US007115358B2

(12) United States Patent
Funakubo et al.

(10) Patent No.: US 7,115,358 B2
(45) Date of Patent: Oct. 3, 2006

(54) BLACK AND WHITE PHOTOTHERMOGRAPHIC MATERIAL AND IMAGE FORMING METHOD

(75) Inventors: Takeshi Funakubo, Kanagawa (JP); Takeshi Suzumoto, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 11/133,299

(22) Filed: May 20, 2005

(65) Prior Publication Data

US 2005/0266361 A1 Dec. 1, 2005

(30) Foreign Application Priority Data

May 24, 2004 (JP) ..... 2004-153912

(51) Int. Cl.

| | |
|---|---|
| ***G03C 1/05*** | (2006.01) |
| ***G03C 1/494*** | (2006.01) |
| ***G03C 1/00*** | (2006.01) |
| ***G03C 5/16*** | (2006.01) |

(52) U.S. Cl. ..... 430/567; 430/570; 430/617; 430/618; 430/619; 430/620; 430/348; 430/349; 430/350

(58) Field of Classification Search ..... 430/567, 430/570, 617, 618, 619, 620, 348, 349, 350
See application file for complete search history.

(56) References Cited

U.S. PATENT DOCUMENTS

| | | | | |
|---|---|---|---|---|
| 6,576,410 | B1 | 6/2003 | Zou et al. | |
| 6,649,337 | B1 * | 11/2003 | Hioki et al. | 430/619 |
| 2005/0208437 | A1 * | 9/2005 | Ohzeki | 430/619 |
| 2005/0214702 | A1 * | 9/2005 | Ohzeki | 430/619 |

* cited by examiner

*Primary Examiner*—Geraldine Letscher
(74) *Attorney, Agent, or Firm*—Margaret A. Burke; Sheldon J. Moss

(57) ABSTRACT

The present invention provides a black and white photothermographic material having, on at least one side of a support, an image forming layer containing at least a photosensitive silver halide, a non-photosensitive organic silver salt, a reducing agent for silver ions, and a binder, as well as an image forming method. The black and white photothermographic material is characterized in that 1) the non-photosensitive organic silver salt includes at least one compound selected from the group consisting of a silver salt of an azole compound and a silver salt of a mercapto compound, and 2) the photosensitive silver halide has a spectral sensitizing dye in the form of a multilayer adsorbed on its surface.

According to the invention, an improved black and white photothermographic material and image forming method realizing high sensitivity, favorable gradation, and less dependence on developing process conditions are provided.

27 Claims, 1 Drawing Sheet

BLACK AND WHITE PHOTOTHERMOGRAPHIC MATERIAL AND IMAGE FORMING METHOD

CROSS-REFERENCE TO RELATED APPLICATION

This application claims priority under 35 USC 119 from Japanese Patent Application No. 2004-153912, the disclosure of which is incorporated by reference herein.

BACKGROUND OF THE INVENTION

1. Field of the Invention

The present invention relates to a black and white photothermographic material and an image forming method. More particularly, the invention relates to a high image quality black and white photothermographic material for medical use and an image forming method using the same.

2. Description of the Related Art

In recent years, in the medical field and the graphic arts field, there has been a strong desire for providing a dry photographic process from the viewpoints of protecting the environment and economy of space. Further, the development of digitization in these fields has resulted in the rapid development of systems in which image information is captured and stored in a computer, and then when necessary processed and output by transmitting it to a desired location. Here the image information is output onto a photosensitive material using a laser image setter or a laser imager, and developed to form an image at the location. It is necessary for the photosensitive material to be able to record an image with high-intensity laser exposure and that a clear black-tone image with a high resolution and sharpness can be formed. While various kinds of hard copy systems using pigments or dyes, such as ink-jet printers or electrophotographic systems, have been distributed as general image forming systems using such digital imaging recording materials, images on the digital imaging recording materials obtained by such general image forming systems are insufficient in terms of the image quality (sharpness, granularity, gradation, and tone) needed for medical images used in making diagnoses, and high recording speeds (sensitivity). These kinds of digital imaging recording materials have not reached a level at which they can replace medical silver halide film processed with conventional wet development.

Photothermographic materials utilizing organic silver salts are already known. Photothermographic materials generally comprise an image forming layer in which a reducible silver salt (for example, an organic silver salt), a photosensitive silver halide, and if necessary, a toner for controlling the color tone of developed silver images are dispersed in a binder.

Photothermographic materials form a black silver image by being heated to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed on the exposed region. There is much literature in which photothermographic materials are described, and the Fuji Medical Dry Imager FM-DPL is an example of a medical image forming system that has been made commercially available.

Photothermographic materials using a silver salt of a nitrogen-containing heterocyclic compound as an organic silver salt and a hydrophilic binder such as gelatin are disclosed in U.S. Pat. No. 6,576,410.

SUMMARY OF THE INVENTION

A first aspect of the invention is to provide a black and white photothermographic material comprising, on at least one side of a support, an image forming layer comprising at least a photosensitive silver halide, a non-photosensitive organic silver salt, a reducing agent for silver ions, and a binder, wherein 1) the non-photosensitive organic silver salt comprises at least one compound selected from the group consisting of a silver salt of an azole compound and a silver salt of a mercapto compound, and 2) the photosensitive silver halide has a spectral sensitizing dye in the form of a multilayer adsorbed on its surface.

A second aspect of the invention is to provide an image forming method comprising (a) providing a black and white photothermographic material comprising, on at least one side of a support, an image forming layer comprising at least a photosensitive silver halide, a non-photosensitive organic silver salt, a reducing agent for silver ions, and a binder, wherein 1) the non-photosensitive organic silver salt comprises at least one compound selected from the group consisting of a silver salt of an azole compound and a silver salt of a mercapto compound, and 2) the photosensitive silver halide has a spectral sensitizing dye in the form of a multilayer adsorbed on its surface; and (b) subjecting the black and white photothermographic material to imagewise exposure and thermal development, wherein the imagewise exposure comprises bringing the black and white photothermographic material into close contact with a fluorescent intensifying screen containing a fluorescent substance, wherein 50% or more of emission light of the fluorescent substance has a wavelength of 350 nm to 420 nm, and applying imagewise X-ray exposure.

DETAILED DESCRIPTION OF THE INVENTION

Figure 1:
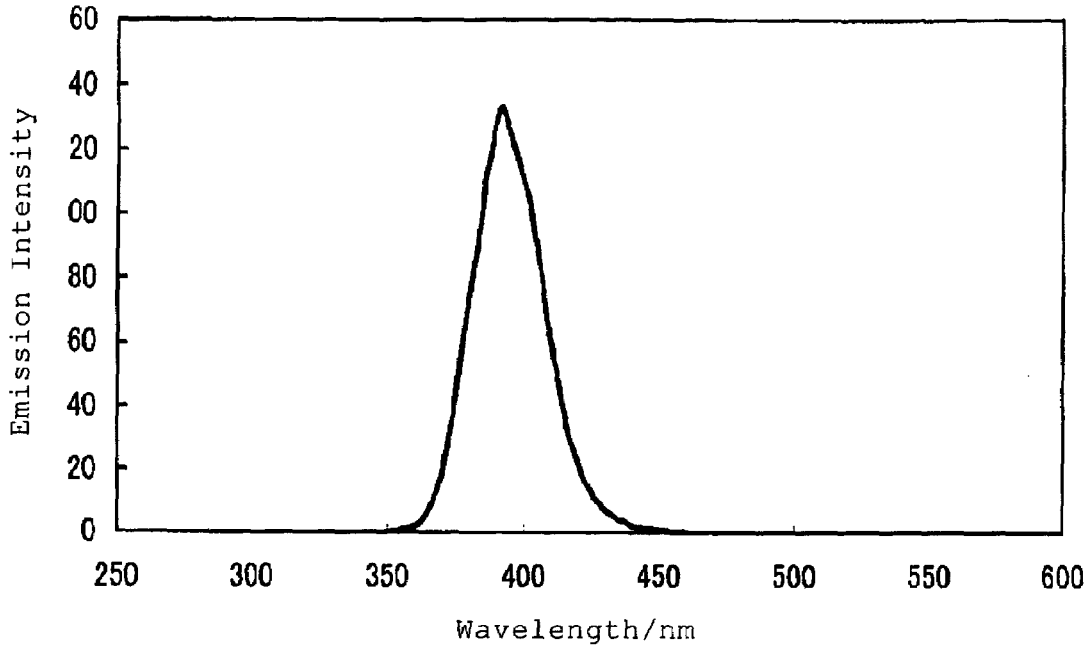
FIG. 1 shows an emission spectrum of a fluorescent intensifying screen A.

An object of the present invention relates to an improved black and white photothermographic material and an improved method of forming an image and, in particular, is to provide a black and white photothermographic material and a method of forming an image, which exhibit high image quality with high sensitivity and low variations in sensitivity and fog with respect to variations in environmental conditions at development.

For black and white photothermographic materials utilizing a silver salt of a nitrogen-containing heterocyclic compound as an organic silver salt, there exist problems such as in that sensitivity is low and in that gradation expressed by a photographic characteristic curve is low in contrast and thus unfavorable. Furthermore, another problem that has become obvious is that the obtained color tone of developed silver images varies due to changes in developing process conditions, such as temperature change in a thermal developing apparatus, temperature and humidity changes in environmental conditions, or the like. The inventors found that the use of a photosensitive silver halide emulsion according to the present invention can provide an effective means for solving the above problems, which led to the achievement of the present invention.

As an image forming method for medical use utilizing black and white photothermographic materials, the inventors have further discovered an image forming method in which the black and white photothermographic material is closely contacted with a fluorescent intensifying screen containing a fluorescent substance, wherein 50% or more of emission light of the fluorescent substance has a wavelength of 350 nm to 420 nm, and the assembly is subjected to X-ray exposure, and thereby arrived at the present invention.

The present invention will be described in detail below.

1. Black and White Photothermographic Material

In the present invention, a photographic characteristic curve is a D-log E curve representing a relationship between the common logarithm (log E) of a light exposure value, i.e., the exposure energy, and the optical density (D), i.e., a scattered light photographic density, by plotting the former on the abscissa axis and the latter on the ordinate axis.

Fog in the present invention refers to an optical density of an unexposed portion. Sensitivity in the present invention means the reciprocal of the light exposure value (E) necessary to give a density of fog+(optical density of 1.0)

Average gradient in the present invention is expressed as a gradient of a line joining the points at fog+(optical density of 0.5) and fog+(optical density of 2.0) on the photographic characteristic curve (i.e., the value equals tan θ when the angle between the line and the horizontal axis is θ). In the present invention, an average gradient is from 1.8 to 4.3, and preferably from 2.2 to 3.2.

The black and white photothermographic material of the present invention has, on at least one side of a support, an image forming layer comprising a photosensitive silver halide, a non-photosensitive organic silver salt, a reducing agent, and a binder. The image forming layer may be disposed on one side, or may be disposed on both sides of the support. Further, the image forming layer may preferably have disposed thereon a surface protective layer, or a back layer, a back protective layer, or the like may be preferably disposed on the opposite side of the support from the image forming layer.

The non-photosensitive organic silver salt of the present invention comprises at least one compound selected from the group consisting of a silver salt of an azole compound and a silver salt of a mercapto compound.

The non-photosensitive organic silver salt of the present invention is preferably a silver salt of a nitrogen-containing heterocyclic compound, more preferably at least one compound selected from the group consisting of a silver salt of a triazole compound and a silver salt of a tetrazole compound, and particularly preferably a silver salt of a benzotriazole compound.

An alternative preferred non-photosensitive organic silver salt is at least one selected from the group consisting of a silver salt of an aliphatic mercapto compound and a silver salt of a heterocyclic mercapto compound, and more preferably a silver salt of an aliphatic mercapto compound having 10 or more carbon atoms.

The constitutions and preferable components of these layers will be explained in detail below.

(Photosensitive Silver Halide)

The photosensitive silver halide used in the present invention is spectrally sensitized by a spectral sensitizing dye and the spectral sensitizing dye is adsorbed in the form of a multilayer on the surface of the photosensitive silver halide.

The photosensitive silver halide used in the present invention will be described in detail.

1) Halogen Composition

For the photosensitive silver halide used in the invention, there is no particular restriction on the halogen composition and silver chloride, silver chlorobromide, silver bromide, silver iodobromide, silver iodochlorobromide and silver iodide can be used. Among these, silver bromide, silver iodobromide, and silver iodide are preferable.

One of the preferable photosensitive silver halide used in the invention has an average silver bromide content of 60 mol % or higher, and more preferably 80 mol % or higher.

Another preferable photosensitive silver halide used in the invention is a high silver iodide content-silver halide having an average silver iodide content of 40 mol % or higher. More preferably, the average silver iodide content is 80 mol % or higher and, even more preferably, 90 mol % or higher.

Other components are not particularly limited and can be selected from silver chloride, silver chlorobromide, silver bromide, silver iodobromide, silver iodochlorobromide, silver iodide, and the like.

The distribution of the halogen composition in a grain may be uniform or the halogen composition may be changed stepwise, or it may be changed continuously. Further, a silver halide grain having a core/shell structure can be preferably used. Preferred structure is a twofold to fivefold structure and, more preferably, core/shell grain having a twofold to fourfold structure can be used. Further, a technique of localizing silver bromide or silver iodide to the surface of a silver chloride, silver bromide, or silver chlorobromide grains can also be used preferably.

2) Method of Grain Formation

The method of forming photosensitive silver halide is well-known in the relevant art and, for example, methods described in Research Disclosure No. 17029, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in Japanese Patent Application Laid-Open (JP-A) No. 11-119374 (paragraph Nos. 0217 to 0224) and methods described in JP-A Nos. 11-352627 and 2000-347335 are also preferred.

According to the method of forming tabular grains, preferably used are those described in JP-A Nos. 59-119350 and 59-119344. As for forming dodecahedral grains, tetradecahedral grains, and octahedral grains, the methods described in JP-A Nos. 2002-081020, 2003-287835, and 2003-287836 can be used for reference.

3) Grain Size

The equivalent circular diameter and grain thickness of tabular grains can be determined by taking a transmission electron microscopic photograph by a replica method. The diameter (equivalent circular diameter) of a circle having an area equal to the projected area of parallel outer surfaces of individual grain and the grain thickness are measured thereby. In this case, the grain thickness is calculated from the length of a shadow of the replica.

In the case of non-tabular grain, the diameter of a circle having an area equal to the projected area of the biggest grain is taken as the equivalent circular diameter of the grain. The grain thickness of non-tabular grain, for example, in the case of a triangular form where a plane parallel to the bottom plane does not exist, the distance between the top and the bottom is taken as the grain thickness.

The non-tabular grains are not preferred because of their small specific surface area. If the ratio of these grains is high, it is difficult to accomplish high sensitivity. In the case where the equivalent circular diameter of tabular grain is smaller, high sensitization is also hard because of the small grain size. Further, when the grain is thick, it is very hard to keep the ratio of sensitivity/granularity high, because of the small specific surface area. A mean circular equivalent diameter of the grains in the present invention is preferably in a range from 0.3 μm to 8.0 μm, and more preferably from 0.4 μm to 8.0 μm. A mean grain thickness is preferably in a range from 0.01 μm to 0.3 μm, more preferably from 0.015 μm to 0.25 μm, and even more preferably from 0.02 μm to 0.2 μm. In the case of so-called epitaxy emulsion which has a protrude, the grain thickness can be determined by observing the thickness of the host grains and the section prepared by slicing a thin film of the coatings by a transmission electron microscope.

Concerning the silver halide grain of the present invention, a variation coefficient an equivalent circular diameter distribution of all grains is preferably 40% or less, more preferably 30% or less, and even more preferably 20% or less. A variation coefficient of a grain thickness distribution of all grains is preferably 20% or less. The term "a variation coefficient of an equivalent circular diameter distribution" used herein means a value obtained by dividing a standard deviation of equivalent circular diameter by mean equivalent circular diameter and multiplying the resultant by 100. The term "a variation coefficient of a grain thickness distribution" used herein means a value obtained by dividing a standard deviation of grain thickness by mean grain thickness and multiplying the resultant by 100.

4) Grain Form

While examples of forms of silver halide grains in the invention can include cubic grains, octahedral grains, tetradecahedral grains, dodecahedral grains, tabular grains, spherical grains, rod shape grains, potato-like grains, and the like, preferable in the invention are dodecahedral grains, tetradecahedral grains, and tabular grains. The term "dodecahedral grain" means a grain having faces of (001), {1(−1)0}, and {101} the term "tetradecahedral grain" means a grain having faces of (001), {100}, and {101}. Herein, the {100} face and {101} face express a family of crystallographic faces equivalent to (100) face and (101) face, respectively.

According to the method of forming dodecahedral, tetradecahedral, and octahedral silver iodide grains, the methods described in JP-A Nos. 2003-287835 and 2003-287836 can be used for reference.

As the form of the photosensitive silver halide in the invention, tabular grains having a mean aspect ratio of 2 or more are preferred, more preferred are tabular grains having a mean aspect ratio of 2 to 100, and further preferred are tabular grains having a mean aspect ratio of 5 to 80. An aspect ratio is a value obtained by dividing the equivalent circular diameter by thickness.

The silver halide having high silver iodide content of the invention can take a complicated form, and as the preferable form, there are listed, for example, connecting grains as shown in R. L. JENKINS et al., J. of Phot. Sci., vol. 28 (1980), p 164, FIG. 1. Tabular grains as shown in FIG. 1 of the same literature can also be preferably used. Silver halide grains which are rounded at corners can also be used preferably. The surface indices (Miller indices) of the outer surface of a photosensitive silver halide grain is not particularly restricted, and it is preferable that the ratio occupied by the [100] face is large, because of showing high spectral sensitization efficiency when a spectral sensitizing dye is adsorbed. The ratio is preferably 50% or more, more preferably 65% or more and, further preferably 80% or more. The ratio of the [100] face, Miller index, can be determined by a method described in T. Tani; J. Imaging Sci., vol. 29, page 165, (1985) utilizing adsorption dependency of the [111] face and [100] face in adsorption of a sensitizing dye.

5) Heavy Metal

The photosensitive silver halide grain of the invention can contain metals or complexes of metals belonging to groups 3 to 14 of the periodic table (showing groups 1 to 18). Preferably, the photosensitive silver halide grain can contain metals or complexes of metals belonging to groups 6 to 10 of the periodic table. The metal or the center metal of the metal complex from groups 6 to 10 of the periodic table is preferably ferrum, rhodium, ruthenium, or iridium. The metal complex may be used alone, or two or more kinds of complexes comprising identical or different species of metals may be used together. The content is preferably in a range from $1\times10^{-9}$ mol to $1\times10^{-3}$ mol per 1 mol of silver. The heavy metals, metal complexes and the addition method thereof are described in JP-A No. 7-225449, in paragraph Nos. 0018 to 0024 of JP-A No. 11-65021, and in paragraph Nos. 0227 to 0240 of JP-A No. 11-119374.

In the present invention, a silver halide grain having a hexacyano metal complex present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion, and lithium ion, ammonium ion, and alkyl ammonium ion (for example, tetramethyl ammonium ion, tetraethyl ammonium ion, tetrapropyl ammonium ion, and tetra(n-butyl)ammonium ion), which are easily miscible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters, amides, or the like) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$, per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of an emulsion formation step prior to a chemical sensitization step, of conducting chalcogen sensitization such as sulfur sensitization, selenium sensitization, and tellurium sensitization or noble metal sensitization such as gold sensitization, during a washing step, during a dispersion step and before a chemical sensitization step. In order not to grow fine silver halide grains, the hexacyano metal complex is rapidly added preferably after the grain is formed, and it is preferably added before completion of an emulsion formation step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complexes is added after addition of an aqueous silver nitrate just before completion of grain formation, it can be adsorbed to the outermost surface of the silver halide grain and most of them form an insoluble salt with silver ions on the surface of the grain. Since silver salt of hexacyano iron (II) is a less soluble salt than AgI, re-dissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No. 11-84574, in paragraph Nos. 0025 to 0031 of JP-A No. 11-65021, and paragraph Nos. 0242 to 0250 of JP-A No. 11-119374.

6) Gelatin

As the gelatin contained in the photosensitive silver halide emulsion used in the invention, various kinds of gelatins can be used.

It is necessary to maintain an excellent dispersion state of a photosensitive silver halide emulsion in a coating solution containing an organic silver salt, and gelatin having a molecular weight of 10,000 to 1,000,000 is preferably used. Phthalated gelatin is also preferably used. These gelatins may be used at grain formation or at the time of dispersion after desalting treatment and it is preferably used at grain formation.

7) Sensitizing Dye

The spectral sensitizing dye according to the present invention has a dye chromophore in the molecular structure. The dye chromophore may exist as a partial structure of dye, or the dye chromophore itself may form the sensitizing dye. In the latter case, the dye chromophore represents the sensitizing dye.

The dye chromophores of the present invention are explained referring to "Chromophore (1)" below.

<Chromophore (1)>

The "chromophore" used herein is defined in Rikagaku Jiten (Physicochemical Dictionary 5th Ed.), Iwanami Shoten, page 1052, (1998), and means an atomic group which work out to a main cause for the absorption band of a molecular, where any atomic groups, for example, an atomic group having an unsaturated bond such as C═C, N═N, or the like may be used.

Specific examples of the dye chromophore include a cyanine dye, a styryl dye, a hemicyanine dye, a merocyanine dye (including a zeromethine merocyanine dye (a simple merocyanine)), a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarylium dye, a croconium dye, an azamethine dye, a coumarin dye, an arylidene dye, an anthraquinone dye, a triphenyl methane dye, an azo dye, an azomethine dye, a spiro compound, a metallocene dye, a fluorenone dye, a fulgide dye, a perylene dye, a phenazine dye, a phenothiazine dye, a quinon dye, an indigo dye, a diphenylmethane dye, a polyene dye, a acridine dye, an acridinone dye, a diphenylamine dye, a quinacridone dye, a quinophthalone dye, a phenoxazine dye, a phthaloperylene dye, a porphin dye, a chlorophile dye, a phthalocyanine dye, and a metal complex dye.

Among these, preferred are a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarylium dye, a croconium dye, and a methine chromophore such as an azamethine dye. More preferred are a cyanine dye, a merocyanine dye, a trinuclear merocyanine dye, a tetranuclear merocyanine dye, a rhodacyanine dye, and an oxonol dye. Even more preferred are a cyanine dye, a merocyanine dye, a rhodacyanine dye, and an oxonol dye. Particularly preferred are a cyanine dye and a merocyanine dye, and most preferred is a cyanine dye.

These dyes are described in detail in the following "Literature concerning dye (2)".

<Literature Concerning Dye (2)>

F. M. Harmer, "Hetreocyclic Compounds—Cyanine Dyes and Related Compounds", John Wiley & Sons, New York, London, (1964), D. M Sturmer, "Heterocyclic Compounds—Special Topics in Heterocyclic Chemistry" Chapter 18, paragraph 14, pages 482 to 515, John Wiley & Sons, New York, London (1977), and "Rodd's Chemistry of Carbon Compounds", 2nd. Ed., vol. IV, part B, Chapter 15, pages 369 to 422, Elsevier Science Publishing Company Inc., New York, (1977).

In addition to the above, the dyes described in the following references are preferably used. Research Disclosure (RD), item 17643, pages 23 to 24, RD, item 18716, page 648, right column to page 649, right column, RD item 308119, page 996, right column to page 998, right column, and EP 0565096 A1, page 65, lines 7 to 10.

Dyes having a partial structure or a structure represented by formulae and examples can be preferably used, described in U.S. Pat. No. 5,747,236 (pages 30 to 39), U.S. Pat. No. 5,994,051 (pages 32 to 43), U.S. Pat. No. 5,340,694 (pages 21 to 58, but in the dyes represented by (XI), (XII), and (XIII), the numbers of $n_{12}$, $n_{15}$, $n_{17}$, and $n_{18}$ are not restricted and each represents an integer of 0 or more (preferably 4 or less)).

Furthermore, dyes having a partial structure or a structure represented by formulae and examples can be preferably used, described in JP-A Nos. 10-239789, 11-133531, 2000-267216, 2000-275772, 2001-75222, 2001-75247, 2001-75221, 2001-75226, 2001-75223, 2001-255615, 2002-23294, 10-171058, 10-186559, 10-197980, 2000-81678, 2001-5132, 2001-166413, 2002-49113, 64-91134, 10-110107, 10-171058, 10-226758, 10-307358, 10-307359, 10-310715, 2000-231174, 2000-231172, 2000-231173, and 2001-356442, EP Nos. 0985965A, 0985964 A, 0985966 A, 0985967 A, 1085372 A, 1085373A, 1172688A, 1199595A, and 887700 A1, JP-A Nos. 10-239789, 2001-75222, and 10-171058.

Next, the multilayered adsorption of the present invention is explained. In the present invention, the multilayered adsorption used herein means a state where a dye chromophore is adsorbed in one or more layers onto the surface of a silver halide grain (in other words, laminated).

More specifically, for example, the method of dye adsorption on the surface of silver halide grains in an amount which is more than a single layer saturated coverage amount by utilizing molecular interaction, and the method of dye adsorption on silver halide grain utilizing compounds having a plurality of dye chromophores (where preferably, the dye chromophores are not conjugated) (namely, a multichromophore dye compound or linked type dye) are described in the following "Patent list (3) concerning multilayered adsorption". Among them, the multilayered adsorption preferably consists of bonding dye chromophores to each other by an attractive force except covalent bond force.

<Patent List Concerning Multilayered Adsorption (3)>

JP-A Nos. 10-239789, 11-133531, 2000-267216, 2000-275772, 2001-75222, 2001-75247, 2001-75221, 2001-75226, 2001-75223, 2001-255615, 2002-23294, 10-171058, 10-186559, 10-197980, 2000-81678, 2001-5132, 2001-166413, 2002-49113, 64-91134, 10-110107, 10-171058, 10-226758, 10-307358, 10-307359, 10-310715, 2000-231174, 2000-231172, 2000-231173, and 2001-356442, EP Nos. 0985965A, 0985964A, 0985966A, 0985967A, 1085372A, 1085373A, 1172688A, 1199595A, and 887700A1, all of the above disclosures of which are incorporated herein by reference.

In addition, the combined use with each technology described in JP-A Nos. 10-239789, 2001-75222, and 10-171058 is preferred.

In the present invention, the state where a dye chromophore is adsorbed in the form of a multilayer on the surface of a silver halide grain means a silver halide emulsion where a dye chromophore is adsorbed in one or more layers onto the surface of a silver halide grain, and also means a state where the amount of adsorbed dye chromophore per unit layer is larger than the single layer saturated coverage amount, by defining the saturated adsorbed amount per unit surface area achieved by a dye having a smallest dye occupied area on the surface of silver halide grain as a single layer saturated coverage amount among the sensitizing dyes added to the emulsion.

The number of adsorbed layers means an amount of adsorbed dye chromophore per unit grain surface area based on the single layer saturated coverage amount. In the case of multichromophore dye compound, the number of adsorbed layers may be based on the dye occupied area of dyes having individual dye chromophore in their unlinked state.

One example is the dye having a dye chromophore where the linked part is changed to alkyl group or alkylsulfone group.

The dye occupied area can be determined from an adsorption isotherm showing a relationship between a free dye concentration and an amount of adsorbed dye, and a grain surface area. The adsorption isotherm can be obtained by referring to, for example, the method described in A. Herz et al, "Adsorption from Aqueous Solution", Advances in Chemistry Series, No. 17, page 173 (1968).

For determining the amount of adsorbed dye to an emulsion grain, two methods may be used, namely, one is a method of centrifuging an emulsion adsorbed by a dye, separating the emulsion grains from the supernatant aqueous solution of gelatin, measuring the spectral absorption of the supernatant to obtain a non-adsorbed dye concentration, and subtracting the concentration from the addition amount of dye, thereby determining the amount of adsorbed dye. And another is a method of drying the precipitated emulsion grains, dissolving a predetermined weight of the precipitate in a mixed solution of a silver halide solvent and a dye solubilizing agent, for example, a mixed solution of an aqueous solution of sodium thiosulfate and methanol, and measuring the spectral absorption, thereby determining the amount of adsorbed dye. In the case where a plurality of dyes are used, the amount of adsorbed individual dye may also be determined using a means such as high performance liquid chromatography.

The method of determining the amount of adsorbed dye by quantitating the amount of dye in the supernatant is described, for example, in W. West et al, Journal of Physical Chemistry, vol. 56, page 1054, (1952). However, under the condition where the addition amount of dye is large, even non-adsorbed dyes may precipitate and the exact determination of the adsorption amount may not be obtained by the method of quantitating the concentration in the supernatant.

On the other hand, according to the method of dissolving the precipitated silver halide grains and measuring the amount of adsorbed dye, the amount of the dye adsorbed to grains can be exactly determined because the emulsion grain is faster in the sedimentation velocity, and the grains and the precipitated dye can be easily separated. This method is most reliable for determining the amount of adsorbed dye.

As one example of the method for measuring the surface area of a silver halide grain, a method of taking a transmission electron microscopic photograph by a replica method and calculating the shape and size of individual grain may be used. In this case, the thickness of a tabular grain is calculated from the length of a shadow of the replica. The transmission electron microscopic photograph may be taken by a method described, for example, in Denshi Kenbikyou Shiryo Gijutsu Shu (Electron Microscopic Sample Technologies), edited by Nippon Denshi Kenbikyou Gakkai, Seibundo Shinko Inc., (1970), and P. B. Hirsch et al, Electron Microscopy of Thin Crystals, Butterworths, London, (1965).

Other examples of the measuring method are described in A. M. Kragin et al, The Journal of Photographic Science, vol. 14, page 185 (1966), J. F. Paddy, Transactions of the Faraday Society, vol. 60, page 1325, (1964), S. Boyer et al, Journal de Chimie Physique et de Physicochimie Biologique, vol. 63, page 1123 (1963), W, West et al, Journal of Physical Chemistry, vol. 56, page 1054, (1952), and E. Klein et al, International Coloquium, edited by H. Sauvernier, and Scientific Photography, Liege, (1959).

The dye occupied area of individual grain may be experimentally determined by the above described methods, however, the molecular occupied area of sensitizing dyes used in the art is usually present almost in the vicinity of 0.8 $nm^2$, therefore, the number of adsorbed layers can be roughly estimated by a simple method of counting the dye occupied area of all dyes as 0.8 $nm^2$.

The dye chromophore is preferably adsorbed to a silver halide grain in 1.3 layers or more, more preferably 1.5 layers or more, and particularly preferably in 1.7 layers or more. Although there is no particular restriction concerning the upper limit, it is preferably 10 layers or less, more preferably 5 layers or less, and particularly preferably 3 layers or less.

The silver halide emulsion of the present invention preferably contains a silver halide grain having a light absorption intensity of 100 or more in the case of a grain having a spectral absorption maximum wavelength of 500 nm or more, and having a light absorption intensity of 60 or more in the case of a grain having a spectral absorption maximum wavelength of less than 500 nm, and thereby accounting for a half or more of the total projected area of all silver halide grains. In the case of a grain having a spectral absorption maximum wavelength of 500 nm or more, the light absorption intensity is preferably 150 or more, more preferably 170 or more, and particularly preferably 200 or more. In the case of a grain having a spectral absorption maximum wavelength of less than 500 nm, the light absorption intensity is preferably 90 or more, more preferably 100 or more, and particularly preferably 120 or more. Although there is no particular restriction concerning the upper limit, it is preferably 2,000 or less, more preferably 800 or less, and particularly preferably 400 or less.

The "light absorption intensity" used herein means an intensity of light absorption area by a sensitizing dye per unit surface area of grains and defined as a value obtained, assuming that the quantity of light incident on the unit grain surface area is 10 and the quantity of light absorbed into a sensitizing dye on the surface is 1, by integrating the optical density Log ($I_0/(I_0-I)$) with respect to the wavenumber ($cm^{-1}$). The integration range is from 5000 $cm^{-1}$ to 35000 $cm^{-1}$.

In addition to the afore-mentioned measurement of the amount of adsorbed dye, by measuring light absorption intensity of 20 or more grains selected randomly, the ratio of grains where dyes are adsorbed in multilayer can be roughly estimated.

By the measurement of the amount of adsorbed dye, an average number of dye-adsorbed-layers of all grains can be determined. On the other hand, by the measurement of the light absorption intensity with a microspectrometer described below, an approximate average value of light absorption intensity of the individual grain can be obtained. The ratio of (average number of adsorbed dye layers)/(approximate average light absorption intensity) is calculated and then by multiplying the calculated value by the light absorption intensity of grains to be measured. Thereby, the number of dye adsorbed layers of the grain to be measured can be roughly estimated.

As mentioned above, the ratio of grains, which have more than one adsorbed-dye-layer, to all grains measured can be obtained. The obtained ratio presents a rough ratio of grains where dyes are adsorbed in multilayer. The ratio to total projected area can be easily obtained by measuring concurrently the projected area of grains where the light absorption intensities are measured. In the silver halide emulsion of the present invention, the ratio of silver halide grains where dye chromophores are adsorbed in multilayer on the surface of silver halide grain is preferably 70% or more, and more preferably 90% or more, with respect to the total projected area.

One example of the method for measuring the light absorption intensity is a method using a microspectrophotometer. A microspectrophotometer is a device capable of measuring the absorption spectrum of a microscopic area and can measure the transmission and reflective spectrum of one grain. The absorption spectrum can be obtained by the measurement of the above spectrum. The measurement of absorption spectrum of one grain by the microspectrometry is described in the report by Yamashita et al (Nippon Shashin Gakkai, (1996), Nendo Nenji Taikai Koen Yoshi Shu (Lecture Summary at Annual Meeting of Japan Photographic Association in 1996), page 15. From this absorption spectrum, an absorption intensity per one grain can be obtained, however, the light which transmits the grain is absorbed by two surfaces of upper surface and lower surface, therefore, the absorption intensity per unit area on the grain surface can be obtained as a half of the absorption intensity per one grain obtained by the above described method.

At this time, the segment for the integration of absorption spectrum is from 5000 $cm^{-1}$ to 35000 $cm^{-1}$ in the definition, however, in experiments, the segment for the integration may contain the region of 500 $cm^{-1}$ shorter or longer than the segment having an absorption by sensitizing dye.

The light absorption intensity is a value indiscriminately determined by the oscillator strength of sensitizing dye and the number of adsorbed molecules per unit area, therefore, the oscillator strength of sensitizing dye, the amount of adsorbed dye, and the surface area of grain are determined, and then these can be converted to the light absorption intensity.

The oscillator strength of a sensitizing dye can be experimentally determined as the value proportional to the absorption area intensity (optical density×$cm^{-1}$) of sensitizing dye solution. By defining that the absorption area intensity per 1 mol/L of sensitizing dye is A (optical density×$cm^{-1}$), the amount of adsorbed sensitizing dye is B (mol/molAg) and the surface area of grain is C ($m^2$/molAg), the light absorption intensity can be determined from the following formula within an error of about 10%.

$$0.156 \times A \times B/C$$

The value calculated from the above formula is substantially the same value as the light absorption intensity (the value obtained by integrating the optical density (Log ($I_0/(I_0-I)$) with respect to the wavenumber ($cm^{-1}$)) by the measurement based on the definition described above.

In the present invention, in the case of ordinary dye having one dye chromophore, the first layer dye means a dye adsorbed on the inner side adjacent to the silver halide grain and the second or upper layer dye means a dye adsorbed outer side adjacent to the first layer dye, but not directly onto the grain, in which the dye is assumed as adsorbed on silver halide grain by the above adsorption amount measurement. In the case of a multichromophore dye compound, the first layer dye means a dye chromophore adsorbed on the inner side adjacent to the silver halide grain, and the second or upper layer dye means a dye chromophore adsorbed outer side adjacent to the inner dye chromophore.

In the present invention, a maximum absorption wavelength of dyes in the second or upper layer is preferably the same or shorter than a maximum absorption wavelength of dyes in the first layer. The wavelength distance between them is preferably from 0 nm to 50 nm, more preferably from 0 nm to 30 nm, and particularly preferably from 0 nm to 20 nm.

The dye in the first layer and the dye in the second or upper layer may have any reduction potential and any oxidation potential, however, the reduction potential of the dye in the first layer is preferably higher than the value obtained by subtracting 0.2 V, more preferably 0.1 V, from the reduction potential of the dye in the second or upper layer. Particularly, the reduction potential of dye in the first layer is preferably higher than the reduction potential of dye in the second or upper layer.

The reduction potential and the oxidation potential can be measured by various methods, however, these are preferably measured by a phase selective or second harmonic AC polarography and thereby the exact value can be obtained. The method for measuring the potential by a phase selective or second harmonic AC polarography is described in Journal of Imaging Science, vol. 30, page 27, (1986).

The dye in the second or upper layer preferably has a luminescent property in dry film. As the kind of luminous dye, the dye having a skeleton structure of dyes used for a dye laser is preferred.

These are described, for example, in Mitsuo Maeda, "Laser Kenkyu (Study on laser)", vol. 8, pages 694, 803, and 958, (1980), and vol. 9, page 85 (1981), and F. Schaefer, "Dye Lasers", Springer (1973).

The luminous yield of the second layer dye itself in dry gelatin film is preferably 0.05 or more, more preferably 0.1 or more, even more preferably 0.2 or more, and particularly preferably 0.5 or more.

In the case where energy transfer is performed from the dye in the second or upper layer to the dye in the first layer by non-equilibrium excitation energy transfer mechanism, the excitation life in the dry gelatin film of the dye part itself in the second layer is preferably longer. In the above case, the luminous yield of the second layer dye may be either higher or lower. The fluorescent life in dry film of the dye part itself in the second layer is preferably 10 ps or more, more preferably 40 ps or more, and even more preferably 160 ps or more. Although there is no particular restriction concerning the upper limit of the fluorescent life of the dye in the second or upper layer, it is preferably 1 ms or less.

It is preferred that the overlap of emission of the dye in the second or upper layer with the absorption of the first layer dye is large. When the emission spectrum of the dye in the second or upper layer is 1(ν), and the absorption spectrum of the dye in the first layer is a (ν), the product 1(ν)×a (ν) is preferably 0.001 or more, more preferably 0.01 or more, even more preferably 0.1 or more, and particularly preferably 0.5 or more.

Herein, ν is a wavenumber and in individual spectrum, the spectra area is normalized to 1.

The energy transfer efficiency of the excitation energy of the second or upper layer dye to the first layer dye is preferably 10% or more, more preferably 30% or more, particularly preferably 60% or more, and most preferably 90% or more. The term "excitation energy of the second or upper layer dye" as used herein means the energy of a dye in the excited state produced by absorbing the light energy by the second or upper layer dye.

In the case where the excitation energy of a certain molecule transfers to another molecule, the excitation energy is considered to transfer through the excitation electron transfer mechanism, such as Forster type model energy transfer mechanism, Dextor model transfer mechanism, or the like. Therefore, it is also preferred for the multilayered adsorption system of the present invention to satisfy the conditions for causing an efficient excitation transfer suggested by these mechanisms.

More preferred is to satisfy the conditions for causing Forster model energy transfer mechanism. In order to elevate the Forster type model energy transfer efficiency, the reduction of the refractive index in the neighborhood of the grain surface is effective.

The efficiency of energy transfer from the second or upper layer dye to the first layer dye can be determined by the analysis of the fluorescent decay velocity of the second layer dye and the dynamics analysis of the light exited state such as the start-up velocity of fluorescence of the first dye layer.

The efficiency of energy transfer from the second or upper layer dye to the first layer dye can be determined as the ratio of (spectral sensitization efficiency by excitation of the second or upper layer dye)/(spectral sensitization efficiency by excitation of the first layer dye).

In the present invention, the dyes adsorbed on the first layer preferably form J aggregate. The dyes of the second or upper layer also may be adsorbed in monomer to form a short wavelength aggregates such as H aggregates, however, particularly preferably adsorbed to form J aggregates. J aggregates are very useful for spectral sensitization by the ordinary monolayer adsorption because of their high absorption coefficients and sharp absorptions, however, more preferably, the second or upper layer dyes themselves have the above spectral characteristics. And also J aggregates exhibit a high fluorescent yield and small Stokes' shift, and therefore, it is preferred that the light energy absorbed by the second or upper layer dye is transferred to the first layer dye whose absorption wavelength is close thereto, by utilizing the Forster-type energy transfer mechanism.

In the case of the emulsion comprising a silver halide grain having a light absorption intensity of 60 or more, or 100 or more, the distance between the shortest wavelength and the longest wavelength each showing 50% of a maximum value Amax of the spectral absorptivity by a sensitizing dye is preferably 120 nm or less, and more preferably 100 nm or less. Further, the distance between the shortest wavelength and the longest wavelength each showing 50% of a maximum value Smax of the spectral sensitivity is preferably 120 nm or less, and more preferably 100 nm or less.

Similarly, the distance between the shortest wavelength and the longest wavelength each showing 80% of Amax and Smax is preferably 20 nm or more, more preferably 100 nm or less, even more preferably 80 nm or less, and particularly preferably 50 nm or less.

And similarly, the distance between the shortest wavelength and the longest wavelength each showing 20% of Amax and Smax is preferably 180 nm or less, more preferably 150 nm or less, particularly preferably 120 nm or less, and most preferably 100 nm or less.

The longest wavelength showing a spectral absorptivity of 50% of Amax and Smax is preferably in a range of from 460 nm to 510 nm, or from 560 nm to 610 nm, or from 640 nm to 730 nm.

Further, when the wavelength showing a maximum spectral absorptivity by dye chromophore in the first layer on silver halide grain is expressed in terms of A1max and the wavelength showing a maximum spectral absorptivity by dye chromophore in the second or upper layer is expressed in terms of A2max, it is preferred that A1max and A2max are in a range of from 400 nm to 500 nm, or from 500 nm to 600 nm, or from 600 nm to 700 nm, or from 700 nm to 1000 nm.

Further, when the wavelength showing a maximum spectral sensitivity by dye chromophore in the first layer on silver halide grain is expressed in terms of S1max and the wavelength showing a maximum spectral sensitivity by dye chromophore in the second or upper layer is expressed in terms of S2max, it is preferred that S1max and S2max are in a range of from 400 nm to 500 nm, or from 500 nm to 600 nm, or from 600 nm to 700 nm, or from 700 nm to 1000 nm.

The multilayered adsorption of dye chromophore by utilizing molecular interaction is explained. The "multilayered adsorption" used herein means the state that the dye chromophore is adsorbed in the form of a multilayer on the surface of silver halide by attractive force except covalent bond where dye chromophores are bonded together.

The attractive force other than covalent bonding force may be any force, however, for example, including van der Waals force (more particularly, this is classified into orientation force working between permanent dipole and permanent dipole, induction force working between permanent dipole and induced dipole, and dispersion force working between temporary dipole and induced dipole), charge transfer force (CT), Coulomb force (electrostatic force), hydrophobic bonding force, hydrogen bonding force, and coordinate bonding force. These forces may be used alone or in combinations of freely selected forces.

Examples of preferred force include van der Waals force, charge transfer force, Coulomb force, hydrophobic bonding force, and hydrogen bonding force, more preferably van der Waals force, Coulomb force, and hydrogen bonding force, and particularly preferably van der Waals force and Coulomb force.

The term "bonded together" used herein means the state where dye chromophores are bound with the attractive force mentioned above. In other words, the energy of the attractive force (namely, adsorption energy (ΔG)) is preferably 15 kJ/mol or more, more preferably 20 kJ/mol or more, and particularly preferably 40 kJ/mol or more. Although there is no particular restriction concerning the upper limit, it is preferably 5000 kJ/mol or less, and more preferably 1000 kJ/mol or less.

Suitable embodiments of preferred method include, for example, a method of the combined use of dyes having an aromatic group, or cationic dye having an aromatic group and anionic dye described in JP-A No. 10-239789, a method of using dyes having polyvalent charge described in JP-A No. 10-171058, a method of using dyes having a hydrophobic group described in JP-A No. 10-186559, a method of using dyes having a covalent bonding group described in JP-A No. 10-197980, a method of using dyes having a trinuclear basic nucleus described in JP-A No. 2001-5132, a method of using dyes having specific hydrophilic and hydrophobic properties described in JP-A No 2001-13614, a method of using dyes having specific intramolecular base described in JP-A No. 2001-75220, a method of using specific dyes other than cyanine dye described in JP-A No. 2001-75221, a method of using dyes having an acid dissociable group with a specific pKa described in JP-A No 2001-152038, a method of using dyes having a specific hydrogen bonding group described in JP-A Nos. 2001-166413, 2001-323180, and 2001-337409, a method of using dyes having specific fluorescent quantum yield described in JP-A No. 2001-209143, a method of using specific decoloring dyes described in JP-A No. 2001-264913, a method of using dyes included in gel matrix described in JP-A No. 2001-343720, a method of using specific infrared dyes described in JP-A No. 2002-23294, a method of using dyes having specific potential described in JP-A No. 2002-99053, and a method of using specific cationic dyes EP Nos. 0985946, 0985965, 0985966, 0985967, 1085372, 1085373, 1172688, and 1199595.

Next, the multilayered adsorption by adsorbing the compound comprising a plurality of dye chromophores onto silver halide grains is explained. The multichromophore dye compound is a dye compound containing a plurality of dye chromophores.

In the above compound, the dye chromophores can be linked by covalent bond, or coordinate bond, preferably linked by covalent bond (here the coordinate bond can be considered as a coordinate bonding force which is one kind of the molecular interaction described in "Patent list (3)".)

In the compounds, the covalent bond or the coordinate bond may preferably be formed beforehand, or in the process of preparation of silver halide photosensitive materials (for example, in silver halide emulsion). The latter can be performed by using the method described in JP-A No. 2000-81678. Preferable is the case where the bond is formed beforehand.

The number of dye chromophores in the multichromophore dye compound is preferably at least two, more preferably from 2 to 7, even more preferably from 2 to 5, particularly preferably 2 to 3, and most preferably 2. The dye chromophores may be the same or different. There is no restriction concerning the dye chromophore, however, preferable are dye chromophores described in "Chromophore (1)" above, similar to those are preferable, and particularly, dye chromophores represented by formulae (QA), (QB), (QC), or (QD) shown below are preferable.

Examples of the multichromophore dye compound include, for example, a multichromophore dye linked by methine chain described in JP-A No. 9-265144, a multichromophore dye combined with oxonol dyes described in JP-A No. 10-226758, a multichromophore dye which has specific benzimidazole nucleus or the like described in JP-A Nos. 10-110107, 10-307358, 10-307359, and 10-310715, a multichromophore dye linked with specific group described in JP-A Nos. 9-265143, 2000-231172, 2000-231173, 2002-55406, 2002-82403, 2002-82404, and 2002-82405, a multichromophore dye prepared in emulsion by using a dye which contains a reactive group described in JP-A No. 2000-81678, a multichromophore dye having specific benzoxazole nucleus described in JP-A No. 2000-231174, a multichromophore dye having specific character or dissociable group described in JP-A No. 2001-311015, a multichromophore dye having specific characteristic feature described in JP-A No. 2001-356442, a multichromophore dye having specific merocyanine described in JP-A No. 2002-90927, a multichromophore dye having specific dissociable group described in JP-A Nos. 2002-90928 and 2002-90929.

The multichromophore dye compound used for the present invention is preferably the compound represented by the following formula (Q).

$$(D_a)r_a([-L_a-]S_a[D_b]q_a)r_b \quad \text{Formula (Q)}$$
$$M_b m_b$$

wherein, Da and Db each represent a dye chromophore. La represents a linking group. Sa represents an integer of 1 to 4. qa represents an integer of 1 to 5. ra and rb each independently represent an integer of 1 to 100. Mb represents a counter ion for balancing the electric charge, and mb represents a number necessary for neutralizing the electric charge of the molecule.

Further, formula (Q) shows that any linking pattern to link the dye chromophores may be available.

The dye chromophore represented by Da and Db is any chromophore, but similar ones to those mentioned in the above "Chromophores (1)" are preferred.

And also, at least one of Da and Db is preferably a dye selected from cyanine or merocyanine dye chromophores, and more preferably, selected from cyanine dye chromophores. Da and Db may be the same or different, however, different is preferred.

In the present invention, in the case where the compound represented by formula (Q) is adsorbed on a silver halide grain, it is preferred that Da is adsorbed on a silver halide grain and Db is not adsorbed directly on a silver halide grain. Namely, the adsorption force of ([-La-] Sa [Db] qa) on silver halide grains is preferably weaker than that of Da.

As mentioned above, Da is preferably a dye part having an adsorptive ability to silver halide grains, where the dye adsorption can be performed by either physical adsorption or chemical adsorption.

The dye chromophore Db having weak adsorptive ability on silver halide grains is preferably a luminous dye. The luminous dye preferably has a skeleton structure of dyes used for a dye laser.

These are described, for example, in Mitsuo Maeda, "Laser Kenkyu (Study of Laser)", vol. 8, pages 694, 803, and 958, and vol. 9, page 85, and F. Schaefer, "Dye Lasers", Springer, (1973).

Further, the absorption maximum wavelength of Da in the photographic silver halide materials is preferably longer than the absorption maximum wavelength of ([-La-] Sa [Db] qa). Furthermore, the luminescence of ([-La-] Sa [Db] qa) preferably overlaps the absorption of Da. Da preferably form a J-aggregate. In addition, in order that the multichromophore dye compound represented by formula (Q) may have an absorption and spectral sensitivity in desired wavelength range, ([-La-] Sa [Db] qa) also preferably forms a J-aggregate.

Da and ([-La-] Sa [Db] qa) may have any reduction potential and any oxidation potential, however, the reduction potential of Da is preferably higher than the value obtained by subtracting 0.2 V from the reduction potential value of ([-La-] Sa [Db] qa).

La represents a linking group (preferably divalent linking group). The linking group may include a single bond (simply called a mere bonding hand). Preferred examples of the linking group include a single bond, or an atom or atomic group comprising at least one selected from the group consisting of a carbon atom, nitrogen atom, sulfur atom, and oxygen atom. Among these, preferred are a single bond or a linking group having 0 to 100 carbon atoms, and preferably 1 to 20 carbon atoms, consisted of one or a combination of the following groups; an alkylene group (for example, methylene, ethylene, trimethylene, tetramethylene, or pentamethylene), an arylene group (for example, phenylene, or naphthylene), an alkenylene group (for example, ethenylene or propenylene), an alkynylene group (for example, ethynylene or propynylene), an amide group, an ester group, a sulfoamide group, a sulfonic acid ester group, an ureido group, a sulfonyl group, a sulfinyl group, a thioether group, an ether group, a carbonyl group, —N(Va)— (where Va represents a hydrogen atom or a monovalent substitutent) and a heterocyclic divalent group (for example, a 6-chloro-1,3,5-triazine-2,4-diyl group, pyrimidine-2,4-diyl group, or a quinoxaline-2,3-diyl group).

The above linking group may have any substitutent. And, these linking groups may contain a ring (an aromatic, or non-aromatic hydrocarbon ring, or a heterocycle).

More preferred are a single bond or a divalent linking group having 1 to 10 carbon atoms consisted of one or a combination of the following groups; an alkylene group having 1 to 10 carbon atoms, (for example, methylene, ethylene, trimethylene tetramehtylene, or pentamethylene), an arylene group having 6 to 10 carbon atoms, (for example, phenylene or naphthylene), an alkenylene group having 2 to 10 carbon atoms (for example, ethenylene or propenylene), an alkynylene group having 2 to 10 carbon atoms (for example, ethynylene or propynylene), an ether group, an amide group, an ester group, a sulfoamide group, a sulfonic acid ester group. These may be substituted by W described above.

La is a linking group which may perform an energy transfer or electron transfer by a through-bond interaction. The through-bond interaction includes a tunnel interaction and a super-exchange interaction. In particular, a through-bond interaction based on a super-exchange interaction is preferred. The through-bond interaction and the super-exchange interaction are the interactions defined by Shammai Speiser, Chem. Rev. vol. 96, page 1960–1963 (1996). As the linking group which can perform the energy transfer or electron transfer by such interaction, those described in Shammai Speiser, Chem. Rev. vol. 96, page 1967–1969 (1996) are preferably used.

Sa represents an integer of 1 to 4. When Sa is 2 or more, Da and Db are linked by plural linking groups. Sa preferably represents an integer of 1 or 2, and more preferably 1. When Sa is 2 or more, the included plural La each may be different from each other.

qa represents an integer of 1 to 5, preferably 1 or 2, and even more preferably 1. ra and rb each independently represent an integer of 1 to 100, preferably an integer of 1 to 5, more preferably 1 or 2, and particularly preferably 1. In case where each of qa, ra, and rb is 2 or more, the included plural Da, La, sa, Db, and qa each may be different linking groups, dye chromophores, and numbers.

The compounds represented by formula (Q) may further be substituted by a dye chromophore.

In formula (Q), the compound preferably has an electric charge of −1 or less as a whole, and more preferably an electric charge of −1.

The dye chromophore used for the present invention is preferably similar to those as mentioned in the above "Chromophore (1)", however, more preferred are methine dye chromophores represented by formulae (QA), (QB), (QC), or (QD) shown below.

Formula (QA)

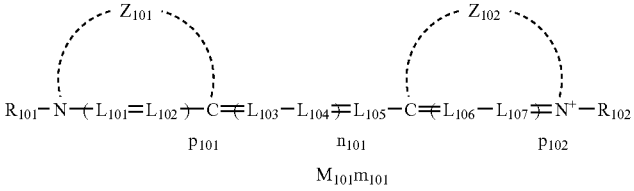

In formula (QA), $L_{101}$, $L_{102}$, $L_{103}$, $L_{104}$, $L_{105}$, $L_{106}$, and $L_{107}$ each independently represent a methine group. $p_{101}$ and $p_{102}$ each independently represent 0 or 1. $n_{101}$ represents 0, 1, 2, 3, or 4. $Z_{101}$ and $Z_{102}$ each represent an atomic group necessary for forming a nitrogen-containing heterocycle. However, a ring may be condensed to these, or these may have a substitutent. $M_{101}$ represents a counter ion for balancing the electric charge, and $m_{101}$ represents a number of 0 or more, necessary for neutralizing the electric charge of the molecule. $R_{101}$ and $R_{102}$ each independently represent one selected from a hydrogen atom, an alkyl group, an aryl group, or a heterocyclic group.

Formula (QB)

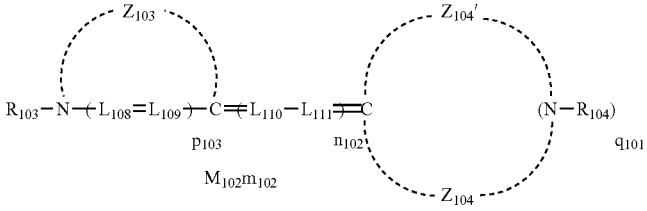

In formula (QB), $L_{108}$, $L_{109}$, $L_{110}$, and $L_{111}$ each independently represent a methine group. $p_{103}$ represents 0 or 1. $q_{101}$ represents 0 or 1. $n_{102}$ represents 0, 1, 2, 3, or 4. $Z_{103}$ represents an atomic group necessary for forming a nitrogen-containing heterocycle. $Z_{104}$ and $Z_{104'}$ represent an atomic group necessary for forming a cyclic or an acyclic acidic terminal group with $(N—R_{104})q_{101}$. However, a ring may be condensed to $Z_{103}$ or $Z_{104}$ and $Z_{104'}$, or, $Z_{103}$ or $Z_{104}$, and $Z_{104'}$ may have a substitutent. $M_{102}$ represents a counter ion for balancing the electric charge. $m_{102}$ represents an integer of 0 or more, necessary for neutralizing the electric charge of the molecule. $R_{103}$ and $R_{104}$ each independently represent one selected from a hydrogen atom, an alkyl group, an aryl group, or a heterocyclic group.

The dye chromophores represented by formulae (QA), (QB), (QC), or (QD) are explained below in detail.

$Z_{101}$, $Z_{102}$, $Z_{103}$, $Z_{105}$, and $Z_{107}$ each represents an atomic group necessary for forming a nitrogen-containing heterocycle, preferably 5 or 6-membered nitrogen-containing heterocycle. However, a ring may be condensed to these, or these may have a substitutent. As for the ring, an aromatic ring, a non-aromatic ring, a hydrocarbon ring, or a heterocycle may be included, but preferably an aromatic ring.

Formula (QC)

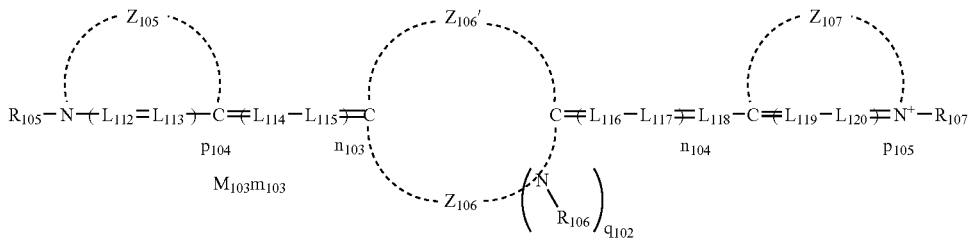

In formula (QC), $L_{112}$, $L_{113}$, $L_{114}$, $L_{115}$, $L_{116}$, $L_{117}$, $L_{118}$, $L_{119}$, and $L_{120}$ each independently represent a methine group. $p_{104}$ and $p_{105}$ each represent 0 or 1. $q_{102}$ represents 0 or 1. $n_{103}$ and $n_{104}$ each represent 0, 1, 2, 3, or 4. $Z_{105}$ and $Z_{107}$ each represent an atomic group necessary for forming a nitrogen-containing heterocycle. $Z_{106}$ and $Z_{106'}$ represent an atomic group necessary for forming a ring with $(N—R_{106})q_{102}$.

However, a ring may be condensed to $Z_{105}$, $Z_{106}$ and $Z_{106'}$, or $Z_{107}$; and $Z_{105}$, $Z_{106}$ and $Z_{106'}$, or $Z_{107}$ may have a substitutent. $M_{103}$ represents an counter ion for balancing the electric charge. $m_{103}$ represents an integer of 0 or more, necessary for neutralizing the electric charge of the molecule. $R_{105}$, $R_{106}$, and $R_{107}$ each independently represent one selected from a hydrogen atom, an alkyl group, an aryl group, or a heterocyclic group.

Preferred examples include an aromatic hydrocarbon ring such as a benzene ring and a naphthalene ring, and an aromatic heterocycle such as pyrazine ring and thiophene ring.

Specific examples of the nitrogen-containing heterocycle include a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a tellurazoline nucleus, a tellurazole nucleus, a benzotellurazole nucleus, a 3,3-dialkylindolenine nucleus (for example, 3,3-dimethylindolenine), an imidazoline nucleus, an imidazole nucleus, a benzimidazole nucleus, a pyrroline nucleus, a 2-pyridine nucleus, a 4-pyridine nucleus, a 2-quinoline nucleus, a 4-quinoline nucleus, a 1-isoquinoline nucleus, a 3-isoquinoline nucleus, an imidazo[4,5-b]quinoxaline nucleus, an oxa- Formula (QD)

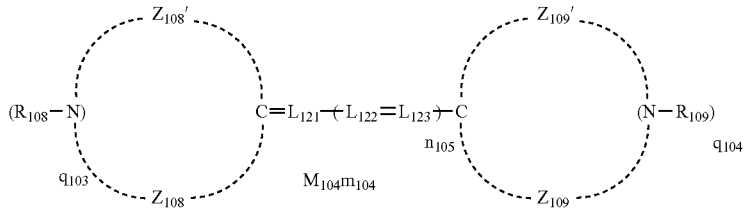

In formula (QD), $L_{121}$, $L_{122}$, and $L_{123}$ each independently represent a methine group. $q_{103}$, and $q_{104}$ each represent 0 or 1. $n_{105}$ represents 0, 1, 2, 3, or 4. $Z_{108}$ and $Z_{108'}$, or $Z_{109}$ and $Z_{109'}$ represent an atomic group necessary for forming a cyclic, or an acyclic acidic terminal group with $(N—R_{108})q_{103}$, or $(N—R_{109})q_{104}$ respectively. However, a ring may be condensed to $Z_{108}$, and $Z_{108'}$, or $Z_{109}$ and $Z_{109'}$, or, $Z_{108}$, and $Z_{108'}$, or $Z_{109}$ and $Z_{109'}$ may have a substitutent. $M_{104}$ represents an atomic group necessary for balancing the electric charge. $m_{104}$ represents a number of 0 or more, necessary to neutralize the molecular charge. $R_{108}$ and $R_{109}$ each independently represent one selected from a hydrogen atom, an alkyl group, an aryl group, or a heterocyclic group.

diazole nucleus, a thiadiazole nucleus, a pyrazole nucleus, a tetrazole nucleus, a pyrimidine nucleus, and the like. Preferred are a benzothiazole nucleus, a benzoxazole nucleus, a 3,3-dialkylindolenine nucleus (for example, 3,3-dimethylindolenine), a benzimidazole nucleus, a 2-pyridine nucleus, a 4-pyridine nucleus, a 2-quinoline nucleus, a 4-quinoline nucleus, a 1-isoquinoline nucleus, and a 3-isoquinoline nucleus.

They may have a substituent or a ring may be condensed to these. Preferred are an alkyl group, an aryl group, an alkoxy group, a halogen atom, aromatic ring condensation, a sulfo group, a carboxyl group, and a hydroxy group.

As examples of the heterocyclic group formed by $Z_{101}$, $Z_{102}$, $Z_{103}$, $Z_{105}$, and $Z_{107}$, there can be mentioned similar groups to the examples of $Z_{11}$, $Z_{12}$, $Z_{13}$, $Z_{14}$, and $Z_{16}$ described in U.S. Pat. No. 5,340,694, paragraphs 23 to 24.

In the case where the dye chromophore represented by formulae (QA), (QB), or (QC) represents a dye chromophore in the first layer, $Z_{101}$, $Z_{102}$, $Z_{103}$, $Z_{105}$, and $Z_{107}$ each preferably represent a benzothiazole nucleus, a benzoxazole nucleus, a 3,3-dialkylindolenine nucleus (for example, 3,3-dimethylindolenine), or a benzimidazole nucleus. More preferable are a benzoxazole nucleus, a benzothiazole nucleus, and a benzimidazole nucleus, and particularly preferable are a benzoxazole nucleus and a benzothiazole nucleus. Preferred substituent on the nucleus include a halogen atom, an aromatic group, and an aromatic ring condensation.

In the case where the dye chromophore represented by formulae (QA), (QB), or (QC) represent a dye chromophore in the second or upper layer, $Z_{101}$, $Z_{102}$, $Z_{103}$, $Z_{105}$, and $Z_{107}$ each preferably represent a benzothiazole nucleus, a benzoxazole nucleus, a 3,3-dialkylindolenine nucleus (for example, 3,3-dimethylindolenine), or a benzimidazole nucleus. More preferable are a benzoxazole nucleus, a benzothiazole nucleus, and a benzimidazole nucleus, and particularly preferable are a benzoxazole nucleus and a benzothiazole nucleus. Preferred substituent W on the nucleus include a halogen atom, an aromatic group, an aromatic ring condensation, and an acidic group.

The acidic group used herein is explained. An acidic group means a group having a dissociable proton.

Embodiments of the acidic group include, for example, a group which a proton dissociates depending on the pKa thereof and the pH of the surrounding, such as a sulfo group, a carboxyl group, a sulfate group, a —$CONHSO_2$— group (a sulfonyl carbamoyl group and a carbonyl sulfamoyl group), a —CONHCO— group (carbonyl carbamoyl group), an —$SO_2NHSO_2$— group (a sulfonylsulfamoyl group), a sulfonamide group, a sulfamoyl group, a phosphate group, a phosphono group, a boron acid group, a phenolic hydroxide group, and the like. For example, proton dissociable acidic groups which can dissociate 90% thereof or more at pH of 5 to 11 are preferred.

More preferable are a sulfo group, a carboxyl group, a —$CONHSO_2$— group, a —CONHCO— group, and a —$SO_2NHSO_2$— group, particularly preferable are a sulfo group and a carboxyl group, and most preferable is a sulfo group.

$Z_{104}$ and $Z_{104'}$ and $(N—R_{104})q_{101}$, $Z_{108}$ and $Z_{108'}$ and $(N—R_{108})q_{103}$, and $Z_{109}$ and $Z_{109'}$ and $(N—R_{109})q_{104}$ represent an atomic group necessary for forming a cyclic or an acyclic acidic terminal group with each together. Any ring may be preferably used herein, but preferred is a heterocycle (preferably 5 or 6-membered heterocycle), and more preferably an acidic nucleus.

Next, the acidic nucleus and the acyclic acidic terminal group are explained. The acidic nucleus and the acyclic acidic terminal group may have any form of the acidic nucleus and acyclic acidic terminal group of conventional merocyanine dyes, respectively. In preferred form, $Z_{104}$, $Z_{108}$, and $Z_{109}$ are a thiocarbonyl group represented by —(C═S)— (including a thioester group, a thiocarbamoyl group, and the like), a carbonyl group represented by —(C═O)— (including an ester group, a carbamoyl group, and the like), a sulfonyl group represented by —($SO_2$)— (including a sulfonic acid ester group, a sulfamoyl group, and the like), a sulfinyl group represented by —(S═O)—, or a cyano group, and more preferably a thiocarbonyl group or a carbonyl group.

$Z_{104'}$, $Z_{108'}$, and $Z_{109'}$ each represent an atomic group necessary for forming an acidic nucleus or an acyclic acidic terminal group. In the case of forming an acyclic acidic terminal group, preferred are a thiocarbonyl group, a carbonyl group, a sulfonyl group, a sulfinyl group, and a cyano group. A structure having an exomethylene where the carbonyl group or thiocarbonyl group forming these acidic nucleus or acyclic acidic terminal group is substituted by the active methylene compound as used for the raw material of the acidic nucleus or acyclic acidic terminal group at the active methylene site, or the repeating structure thereof can also be used.

In the case where the acidic nucleus is substituted by another acidic nucleus, the dye may form so-called trinuclear merocyanine dye, tetranuclear merocyanine dye, or the like. In the case where the acidic terminal group is substituted by another acidic terminal group, the terminal may have a dicyanomethylene group, a cyano group, or the like.

$q_{101}$, $q_{103}$, and $q_{104}$ each represent 0 or 1, and preferably 1.

The acidic nucleus and acyclic acidic terminal group used herein are described, for example, in T. H. James, "The Theory of the Photographic Process", Fourth Edition, published by Macmillan publishing Co., Inc. (1977), pages 197 to 200. Wherein the acyclic acidic terminal group means an acidic, that is, an electron acceptable terminal group which does not form a ring.

Concerning acidic nucleus and acyclic acidic terminal groups, description can be found in U.S. Pat. Nos. 3,567,719, 3,575,869, 3,804,634, 3,837,862, 4,002,480, and 4,925,777, JP-A No. 3-167546, U.S. Pat. Nos. 5,994,051 and 5,747,236.

The acidic nucleus preferably forms a heterocycle containing a carbon atom, a nitrogen atom, and/or a chalcogen atom (typically, oxygen, sulfur, selenium, or tellurium), (preferably a 5 or 6-membered nitrogen-containing heterocycle), and more preferably forms a 5- or 6-membered nitrogen-containing heterocycle containing a carbon atom, a nitrogen atom, and/or a chalcogen atom (typically, oxygen, sulfur, selenium, or tellurium). Embodiments of preferred nucleus are follows;

Nuclei of 2-pyrazoline-5-one, pyrazolidine-3,5-dione, imidazoline-5-one, hydantoin, 2- or 4-thiohydantoin, 2-imino oxazolidine-4-one, 2-oxazoline-5-one, 2-thiooxazolidine-2,5-dione, 2-thiooxazoline-2,4-dione, isooxazoline-5-one, 2-thiazoline-4-one, thiazolidine-4-one, thiazolidine-2,4-dione, rhodanine, thiazolidine-2,4-dithione, isorhodanine, indan-1,3-dione, thiophene-3-one, thiophene-3-one-1,1-dioxide, indoline-2-one, indoline-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinoline-4-one, 1,3-dioxane-4,6-dione, barbituric acid, 2-thiobarbituric acid, chroman-2,4-dione, indazoline-2-one, pyrido[1,2-a]pyrimidine-1,3-dione, pyrazolo[1,5-b]quinazolone, pyrazolo[1,5-a]benzimidazole, pyrazolopridone, 1,2,3,4-tetrahydroquinoline-2,4-dione, 3-oxo-2,3-dihydrobenzo[d]thiophene-1,1-dioxide, 3-dicyanomethine-2,3-dihydrobenzo[d]thiophene-1,1-dioxide.

The acidic nucleus or the acyclic acidic terminal group may be condensed with a ring, or may be substituted by a substituent.

Preferred examples of acidic nucleus include hydantoin, 2- or 4-thiohydantoin, 2-oxazoline-5-one, 2-thio-oxazoline-2,4-dione, thiazolidine-2,4-dione, rhodanine, thiazolidine-2,4-dithione, barbituric acid, and 2-thiobarbituric acid, more preferable are hydantoin, 2- or 4-thiohydantoin, 2-oxazoline-5-one, rhodanine, barbituric acid, and 2-thiobarbituric acid.

When the dye chromophore represented by formulae (QB) or (QD) is a dye chromophore in the first layer, particularly preferred are 2- or 4-thiohydantoin, 2-oxazoline-5-one, and rhodanine.

When the dye chromophore represented by formulae (QB) or (QD) is a dye chromophore in the second or upper layer, particularly preferred is barbituric acid.

The ring formed by $Z_{106}$ and $Z_{106'}$ and $(N—R_{106})q_{102}$ may be any ring, but preferable are a heterocycle (preferably 5 or 6-membered heterocycle), and similar rings to those formed by $Z_{104}$ and $Z_{104'}$ and $(N—R_{104})q_{101}$ mentioned above.

Preferred are the ones obtained by removing an oxo group or a thioxo group from the acidic nuclei mentioned in the above explanation of the ring formed by $Z_{104}$ and $Z_{104'}$ and $(N—R_{104})q_{101}$.

More preferred are the ones obtained by removing an oxo group or a thioxo group from the acidic nuclei of the above examples formed by $Z_{104}$ and $Z_{104'}$ and $(N—R_{104})q_{101}$. Even more preferred are the ones obtained by removing an oxo group or a thioxo group from hydantoin, 2- or 4-thiohydantoin, 2-oxazoline-5-one, 2-thio-oxazoline-2,4-dione, thiazolidine-2,4-dione, rhodanine, thiazolidine-2,4-dithione, barbituric acid, and 2-thiobarbituric acid. Particularly preferred are the ones obtained by removing an oxo group or a thioxo group from hydantoin, 2- or 4-thiohydantoin, 2-oxazoline-5-one, rhodanine, barbituric acid, and 2-thiobarbituric acid. And most preferred are the ones obtained by removing an oxo group or a thioxo group from 2- or 4-thiohydantoin, 2-oxazoline-5-one, and rhodanine.

$q_{102}$ represents 0 or 1, and preferably 1.

$R_{101}$, $R_{102}$, $R_{103}$, $R_{104}$, $R_{105}$, $R_{106}$, $R_{107}$, $R_{108}$, and $R_{109}$ each independently represent a hydrogen atom, an alkyl group, an aryl group, or a heterocyclic group, and preferably an alkyl group, an aryl group, or a heterocyclic group. Specific examples of the alkyl group, the aryl group, and the heterocyclic group represented by $R_{101}$ to $R_{109}$ include an unsubstituted alkyl group preferably having 1 to 18 carbon atoms, more preferably 1 to 7 carbon atoms, and particularly preferably 1 to 4 carbon atoms (for example, methyl, ethyl, propyl, isopropyl, butyl, isobutyl, hexyl, octyl, dodecyl, or octadecyl), a substituted alkyl group preferably having 1 to 18 carbon atoms, more preferably 1 to 7 carbon atoms, and particularly preferably 1 to 4 carbon atoms {especially, alkyl groups having an acidic group mentioned above are preferred, preferably an aralkyl group (for example, benzyl, 2-phenylethyl, 2-(4-biphenyl)ethyl, 2-sulfobenzyl, 4-sulfobenzyl, 4-sulfophenetyl, 4-phosphobenzyl, or 4-carboxybenzyl), an unsaturated hydrocarbon group (for example, an ally group, a vinyl group, that is, the substituted alkyl group includes herein an alkenyl group and an alkynyl group), a hydroxylalkyl group (for example, 2-hydroxyethyl or 3-hydroxypropyl), a carboxyalkyl group (for example, 2-carboxyethyl, 3-carboxypropyl, 4-carboxybutyl, or carboxymethyl), an alkoxyalkyl group (for example, 2-methoxyethyl, 2-(2-methoxyethoxy)ethyl, or 3-sulfopropoxyethoxyethyl), an aryloxyalkyl group (for example, 2-phenoxyethyl, 2-(4-biphenoxy)ethyl, 2-(1-naphthoxy)ethyl, 2-(4-sulfophenoxy) ethyl), or 2-(2-phosphophenoxy)ethyl), an alkoxycarbonyl alkyl group (for example, ethoxy carbonylmethyl, or 2-benzyloxy carbonylethyl), an aryloxycarbonylalkyl group (for example, 3-phenoxycarbonylpropyl or 3-sulfophenoxycarbonylpropyl), an acyloxyalkyl group (for example, 2-acetyloxyethyl), an acylalkyl group (for example, 2-acetylethyl), a carbamoylalkyl group (for example, 2-mopholinocarbonylethyl), a sulfamoyl alkyl group (for example, N,N-dimethylsulfamoyl methyl), a sulfoalkyl group (for example, 2-sulfoethyl, 3-sulfopropyl, 3-sulfobutyl, 4-sulfobutyl, 2-[3-sulfopropoxy]ethyl, 2-hydroxy-3-sulfopropyl, 3-phenyl-3-sulfopropyl, 4-phenyl-4-sulfobutyl, or 3-(2-pyridyl)-3-sulfopropyl), a sulfoalkenyl group, a sulfitealkyl group (for example, 2-sulfiteethyl, 3-sulfitepropyl, or 4-sulfitebutyl), a heterocycle-substituted alkyl group (for example, 2-(pyrrolidine-2-one-1-yl)ethyl, 2-(2-pyridyl)ethyl, tetrahydrofurfyl, or 3-pyridiniopropyl), an alkylsulfocarbamoyl alkyl group (for example, a methane sulfonycarbamoylmethyl group), an acylcarbamoyl alkyl group (for example, an acetylcarbamoylmethyl group), an acylsulfamoyl alkyl group (for example, an acetylsulfamoylmethyl group), an alkylsulfonylsulfamoyl alkyl group (for example, a methane sulfonylsulfamoylmethyl group), an ammonio alkyl group (for example, 3-(trimethylammonio)propyl or 3-ammoniopropyl), an aminoalkyl group (for example, 3-aminopropyl, 3-(dimethylamino)propyl, or 4-(methylamino)butyl), and guanidinoalkyl group (for example, 4-guanodinobutyl)}, a substituted or unsubstituted aryl group having preferably 6 to 20 carbon atoms, more preferably 6 to 10 carbon atoms, and particularly preferably 6 to 8 carbon atoms (for example, phenyl, 1-naphthyl, p-methoxyphenyl, p-methylphenyl, p-chlorophenyl, biphenyl, 4-sulfophenyl, 4-sulfonaphthyl, and the like can be described.), a substituted or unsubstituted heterocyclic group having preferably 1 to 20 carbon atoms, more preferably 3 to 10 carbon atoms, and particularly preferably 4 to 8 carbon atoms (for example, 2-furyl, 2-thienyl, 2-pyridyl, 3-pyrazoryl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl, 5-methyl-2-thienyl, 4-methoxy-2-pyridyl, 4-sulfo-2-pyridyl, and the like can be described).

In the case where the dye chromophore represented by formulae (QA), (QB), (QC), or (QD) is the dye chromophore in the first layer, the substitutents represented by $R_{101}$ to $R_{109}$ are preferably an unsubstituted alkyl group or a substituted alkyl group. The substituted alkyl group is preferably an alkyl group having the aforementioned acidic group. As the acidic group, preferred are a sulfo group, a carboxyl group, a $—CONHSO_2—$ group, a —CONHCO— group, and an $—SO_2NHSO_2—$ group. Particularly preferred are a sulfo group and a carboxyl group, and most preferred is a sulfo group.

In the case where the dye chromophore represented by formulae (QA), (QB), (QC), or (QD) is the dye chromophore in the second or upper layer, the substitutents represented by $R_{101}$ to $R_{109}$ are preferably an unsubstituted alkyl group or a substituted alkyl group, more preferably a sulfo group, a carboxyl group, a $—CONHSO_2—$ group, a —CONHCO— group, an $—SO_2NHSO_2—$ group, an ammonioalkyl group, an aminoalkyl group or a guanizino alkyl group, and particularly preferably a sulfo group or an ammonio alkyl group.

$L_{101}$, $L_{102}$, $L_{103}$, $L_{104}$, $L_{105}$, $L_{106}$, $L_{107}$, $L_{108}$, $L_{109}$, $L_{110}$, $L_{111}$, $L_{112}$, $L_{113}$, $L_{114}$, $L_{115}$, $L_{116}$, $L_{117}$, $L_{118}$, $L_{119}$, $L_{120}$, $L_{121}$, $L_{122}$, and $L_{123}$ each independently represent a methine group. The methine group represented by $L_{101}$ to $L_{123}$ may have any substituent and as the substituent, W mentioned above can be described. Examples of the substituent include a substituted or unsubstituted alkyl group having 1 to 15 carbon atoms, preferably 1 to 10 carbon atoms, and particularly preferably 1 to 5 carbon atoms (for example, methyl, ethyl, or 2-carboxyethyl), a substituted or unsubstituted aryl group having 6 to 20 carbon atoms, preferably 6 to 15 carbon atoms, and more preferably 6 to 10 carbon atoms (for example, phenyl or o-carboxyphenyl), a substituted or unsubstituted heterocyclic group having 3 to 20 carbon atoms, preferably 4 to 15 carbon atoms, and more preferably 6 to 10 carbon atoms (for example, an N,N-dimethyl barbituric acid group), a halogen atom (for example, chlorine, bromine, iodine, or fluorine), an alkoxy group having 1 to 15 carbon atoms, preferably 1 to 10 carbon atoms, and more preferably 1 to 5 carbon atoms (for example, methoxy or ethoxy), an amino group having 0 to 15 carbon atoms, preferably 2 to 10 carbon atoms, and more preferably 4 to 10 carbon atoms (for example, methylamino, N,N-dimethylamino, N-methyl-N-phenylamino, or N-methylpiperidino), an alkylthio group having 1 to 15 carbon atoms, preferably 1 to 10 carbon atoms, and more preferably 1 to 5 carbon atoms (for example, methylthio or ethylthio), an arylthio group having 6 to 20 carbon atoms, preferably 6 to 12 carbon atoms, and more preferably 6 to 10 carbon atoms (for example, phenylthio or p-methylphenylthio), and the like. The substituent may form a ring with other methine group or with $Z_{102}$ to $Z_{109}$, $R_{101}$ to $R_{109}$, and Ra.

$L_{101}$, $L_{102}$, $L_{106}$, $L_{107}$, $L_{108}$, $L_{109}$, $L_{112}$, $L_{113}$, $L_{119}$, and $L_{120}$ preferably represent an unsubstituted methine group.

$n_{101}$, $n_{102}$, $n_{103}$, $n_{104}$, and $n_{105}$ each independently represent 0, 1, 2, 3, or 4. $n_{101}$ to $n_{105}$ preferably represent 0, 1, 2, or 3, more preferably 0, 1, or 2, and particularly preferably 0 or 1. When $n_{101}$ to $n_{105}$ represent 2 or more, the methine group is repeated but these methine groups need not be the same.

$p_{101}$, $p_{102}$, $p_{103}$, $p_{104}$, and $p_{105}$ each independently represent 0 or 1, and preferably 0.

In the case where $M_{101}$, $M_{102}$, $M_{103}$, $M_{104}$, and Mb are needed to neutralize the ionic charge of dye, the presence of cation or anion is included in the formulae. Typical cation includes an inorganic cation such as a hydrogen ion (H+), an alkali metal ion (for example, sodium ion, potassium ion, or lithium ion), an alkaline earth metal ion (for example, calcium ion), and the like and an organic ion such as an ammonium ion (for example, ammonium ion, tetraalkyl ammonium ion, triethyl ammonium ion, pyridinium ion, ethylpyridinium ion and 1,8-diazabicyclo[5.4.0]-7-undecenium ion) and the like. The anion may be any inorganic anion or organic anion, and examples can include a halogen anion (for example, a fluorine ion, a chlorine ion, or an iodine ion), a substituted arylsulfonate ion (for example, a p-toluenesulfonate ion, or a p-chlorobenzenesulfonate ion), an aryldisulfonate ion (for example, a 1,3-benzenesulfonate ion, a 1,5-naphthalene disulfonate ion, or a 2,6-naphthalene disulfonate ion), an alkylsulfate ion (for example, methylsulfate ion), a sulfate ion, a thiocyanate ion, a perchlorate ion, a tetrafluoroborate ion, a picrate ion, an acetate ion, or a trifluoromethane sulfonate ion. Further, an ionic polymer or other dyes having opposite charge to the dye used may be used. $CO_2^-$ and $SO_3^-$ having a hydrogen ion as the counter ion can be expressed as $CO_2H$ and $SO_3H$, respectively.

$m_{101}$, $m_{102}$, $m_{103}$, $m_{104}$, and mb each represent a number of 0 or more necessary for balancing the electric charge, preferably a number of 0 to 4, and more preferably a number of 0 to 1, and when a salt is formed in the molecule, they represent 0.

In the silver halide emulsion comprising silver halide grains which are multilayered-adsorbed by the dye chromophores of the present invention, the dyes described in the above "Patent list (3) concerning multilayered adsorption" may be used.

In formula (Q), $D_1$, La, and $D_2$ described in JP-A No. 2002-169251 can be preferably used in place of Da, La, and Db.

These dyes can be synthesized based on the methods described in F. M. Harmer, "Heterocyclic Compounds—Cyanine Dyes and Related Compounds", John Wiley & Sons, New York, London, (1964), D. M. Sturmer, "Heterocyclic Compounds—Special Topics in Heterocyclic Chemistry", Chapter 8, paragraph 14, items 482 to 515, John Wiley & Sons, New York, London (1977), "Rodd's Chemistry of Carbon Compounds", 2nd Ed., vol. IV, Part B (1977), Chapter 15, items 365 to 422, Elsevier Science Publishing Company Inc., New York, or the like.

In the silver halide emulsion comprising silver halide grains which are multilayered-adsorbed by the dye chromophores of the present invention, not only the dyes consisting the above multilayered adsorption but other dyes or combinations thereof can be used. As the dyes which can be used, preferred are a cyanine dye, a merocyanine dye, a rhodacyanine dye, a trinuclear merocyanine dye, a tetranuclear merocyanine dye, an allopolar dye, a hemicyanine dye, and a styryl dye.

More preferred are a cyanine dye, a merocyanine dye, and a rhodacyanine dye, and particularly preferred is a cyanine dye. These dyes are described in detail in "Literature concerning dyes (2)" above.

These sensitizing dyes may be used either alone or two or more kinds thereof in combination. The combination of sensitizing dyes is often used for the purpose of super sensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,303,377, 3,769,301, 3,814,609, 3,837,862, and 4,026,707, BP Nos. 1344281 and 1507803, Japanese Patent Application Publication (JP-B) Nos. 43-49336 and 53-12375, JP-A Nos. 52-110618 and 52-109925.

Together with the sensitizing dye, a substance which itself is a dye having no spectral sensitization effect or a substance which absorbs substantially no visible light, but which exhibits supersensitization may be included in the emulsion.

Examples of the supersensitizer useful in the spectral sensitization of the present invention (for example, a pyrimidylamino compound, a triazinylamino compound, an azolium compound, an aminostyryl compound, an aromatic organic acid formaldehyde condensate, an azaindene compound, or a cadmium salt) and the combinations of a supersensitizer and a sensitizing dye are described in U.S. Pat. Nos. 3,511,664, 3,615,613, 3,615,632, 3,615,641, 4,596,767, 4,945,038, 4,965,182, 2,933,390, 3,635,721, 3,743,510, and 3,617,295, and the like. Concerning the usage, the methods described in the above patents are also preferred.

The sensitizing dye of the present invention (similar applies to other sensitizing dyes and supersensitizer) may be added to the silver halide emulsion according to the present invention in any process during the preparation of the emulsion, which is recognized as useful. The addition may be performed at any time or any steps as long as it is before coating of the emulsion, for example, during silver halide grain formation step and/or before desalting time, during desalting step and/or the time after desalting but before the initiation of chemical ripening as described in U.S. Pat. Nos. 2,735,766, 3,628,960, 4,183,756, and 4,225,666, JP-A Nos. 58-184142 and 60-196749, and just before chemical ripening, during the chemical ripening step, or the time after completion of chemical ripening but before coating as described in JP-A No. 58-113920.

The same compound solely or in combination with a different structure may be added in parts, for example, during the grain formation step and during chemical ripening step or after completion of chemical ripening, or before chemical ripening or during the chemical ripening step and after completion of chemical ripening as described in U.S. Pat. No. 4,225,666, JP-A No. 58-7629, and the like. When added in parts, the kind of the compounds or the kind of combinations of compounds may be varied.

The addition amount of the sensitizing dye of the present invention (similar applies to other sensitizing dyes and supersensitizer) varies depending on the form and size of silver halide grain, however, the sensitizing dye can be preferably used in an amount of from $1\times10^{-8}$ mol to 1 mol per 1 mol of silver halide, and more preferably from $1\times10^{-6}$ mol to $1\times10^{-2}$ mol per 1 mol of silver halide. For example, when the silver halide grain size is from 0.2 μm to 1.3 μm, the addition amount is preferably from $2\times10^{-6}$ mol to $3.5\times10^{-3}$ mol, and more preferably from $7.5\times10^{-6}$ mol to $1.5\times10^{-3}$ mol, per 1 mol of silver halide.

However, in the case of adsorbing dye chromophores in multilayers, the sensitizing dye of the present invention is added in an amount necessary for attaining the multilayered adsorption.

The sensitizing dye of the present invention (similar applies to other sensitizing dyes and supersensitizer) can be dispersed directly in the emulsion or can be added to the emulsion in the form of a solution after dissolving the dye in an appropriate solvent such as methyl alcohol, ethyl alcohol, methyl cellusolve, acetone, water, or pyridine or in a mixed solvent thereof. An ultrasonic device may be used for dissolving.

With respect to the addition method of the compound, a method of dissolving the compound in a volatile organic solvent, dispersing the solution in a hydrophilic colloid, and adding the dispersion to the emulsion as described in U.S. Pat. No. 3,469,987, a method of dispersing the compound in a water-soluble solvent and adding the dispersion to the emulsion as described in JP-B No. 46-24185, a method of dissolving the compound to a surfactant and adding the solution to the emulsion described in U.S. Pat. No. 3,822,135, a method of dissolving the compound using a compound capable of red shifting and adding the solution to the emulsion as described in JP-A No. 51-74624, a method of dissolving the compound in an acid which does not substantially contain water and adding the solution to the emulsion as described in JP-A No. 50-80826 may be used.

In addition, in respect to the addition to the emulsion, the methods described in U.S. Pat. Nos. 2,912,343, 3,342,605, 2,996,287, and 3,429,835.

8) Chemical Sensitization

The photosensitive silver halide in the present invention can be used without chemical sensitization, but is preferably chemically sensitized by at least one of a chalcogen sensitizing method, gold sensitizing method, and reduction sensitizing method. The chalcogen sensitizing method includes sulfur sensitizing method, selenium sensitizing method and tellurium sensitizing method.

In sulfur sensitization, unstable sulfur compounds can be used. Such unstable sulfur compounds are described in Chimie et Pysique Photographique, written by P. Grafkides, (Paul Momtel, 5th ed., 1987) and Research Disclosure (vol. 307, item 307105), and the like.

As typical examples of sulfur sensitizer, known sulfur compounds such as thiosulfates (e.g., hypo), thioureas (e.g., diphenylthiourea, triethylthiourea, N-ethyl-N'-(4-methyl-2-thiazolyl)thiourea, or carboxymethyltrimethylthiourea), thioamides (e.g., thioacetamide), rhodanines (e.g., diethylrhodanine or 5-benzylydene-N-ethylrhodanine), phosphinesulfides (e.g., trimethylphosphinesulfide), thiohydantoins, 4-oxo-oxazolidin-2-thiones, disulfides or polysulfides (e.g., dimorphorinedisulfide, cystine, or lenthionine (1,2,3,5,6-pentathiepane)), polythionates, and sulfur element, and active gelatin can be used. Specifically, thiosulfates, thioureas, and rhodanines are preferred.

In selenium sensitization, unstable selenium compounds can be used. These unstable selenium compounds are described in JP-B Nos. 43-13489 and 44-15748, JP-A Nos. 4-25832, 4-109340, 4-271341, 5-40324, 5-11385, 6-51415, 6-175258, 6-180478, 6-208186, 6-208184, 6-317867, 7-92599, 7-98483, and 7-140579, and the like.

As typical examples of selenium sensitizer, colloidal metal selenide, selenoureas (e.g., N,N-dimethylselenourea, trifluoromethylcarbonyl-trimethylselenourea, or acetyltrimethylselemourea), selenoamides (e.g., selenoamide or N,N-diethylphenylselenoamide), phosphineselenides (e.g., triphenylphosphineselenide or pentafluorophenyl-triphenylphosphineselenide), selenophosphates (e.g., tri-p-tolylselenophosphate or tri-n-butylselenophosphate), selenoketones (e.g., selenobenzophenone), isoselenocyanates, selenocarbonic acids, selenoesters, diacylselenides, or the like can be used. Furthermore, non-unstable selenium compounds such as selenius acid, salts of selenocyanic acid, selenazoles, and selenides described in JP-B Nos. 46-4553 and 52-34492, and the like can also be used. Specifically, phosphineselenides, selenoureas, and salts of selenocyanic acids are preferred.

In tellurium sensitization, unstable tellurium compounds are used. Unstable tellurium compounds described in JP-A Nos. 4-224595, 4-271341, 4-333043, 5-303157, 6-27573, 6-175258, 6-180478, 6-208186, 6-208184, 6-317867, 7-140579, 7-301879, 7-301880 and the like, can be used as a tellurium sensitizer.

As typical examples of a tellurium sensitizer, phosphinetellurides (e.g., butyl-diisopropylphosphinetelluride, tributylphosphinetelluride, tributoxyphosphinetelluride, or ethoxy-diphenylphosphinetellride), diacyl(di)tellurides (e.g., bis(diphenylcarbamoyl)ditelluride, bis(N-phenyl-N-methylcarbamoyl)ditelluride, bis(N-phenyl-N-methylcarbamoyl)ditelluride, bis(N-phenyl-N-benzylcarbamoyl)telluride, or bis(ethoxycarmonyl)telluride), telluroureas (e.g., N,N'-dimethylethylenetellurourea or N,N'-diphenylethylenetellurourea), telluramides, or telluroesters may be used. Specifically, diacyl(di)tellurides and phosphinetellurides are preferred. Especially, the compounds described in paragraph No. 0030 of JP-A No. 11-65021 and compounds represented by formulae (II), (III), or (IV) in JP-A No. 5-313284 are preferred.

Specifically, as for the chalcogen sensitization of the invention, selenium sensitization and tellurium sensitization are preferred, and tellurium sensitization is particularly preferred.

In gold sensitization, gold sensitizer described in Chimie et Physique Photographique, written by P. Grafkides, (Paul Momtel, 5th ed., 1987) and Research Disclosure (vol. 307, item 307105) can be used. More specifically, chloroauric acid, potassium chloroaurate, potassium aurithiocyanate, gold sulfide, gold selenide, or the like can be used. In addition to these, the gold compounds described in U.S. Pat. Nos. 2,642,361, 5,049,484, 5,049,485, 5,169,751, and 5,252,455, Belg. Patent No. 691857, and the like can also be used. Noble metal salts other than gold such as platinum, palladium, iridium and the like, which are described in Chimie et Pysique Photographique, written by P. Grafkides, (Paul Momtel, 5th ed., 1987) and Research Disclosure (vol. 307, item 307105), can also be used.

The gold sensitization can be used independently, but it is preferably used in combination with the above chalcogen sensitization. Specifically, these sensitizations are gold-sulfur sensitization (gold-plus-sulfur sensitization), gold-selenium sensitization, gold-tellurium sensitization, gold-sulfur-selenium sensitization, gold-sulfur-tellurium sensitization, gold-selenium-tellurium sensitization and gold-sulfur-selenium-tellurium sensitization.

In the invention, chemical sensitization can be applied in the presence of silver halide solvent.

Specifically, thiocyanates (e.g., potassium thiocyanate), thioethers (e.g., compounds described in U.S. Pat. Nos. 3,021,215 and 3,271,157, JP-B No. 58-30571 and JP-A No. 60-136736, especially, 3,6-dithia-1,8-octanediol), tetra-substituted thioureas (e.g., compounds described in JP-B No. 59-11892 and U.S. Pat. No. 4,221,863, especially, tetramethylthiourea), thione compounds described in JP-B No. 60-11341, mercapto compounds described in JP-B No. 63-29727, mesoionic compounds described in JP-A No. 60-163042, selenoethers described in U.S. Pat. No. 4,782,013, telluroether compounds described in JP-A No. 2-118566, and sulfites can be described. Among them, thiocyanates, thioethers, tetra-substituted thioureas, and thione compounds are preferable, and particularly preferable among them is thiocyanates. The addition amount of silver halide solvent preferably is from $10^{-5}$ mol to $10^{-2}$ mol per 1 mol of silver halide.

In the invention, chemical sensitization can be applied at any time so long as it is after grain formation and before coating and it can be applied, after desalting, (1) before spectral sensitization, (2) simultaneously with spectral sensitization, (3) after spectral sensitization, (4) just before coating, or the like.

The addition amount of chalcogen sensitizer used in the invention may vary depending on the silver halide grain used, the chemical ripening condition, and the like, and it is about $10^{-8}$ mol to $10^{-1}$ mol, and preferably, about $10^{-7}$ mol to $10^{-2}$ mol, per 1 mol of silver halide.

Similarly, the addition amount of the gold sensitizer used in the invention may vary depending on various conditions and it is generally about $10^{-7}$ mol to $10^{-2}$ mol and, more preferably, $10^{-6}$ mol to $5\times10^{-3}$ mol, per 1 mol of silver halide. There is no particular restriction on the condition for the chemical sensitization and, appropriately, the pAg is 8 or lower, preferably, 7.0 or lower, more preferably, 6.5 or lower and, particularly preferably, 6.0 or lower, and the pAg is 1.5 or higher, preferably, 2.0 or higher and, particularly preferably, 2.5 or higher; the pH is 3 to 10, preferably, 4 to 9; and the temperature is at 20° C. to 95° C., preferably, 25° C. to 80° C.

In the invention, reduction sensitization can also be used in combination with the chalcogen sensitization or the gold sensitization. It is specifically preferred to use in combination with the chalcogen sensitization.

As the specific compound for the reduction sensitization, ascorbic acid, thiourea dioxide, or dimethylamine borane is preferred, as well as use of stannous chloride, aminoimino methane sulfonic acid, hydrazine derivatives, borane compounds, silane compounds, polyamine compounds, and the like are preferred.

The reduction sensitizer may be added at any stage in the photosensitive emulsion producing process from crystal growth to the preparation step just before coating. Further, it is preferred to apply reduction sensitization by ripening while keeping the pH to 8 or higher and the pAg to 4 or lower for the emulsion, and it is also preferred to apply reduction sensitization by introducing a single addition portion of silver ions during grain formation.

The addition amount of the reduction sensitizer may also vary depending on various conditions and it is generally about $10^{-7}$ mol to $10^{-1}$ mol and, more preferably, $10^{-6}$ mol to $5\times10^{-2}$ mol per 1 mol of silver halide.

In the silver halide emulsion used in the invention, a thiosulfonate compound may be added by the method shown in EP-A No. 293917.

The photosensitive silver halide grain in the invention is preferably chemically sensitized by at least one method of gold sensitizing method and chalcogen sensitizing method for the purpose of designing a high-sensitivity photothermographic material.

9) Compound that can be One-Electron-Oxidized to Provide a One-Electron Oxidation Product which Releases One or More Electrons The black and white photothermographic material of the invention preferably contains a compound that can be one-electron-oxidized to provide a one-electron oxidation product which releases one or more electrons. The said compound can be used alone or in combination with various chemical sensitizers described above to increase the sensitivity of silver halide.

As the compound that can be one-electron-oxidized to provide a one-electron oxidation product which releases one or more electrons is preferably a compound selected from the following Groups 1 or 2.

(Group 1) a compound that can be one-electron-oxidized to provide a one-electron oxidation product which further releases one or more electrons, due to being subjected to a subsequent bond cleavage reaction;

(Group 2) a compound that can be one-electron-oxidized to provide a one-electron oxidation product, which further releases one or more electrons after being subjected to a subsequent bond formation reaction.

The compound of Group 1 will be explained below.

In the compound of Group 1, as for a compound that can be one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786692A1 (Compound INV 1 to 35); EP No. 893732A1; U.S. Pat. Nos. 6,054,260 and 5,994,051; etc. Preferred ranges of these compounds are the same as the preferred ranges described in the quoted specifications.

In the compound of Group 1, as for a compound that can be one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8), and the compound represented by formula (9) among the compounds which can undergo the chemical reaction represented by reaction formula (1). And the preferable range of these compounds is the same as the preferable range described in the quoted specification.

Formula (1)

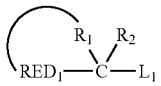

Formula (2)

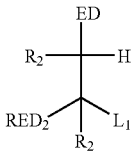

Formula (3)

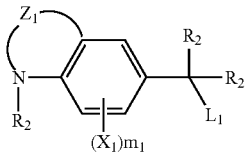

Formula (4)

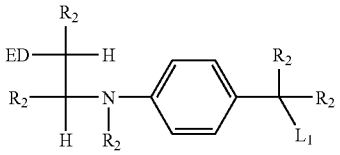

Formula (5)

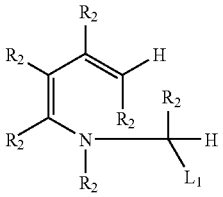

Formula (6)

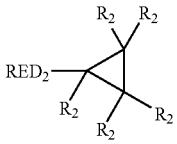

Formula (7)

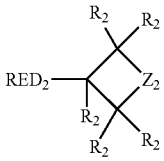

Formula (8)

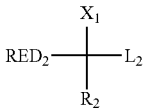

Reaction formula (1)

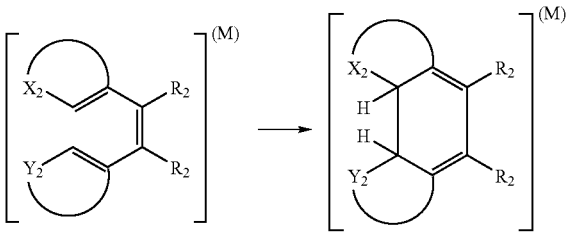

-continued

Formula (9)

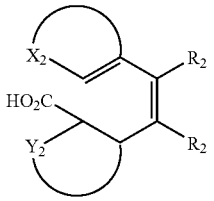

In the formulae, $RED_1$ and $RED_2$ represent a reducing group. $R_1$ represents a nonmetallic atomic group forming a cyclic structure equivalent to a tetrahydro derivative or an octahydro derivative of a 5 or 6-membered aromatic ring (including a hetero aromatic ring) with a carbon atom (C) and $RED_1$. $R_2$ represents a hydrogen atom or a substituent. In the case where plural $R_2$s exist in a same molecule, these may be identical or different from each other. $L_1$ represents a leaving group. ED represents an electron-donating group. $Z_1$ represents an atomic group capable to form a 6-membered ring with a nitrogen atom and two carbon atoms of a benzene ring.

$X_1$ represents a substituent, and $m_1$ represents an integer of 0 to 3. $Z_2$ represents one selected from —$CR_{11}R_{12}$—, —$NR_{13}$—, or —O—. $R_{11}$ and $R_{12}$ each independently represent a hydrogen atom or a substituent. $R_{13}$ represents one selected from a hydrogen atom, an alkyl group, an aryl group, or a heterocyclic group. $X_1$ represents one selected from an alkoxy group, an aryloxy group, a heterocyclic oxy group, an alkylthio group, an arylthio group, a heterocyclic thio group, an alkylamino group, an arylamino group, or a heterocyclic amino group. $L_2$ represents a carboxyl group or a salt thereof, or a hydrogen atom.

$X_2$ represents a group to form a 5-membered heterocycle with C═C. $Y_2$ represents a group to form a 5 or 6-membered aryl group or heterocyclic group with C═C. M represents one selected from a radical, a radical cation, or a cation.

Next, the compound of Group 2 is explained.

In the compound of Group 2, as for a compound that can be one-electron-oxidized to provide a one-electron oxidation product which further releases one or more electrons, after being subjected to a subsequent bond cleavage reaction, specific examples can include the compound represented by formula (10) (same as formula (1) described in JP-A No. 2003-140287), and the compound represented by formula (11) which can undergo the chemical reaction represented by reaction formula (1). The preferable range of these compounds is the same as the preferable range described in the quoted specification.

Formula (10)

$$X—L_2—Y$$

Reaction formula (1)

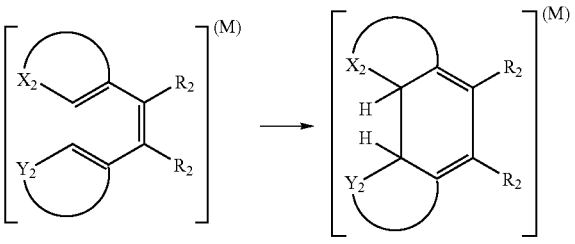

-continued

Formula (11)

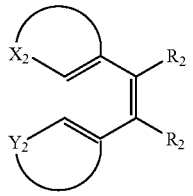

In the formulae described above, X represents a reducing group which can be one-electron-oxidized. Y represents a reactive group containing a carbon-carbon double bond part, a carbon-carbon triple bond part, an aromatic group part or benzo-condensed nonaromatic heterocyclic group which can react with one-electron-oxidized product formed by one-electron-oxidation of X to form a new bond. $L_2$ represents a linking group to link X and Y. $R_2$ represents a hydrogen atom or a substituent. In the case where plural $R_2$s exist in a same molecule, these may be identical or different from each other.

$X_2$ represents a group to form a 5-membered heterocycle with C═C. $Y_2$ represents a group to form a 5 or 6-membered aryl group or heterocyclic group with C═C. M represents one selected from a radical, a radical cation, or a cation.

The compounds of Groups 1 or 2 preferably are "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 or 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be identical or different from each other.

As preferable adsorptive group, a mercapto-substituted nitrogen-containing heterocyclic group (e.g., a 2-mercaptothiazole group, a 3-mercapto-1,2,4-triazole group, a 5-mercaptotetrazole group, a 2-mercapto-1,3,4-oxadiazole group, a 2 -mercaptobenzoxazole group, a 2-mercaptobenzothiazole group, a 1,5-dimethyl-1,2,4-triazolium-3-thiolate group, or the like) or a nitrogen-containing heterocyclic group having —NH— group as a partial structure of heterocycle capable to form a silver imidate (>NAg) (e.g., a benzotriazole group, a benzimidazole group, an indazole group, or the like) are described. A 5-mercaptotetrazole group, a 3-mercapto-1,2,4-triazole group and a benzotriazole group are particularly preferable and a 3-mercapto-1,2,4-triazole group and a 5-mercaptotetrazole group are most preferable.

As an adsorptive group, the group which has two or more mercapto groups as a partial structure in a molecule is also particularly preferable. Herein, a mercapto group (—SH) may become a thione group in the case where it can tautomerize. Preferred examples of an adsorptive group having two or more mercapto groups as a partial structure (dimercapto-substituted nitrogen-containing heterocyclic group and the like) are a 2,4-dimercaptopyrimidine group, a 2,4-dimercaptotriazine group and a 3,5-dimercapto-1,2,4-triazole group.

Further, a quaternary salt structure of nitrogen or phosphorus is also preferably used as an adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group, or the like) and a nitrogen-containing heterocyclic group containing quaternary nitrogen atom can be used. As a quaternary salt structure of phosphorus, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group, or the like) is described. A quaternary salt structure of nitrogen is more preferably used and a 5 or 6-membered aromatic heterocyclic group containing a quaternary nitrogen atom is further preferably used. Particularly preferably, a pyrydinio group, a quinolinio group and an isoquinolinio group are used. These nitrogen-containing heterocyclic groups containing a quaternary nitrogen atom may have any substituent.

Examples of counter anions of quaternary salt are a halogen ion, carboxylate ion, sulfonate ion, sulfate ion, perchlorate ion, carbonate ion, nitrate ion, $BF_4^-$, $PF_6^-$, $Ph_4B^-$, and the like. In the case where the group having negative charge at carboxylate group and the like exists in a molecule, an inner salt may be formed with it. As a counter ion outside of a molecule, chloro ion, bromo ion and methanesulfonate ion are particularly preferable.

The preferred structure of the compound represented by Groups 1 or 2 having a quaternary salt of nitrogen or phosphorus as an adsorptive group is represented by formula (X).

$$(P—Q_1—)_i—R(—Q_2—S)_j \qquad \text{Formula (X)}$$

In formula (X), P and R each independently represent a quaternary salt structure of nitrogen or phosphorus, which is not a partial structure of a spectral sensitizing dye. $Q_1$ and $Q_2$ each independently represent a linking group and typically represent a single bond, an alkylene group, an arylene group, a heterocyclic group, —O—, —S—, —$NR_N$, —C(═O)—, —$SO_2$—, —SO—, —P(═O)— and the group which consists of combination of these groups. Herein, $R_N$ represents one selected from a hydrogen atom, an alkyl group, an aryl group, or a heterocyclic group.

S represents a residue which is obtained by removing one atom from the compound represented by Group 1 or 2. i and j are an integer of one or more and are selected in a range of i+j=2 to 6. The case where i is 1 to 3 and j is 1 to 2 is preferable, the case where i is 1 or 2 and j is 1 is more preferable, and the case where i is 1 and j is 1 is particularly preferable. The compound represented by formula (X) preferably has 10 to 100 carbon atoms in total, more preferably 10 to 70 carbon atoms, further preferably 11 to 60 carbon atoms, and particularly preferably 12 to 50 carbon atoms in total.

The compounds of Groups 1 or 2 may be used at any time during preparation of the photosensitive silver halide emulsion and production of the photothermographic material. For example, the compound may be used in a photosensitive silver halide grain formation step, in a desalting step, in a chemical sensitization step, and before coating, etc. The compound may be added in several times, during these steps. The compound is preferably added after the photosensitive silver halide grain formation step and before the desalting step; in the chemical sensitization step (just before the chemical sensitization to immediately after the chemical sensitization); or before coating. The compound is more preferably added, just before the chemical sensitization step to before mixing with the non-photosensitive organic silver salt.

It is preferred that the compound of Groups 1 or 2 according to the invention is dissolved in water, a water-soluble solvent such as methanol and ethanol, or a mixed solvent thereof. In the case where the compound is dissolved in water and solubility of the compound is increased by increasing or decreasing a pH value of the solvent, the pH value may be increased or decreased to dissolve and add the compound.

The compound of Groups 1 or 2 according to the invention is preferably used in the image forming layer comprising the photosensitive silver halide and the non-photosensitive organic silver salt. The compound may be added to a surface protective layer, or an intermediate layer, as well as the image forming layer comprising the photosensitive silver halide and the non-photosensitive organic silver salt, to be diffused to the image forming layer in the coating step. The compound may be added before or after addition of a sensitizing dye. Each compound is contained in the image forming layer preferably in an amount of $1\times10^{-9}$ mol to $5\times10^{-1}$ mol, more preferably $1\times10^{-8}$ mol to $5\times10^{-2}$ mol, per 1 mol of silver halide.

10) Compound Having Adsorptive Group and Reducing Group

The black and white photothermographic material of the present invention preferably comprises an adsorptive redox compound having an adsorptive group to silver halide and a reducing group in a molecule. It is preferred that the adsorptive redox compound used in the invention is represented by the following formula (I).

A-(W)n-B Formula (I)

In formula (I), A represents a group capable of adsorption to a silver halide (hereafter, it is called an adsorptive group), W represents a divalent linking group, n represents 0 or 1, and B represents a reducing group.

In formula (I), the adsorptive group represented by A is a group to adsorb directly to a silver halide or a group to promote adsorption to a silver halide. As typical examples, a mercapto group (or a salt thereof), a thione group (—C(═S)—), a nitrogen atom, a heterocyclic group containing at least one atom selected from a nitrogen atom, a sulfur atom, a selenium atom, or a tellurium atom, a sulfide group, a disulfide group, a cationic group, an ethynyl group, and the like are described.

The mercapto group as an adsorptive group means a mercapto group (and a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or nonaromatic heterocyclic group having at least a 5 to 7-membered ring, for example, an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, and the like are described.

A heterocyclic group having a quaternary nitrogen atom may also be adopted, wherein a mercapto group as a substituent may dissociate to form a mesoion. When the mercapto group forms a salt, a counter ion of the salt may be a cation of an alkaline metal, an alkaline earth metal, a heavy metal, or the like, such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion; or the like.

Further, the mercapto group as an adsorptive group may become a thione group by a tautomerization.

The thione group used as the adsorptive group also include a linear or cyclic thioamide group, thiouredide group, thiourethane group, and dithiocarbamate ester group.

The heterocyclic group, as an adsorptive group, which contains at least one atom selected from a nitrogen atom, a sulfur atom, a selenium atom, or a tellurium atom represents a nitrogen-containing heterocyclic group having —NH— group, as a partial structure of a heterocycle, capable to form a silver iminate (>NAg) or a heterocyclic group, having an —S— group, a —Se— group, a —Te— group or a ═N— group as a partial structure of a heterocycle, and capable to coordinate to a silver ion by a chelate bonding. As the former examples, a benzotriazole group, a triazole group, an indazole group, a pyrazole group, a tetrazole group, a benzimidazole group, an imidazole group, a purine group, and the like are described. As the latter examples, a thiophene group, a thiazole group, an oxazole group, a benzophthiophene group, a benzothiazole group, a benzoxazole group, a thiadiazole group, an oxadiazole group, a triazine group, a selenoazole group, a benzoselenazole group, a tellurazole group, a benzotellurazole group, and the like are described.

The sulfide group or disulfide group as an adsorptive group contains all groups having "—S—" or "—S—S—" as a partial structure.

The cationic group as an adsorptive group means the group containing a quaternary nitrogen atom, such as an ammonio group or a nitrogen-containing heterocyclic group including a quaternary nitrogen atom. As examples of the heterocyclic group containing a quaternary nitrogen atom, a pyridinio group, a quinolinio group, an isoquinolinio group, an imidazolio group, and the like are described.

The ethynyl group as an adsorptive group means —C≡CH group and the said hydrogen atom may be substituted.

The adsorptive group described above may have any substituent.

Further, as typical examples of an adsorptive group, the compounds described in pages 4 to 7 in the specification of JP-A No. 11-95355 are described.

As an adsorptive group represented by A in formula (I), a heterocyclic group substituted by a mercapto group (e.g., a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4-dimercaptotriazine group, a 3,5-dimercapto-1,2,4-triazole group, a 2,5-dimercapto-1,3-thiazole group, or the like) or a nitrogen atom containing heterocyclic group having an —NH— group capable to form an imino-silver (>NAg) as a partial structure of heterocycle (e.g., a benzotriazole group, a benzimidazole group, an indazole group, or the like) is preferable, and more preferable as an adsorptive group is a 2-mercaptobenzimidazole group or a 3,5-dimercapto-1,2,4-triazole group.

In formula (I), W represents a divalent linking group. The said linking group may be any divalent linking group, as far as it does not give a bad effect toward photographic properties. For example, a divalent linking group which includes a carbon atom, a hydrogen atom, an oxygen atom, a nitrogen atom, or a sulfur atom, can be used. As typical examples, an alkylene group having 1 to 20 carbon atoms (e.g., a methylene group, an ethylene group, a trimethylene group, a tetramethylene group, a hexamethylene group, or the like), an alkenylene group having 2 to 20 carbon atoms, an alkynylene group having 2 to 20 carbon atoms, an arylene group having 6 to 20 carbon atoms (e.g., a phenylene group, a naphthylene group, or the like), —CO—, —$SO_2$—, —O—, —S—, —$NR_1$—, and the combinations of these linking groups are described. Herein, $R_1$ represents a hydrogen atom, an alkyl group, a heterocyclic group, or an aryl group.

The linking group represented by W may have any substituent.

In formula (I), a reducing group represented by B represents the group capable to reduce a silver ion. As the examples, a formyl group, an amino group, a triple bond group such as an acetylene group, a propargyl group and the like, a mercapto group, and residues which are obtained by removing one hydrogen atom from hydroxylamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols, and polyphenols such as hydroquinones, catechols, resorcinols, benzenetriols, bisphenols are included), acylhydrazines, carbamoylhydrazines, 3-pyrazolidones, and the like can be described. They may have any substituent.

The oxidation potential of a reducing group represented by B in formula (I), can be measured by using the measuring method described in Akira Fujishima, "DENKIKAGAKU SOKUTEIHO", pages 150 to 208, GIHODO SHUPPAN and The Chemical Society of Japan, "ZIKKEN KAGAKUKOZA", 4th ed., vol. 9, pages 282 to 344, MARUZEN. For example, the method of rotating disc voltammetry can be used; namely the sample is dissolved in the solution (methanol:pH 6.5 Britton-Robinson buffer=10%:90% (% by volume)) and after bubbling with nitrogen gas during 10 minutes the voltamograph can be measured under the condition of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E1/2) can be calculated by that obtained voltamograph.

When a reducing group represented by B in the present invention is measured by the method described above, an oxidation potential is preferably in a range of about −0.3 V to about 1.0 V, more preferably about −0.1 V to about 0.8 V, and particularly preferably about 0 V to about 0.7 V.

In formula (I), a reducing group represented by B preferably is a residue which is obtained by removing one hydrogen atom from hydroxylamines, hydroxamic acids, hydroxyureas, hydroxysemicarbazides, reductones, phenols, acylhydrazines, carbamoylhydrazines, or 3-pyrazolidones.

The compound of formula (I) in the present invention may have the ballasted group or polymer chain in it generally used in the non-moving photographic additives as a coupler. And as a polymer, for example, the polymer described in JP-A No. 1-100530 can be selected.

The compound of formula (I) in the present invention may be bis or tris type of compound. The molecular weight of the compound represented by formula (I) in the present invention is preferably from 100 to 10,000 and more preferably from 120 to 1,000 and particularly preferably from 150 to 500.

The examples of the compound represented by formula (I) in the present invention are shown below, but the present invention is not limited in these.

(1)

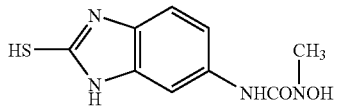

(2)

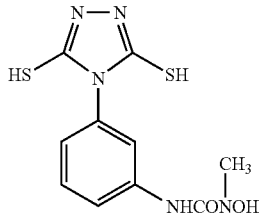

(3)

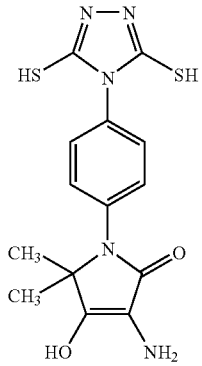

(4)

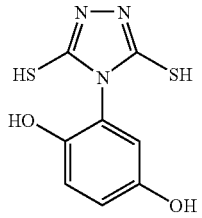

(5)

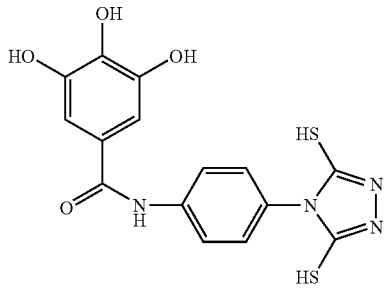

-continued (6)

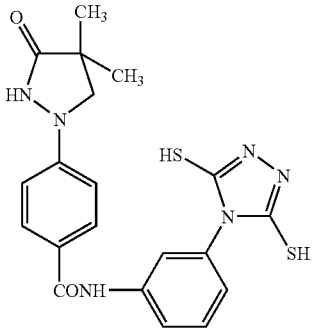

(7)

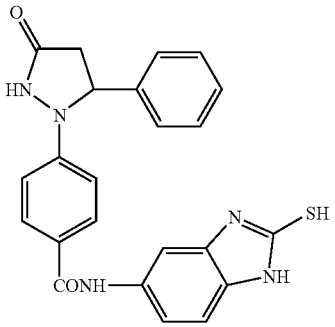

(8)

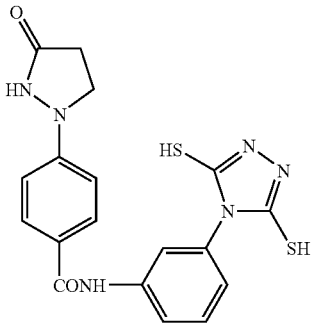

(9)

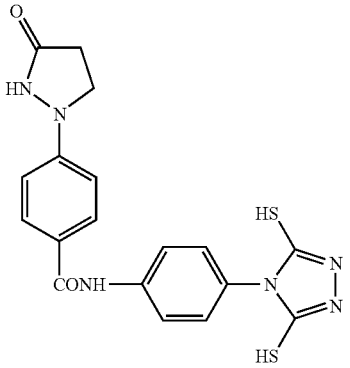

-continued (10)

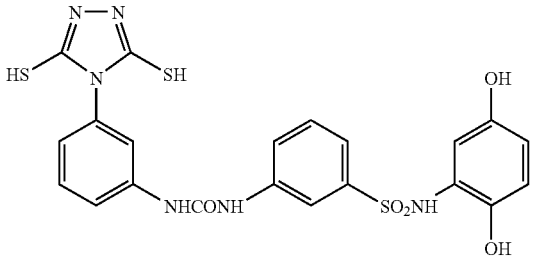

(11)

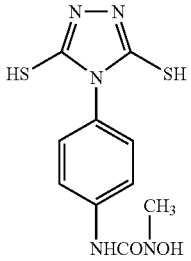

(12)

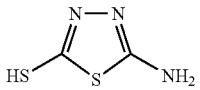

(13)

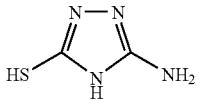

Further, example compounds 1 to 30 and 1"-1 to 1"-77 shown in EP No. 1308776A2, pages 73 to 87 are also described as preferable examples of the compound having an adsorptive group and a reducing group according to the invention.

These compounds can be easily synthesized by any known method.

The compound of formula (I) in the present invention can be used alone, but it is preferred to use two or more kinds of the compounds in combination. When two or more kinds of the compounds are used in combination, those may be added to the same layer or the different layers, whereby adding methods may be different from each other.

The compound represented by formula (I) in the present invention preferably is added to an image forming layer and more preferably is to be added at an emulsion preparing process. In the case, where these compounds are added at an emulsion preparing process, these compounds may be added at any step in the process. For example, the compounds may be added during the silver halide grain formation step, the step before starting of desalting step, the desalting step, the step before starting of chemical ripening, the chemical ripening step, the step before preparing a final emulsion, or the like. The compound may be added in several times, during these steps. It is preferred to be added in the image forming layer. But the compound may be added to a surface protective layer or an intermediate layer, in combination with its addition to the image forming layer, to be diffused to the image forming layer in the coating step.

The preferred addition amount is largely dependent on the adding method described above or the kind of the compound, but generally $1\times10^{-6}$ mol to 1 mol per 1 mol of photosensitive silver halide, preferably $1\times10^{-5}$ mol to $5\times10^{-1}$ mol, and more preferably $1\times10^{-4}$ mol to $1\times10^{-1}$ mol.

The compound represented by formula (I) in the present invention can be added by dissolving in water or water-soluble solvent such as methanol, ethanol and the like or a mixed solution thereof. At this time, the pH may be arranged suitably by an acid or an alkaline and a surfactant can coexist. Further, these compounds may be added as an emulsified dispersion by dissolving them in an organic solvent having a high boiling point and also may be added as a solid dispersion.

11) Combined Use of a Plurality of Silver Halides

The photosensitive silver halide emulsion in the black and white photothermographic material used in the invention may be used alone, or two or more kinds of them (for example, those of different average particle sizes, different halogen compositions, different crystal habits, and different conditions for chemical sensitization) may be used together. Gradation can be controlled by using plural kinds of photosensitive silver halides of different sensitivity. The relevant techniques can include those described, for example, in JP-A Nos. 57-119341, 53-106125, 47-3929, 48 -55730, 46-5187, 50-73627, and 57-150841. It is preferred to provide a sensitivity difference of 0.2 or more in terms of log E between each of the emulsions.

12) Mixing Silver Halide and Organic Silver Salt

The photosensitive silver halide in the invention is particularly preferably formed in the absence of the non-photosensitive organic silver salt and chemically sensitized. This is because sometimes sufficient sensitivity can not be attained by the method of forming the silver halide by adding a halogenating agent to an organic silver salt.

The method of mixing the silver halide and the organic silver salt can include a method of mixing a separately prepared photosensitive silver halide and an organic silver salt by a high speed stirrer, ball mill, sand mill, colloid mill, vibration mill, homogenizer, or the like, or a method of mixing a photosensitive silver halide completed for preparation at any timing in the preparation of an organic silver salt and preparing the organic silver salt. The effect of the invention can be obtained preferably by any of the methods described above.

13) Mixing Silver Halide into Coating Solution

In the invention, the time of adding silver halide to the coating solution for the image forming layer is preferably in the range from 180 minutes before to just prior to the coating, more preferably, 60 minutes before to 10 seconds before coating. But there is no restriction for mixing method and mixing condition as long as the effect of the invention is sufficient. As an embodiment of a mixing method, there is a method of mixing in a tank and controlling an average residence time. The average residence time herein is calculated from addition flux and the amount of solution transferred to the coater. And another embodiment of mixing method is a method using a static mixer, which is described in 8th edition of "Ekitai Kongo Gijutu" by N. Harnby and M. F. Edwards, translated by Koji Takahashi (Nikkan Kogyo Shinbunsha, 1989).

(Organic Silver Salt)

An organic compound that contains a reducible silver (I) ion is contained in the black and white photothermographic materials of the present invention. Preferably, it is a silver salt or a coordination compound that forms a silver image which is comparatively stable to light, when heated to 50° C. or higher in the presence of an exposed silver halide and a reducing agent.

The non-photosensitive organic silver salt of the invention is a compound selected from a silver salt of an azole compound or a silver salt of a mercapto compound. Preferable is a nitrogen-containing heterocyclic compound as an azole compound, and more preferable are a triazole compound and a tetrazole compound. The mercapto compound is a compound which contains at least one of a mercapto group and a thione group in a molecular.

The silver salt of a nitrogen-containing heterocyclic compound is preferably a silver salt of a compound containing an imino group. Specific examples of the silver salt include, but are not limited to these examples, a silver salt of 1,2,4-triazole, a silver salt of benzotriazole or a derivative thereof (for example, a silver salt of methylbenzotriazole and a silver salt of 5-chlorobenzotriazole), a silver salt of 1-H-tetrazole such as phenylmercaptotetrazole described in U.S. Pat. No. 4,220,709, a silver salt of imidazole or an imidazole derivative described in U.S. Pat. No. 4,260,677. Among these kinds of silver salt, particularly preferred are a silver salt of a benzotriazole derivative and a mixture of two or more of the silver salts described herein.

Most preferred compound used for the black and white photothermographic material of the present invention is a silver salt of a benzotriazole derivative.

The compound containing a mercapto group or a thione group according to the invention is preferably a heterocyclic compound containing of 5 or 6 atoms. In this case, at least one atom in the ring is a nitrogen atom and the other atoms are atoms selected from a carbon atom, an oxygen atom, and a sulfur atom. Examples of such heterocyclic compound include triazoles, oxazoles, thiazoles, thiazolines, imidazoles, diazoles, pyridines, and triazines, but the invention is not limited to these examples, Representative examples of the silver salt of a compound containing a mercapto group or a thione group are set forth below, but the invention is not limited to these.

- A silver salt of 3-mercapto-4-phenyl-1,2,4-triazole
- A silver salt of 2-mercapto benzimidazole
- A silver salt of 2-mercapto-5-aminothiazole
- A silver salt of 2-(2-ethylglycolamido)benzothiazole
- A silver salt of 5-carboxylic-1-methyl-2-phenyl-4-thiopyridine
- A silver salt of mercaptotriazine
- A silver salt of 2-mercaptobenzoxazole
- A silver salt described in U.S. Pat. No. 4,123,274 (for example, a silver salt of a 1,2,4-mercaptothiazole derivative, and a silver salt of 3-amino-5-benzylthio-1,2,4-thiazole)
- A silver salt of thione compounds (for example, a silver salt of 3-(2-carboxyethyl)-4-methyl-4-thiazoline-2-thione described in U.S. Pat. No. 3,785,830)

As the compound containing a mercapto group or a thione group according to the invention, a compound which does not contain a heterocycle can also be used. The mercapto or thione derivative which does not contain a heterocycle is preferably an aliphatic or aromatic hydrocarbon compound having 10 or more carbon atoms.

Examples of useful compound of mercapto and thione derivatives containing no heterocycle are set forth below, but the invention is not limited to these.

A silver salt of thioglycolic acid (for example, a silver salt of S-alkylthioglycolic acid, wherein the alkyl group has 12 to 22 carbon atoms)

A silver salt of dithiocarboxylic acid (for example, a silver salt of dithioacetic acid and a silver salt of thioamide)

An organic compound containing a silver salt of carboxylic acid is also used preferably. It is, for example, a silver salt of aromatic carboxylic acid. Preferred examples of the silver salts of aromatic carboxylic acid and other carboxylic acids include the following compounds, but the invention is not limited to these examples.

Substituted or unsubstituted silver benzoate (for example, silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate)

Silver tannate

Silver phthalate

Silver terephthalate

Silver salicyate

Silver phenylacetate

Silver pyromellitate

In the present invention, a silver salt of fatty acid containing a thioether group as described in U.S. Pat. No. 3,330,663 is also used preferably. Soluble silver carboxylate having a hydrocarbon chain incorporating an ether or thioether linkage, or having a sterically hindered substitutent in the alpha-position (on a hydrocarbon group) or ortho-position (on an aromatic group) can also be used. These silver salts can display increased solubility in coating solvents and affording coatings with less light scattering.

Such silver carboxylates are described in U.S. Pat. No. 5,491,059. Any of the silver salts described herein can be used in the invention, when necessary.

Silver salts of sulfonic acid which are described in U.S. Pat. No. 4,504,575 can also be used in the embodiment of this invention. Silver salts of sulfosuccinates which are described in EP-A No. 0227141 are also useful.

Moreover, silver salts of acetylenes described, for example, in U.S. Pat. Nos. 4,761,361 and 4,775,613 can be used in the invention.

Non-photosensitive silver sources which are capable of supplying reducible silver ions can also be provided as core-shell silver salts known in general or such as those described in U.S. Pat. No. 6,355,408.

These silver salts include a core comprised of one or more silver salts and a shell having one or more different silver salts.

Still another useful non-photosensitive silver source in the present invention is a silver dimer synthetic compound that comprises two different silver salts described in U.S. Pat. No. 6,472,131. Such non-photosensitive silver dimer synthetic compound comprises two different silver salts. In the case where the two different silver salts comprise linear, saturated hydrocarbon groups as silver ligands, those ligands differ by 6 or more carbon atoms.

Those of ordinary skill in the art understand that the non-photosensitive silver source which is capable of supplying reducible silver ions can be incorporated in the form of mixtures of various silver salt compounds described above.

The photosensitive silver halide grain and the non-photosensitive silver source which is capable of supplying reducible silver ions must be in catalytic proximity (that is, in the distance of reactive association), and these are preferably present in the same layer.

The non-photosensitive silver source which is capable of supplying reducible silver ions is preferably contained in an amount of from 5% by weight to 70% by weight, and more preferably from 10% by weight to 50% by weight, with respect to the total silver amount in the image forming layer.

Further, the amount of the non-photosensitive silver source is generally contained in an amount of from 0.001 $mol/m^2$ to 0.2 $mol/m^2$, and preferably from 0.01 $mol/m^2$ to 0.05 $mol/m^2$, with respect to the black and white photothermographic material.

The total amount of silver in the black and white photothermographic material of the present invention is generally from 0.01 $mol/m^2$ to 0.05 $mol/m^2$.

(Reducing Agent)

The reducing agent which is used in the black and white photothermographic material of the present invention is explained below.

The reducing agent (individual or a mixture comprising two or more reducing agent components) for silver ions can be any material (preferably an organic material) that can reduce silver (I) ion to silver.

The photographic developing agents used for conventional wet processing (such as methyl gallate, hydroquinone, substituted hydroquinones, 3-pyrazolidones, p-aminophenols, p-phenylenediamines, hindered phenols, admioximes, azines, catechols, pyrogallols, ascorbic acid (and derivatives thereof), and leuco dyes), and other materials readily apparent to one skilled in the art, for example, materials described in U.S. Pat. No. 6,020,117 can be used in the present invention.

An "ascorbic acid reducing agent" (referred as a developing agent) indicates a complex including ascorbic acid and their derivatives. Ascorbic acid developing agents are described in many references, for example, in U.S. Pat. No. 5,236,816 and their cited references.

As the developing agents used for the present invention, an ascorbic acid developing agent is preferred. Useful examples of the ascorbic acid developing agent include ascorbic acid and analogous compounds thereof, isomer and derivatives thereof. Examples of such compounds are set forth below, but the invention is not limited to these.

D- and L-ascorbic acids and their glycosylated derivatives (for example, sorboascorbic acid, gamma-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, and L-arabosascorbic acid)

A sodium salt of ascorbic acid

A potassium salt of ascorbic acid

An isoascorbic acid (or L-erythroascorbic acid) and a salt thereof (for example, alkali salt, ammonium salt, or the salt known in this technical field)

An endiol type ascorbic acid

An enaminol type ascorbic acid

A thioenol type ascorbic acid, for example, compounds described in U.S. Pat. No. 5,498,511, EP-A Nos. 0585792, 0573700, and 0588408, U.S. Pat. Nos. 5,278,035, 5,384,232, and 5,376,510, JP-A No. 7-56286, U.S. Pat. No. 2,688,549, and Research Disclosure, item 37152 (March 1995).

Among these, preferred are D-, L-, and D, L-ascorbic acid (and an alkali salt thereof) and isoascorbic acid (and an alkali salt thereof), and preferred salt is a sodium salt. Mixtures of these developing agents can also be used, when necessary.

Hindered phenols are preferably used individually or in combination with one or more of high-gradation developers and contrast-enhancing agents.

Hindered phenol is a compound that has only one hydroxy group on the benzene ring and has at least one additional substituent located on ortho position with respect to the hydroxy group. Hindered phenol developing agents may contain a plurality of hydroxy groups so long as each hydroxy group is located on different benzene rings.

Examples of the hidered phenol reducing agent include binaphthols (that is dihydroxybinaphthols), biphenols (that is dihydroxybiphenols), bis(hydroxynaphthyl)methanes, bis (hydroxyphenyl)methanes (that is bisphenols), hindered phenols, and hindered naphthols, each of which may be substituted.

Representative binaphthols are the compounds described below, but the invention is not limited to these.

1,1'-Bi-2-naphthol
1,1'-Bi-4-methyl-2-naphthol
6,6'-Dibromo-bi-2-naphthol and other compounds are described in U.S. Pat. Nos. 3,094,714 and 5,262,295.

Representative biphenols are the compounds set forth below, but the invention is not limited to these.

2,2'-Dihydroxy-3,3'-di-t-butyl-5,5'-dimethylbiphenyl
2,2'-Dihydroxy-3,3',5,5'-tetra-t-butylbiphenyl
2,2'-Dihydroxy-3,3'-di-t-butyl-5,5'-dichlorobiphenyl
2-(2-Hydroxy-3-t-butyl-5-methyl phenyl)-4-methyl-6-n-hexylphenol
4,4'-Dihydroxy-3,3',5,5'-tetra-t-butylbiphenyl
4,4'-Dihydroxy-3,3',5,5'-tetramethylbiphenyl
Compounds described in U.S. Pat. No. 5,262,295

Representative bis(hydroxynaphthyl)methanes are the compounds set forth below, but the invention is not limited to these.

4,4'-methylenebis(2-methyl-1-naphthol)
Compounds described in U.S. Pat. No. 5,262,295

Representative bis(hydroxyphenyl)methanes are the compounds described below, but the invention is not limited to these.

Bis(2-hydroxy-3-t-butyl-5-methylphenyl)methane (CAO-5)
1,1'-Bis(2-hydroxy-3,5-dimethylphenyl)-3,5,5-trimethylhexane (NONOX or PERMANAX WSO)
1,1'-Bis(3,5-di-t-butyl-4-hydroxyphenyl)methane
2,2'-Bis(4-hydroxy-3-methylphenyl)propane
4,4'-Ethylidene-bis(2-t-butyl-6-methylphenol)
2,2'-Isobutylidene-bis(4,6-dimethylphenol) (LOWINOX 221B46)
2,2'-Bis(3,5-dimethyl-4-hydroxyphenyl)propane
Compounds described in U.S. Pat. No. 5,262,295

Representative hindered phenols are the compounds described below, but the invention is not limited to these.

2,6-Di-t-butylphenol
2,6-Di-t-butyl-4-methylphenol
2,4-Di-t-butylphenol
2,6-Dichlorophenol
2,6-Dimethylphenol
2-t-Butyl-6-methylphenol Representative hindered naphthols are the compounds described below, but the invention is not limited to these.

1-Naphthol
4-Methyl-1-naphthol
4-Methoxy-1-naphthol
4-Chloro-1-naphthol
2-Methyl-1-naphthol
Compounds described in U.S. Pat. No. 5,262,295

Particularly, reducing agents that have been disclosed as suitable ones for the black and white photothermographic material include the following compounds.

Amidoximes (for example, phenylamidoxime)
2-Thienyl-amidoxime
p-Phenoxyphenylamidoxime
Azines (for example, 4-hydroxy-3,5-dimethoxybenzalde hydrazine)
A combination of aliphatic carboxylic acid aryl hydrazide and ascorbic acid (such as a combination of 2,2'-bis-(hydroxymethyl)-propionyl-β-phenylhydrazide and ascorbic acid)
A combination of polyhydroxybenzene and hydroxylamine
A combination of reductone and hydrazine (for example, a combination of hydroquinone and bis(ethoxyethyl) hydroxylamine)
Piperidino-4-methylphenylhydrazine
Hydroxamic acids (for example, phenylhydroxamic acid, p-hydroxylphenylhydroxamic acid, and o-alaninehydroxamic acid)
A combination of azine and sulfonamidophenols (for example, a combination of phenothiazine and 2,6-dichloro-4-benzenesulfonamidophenol)
α-Cyanophenylacetic acid derivatives (for example, ethyl-α-cyano-2-methylphenylacetic acid and ethyl-α-cyanophenylacetic acid)
Bis-o-naphthol (for example, 2,2'-dihydroxy-1-binaphthyl, 6,6'-dibromo-2,2'-dihydroxy-1,1'-binaphthyl, and bis(2-hydroxy-1-naphthyl)methane)
A combination of bis-o-naphthol and 1,3-dihydroxybenzene derivative (for example, 2,4-dihydroxybenzophenone and 2,4-dihydroxyacetophenone)
5-Pyrazolone (for example, 3-methyl-1-phenyl-5-pyrazolone)
Reductones (for example, dimethylaminohexose reductone, anhydrodihydroaminohexose reductone, or anhydrodihydro-piperidone-hexose reductone)
Sulfonamidophenol reducing agents (for example, 2,6-dichloro-4-benzenesulfonamidophenol, or p-benzenesulfonamidophenol)
Indane-1,3-diones (for example, 2-phenylindane-1,3-dione)
Chromans (for example, 2,2-dimethyl-7-t-butyl-6-hydroxychroman)
1,4-Dihydropyridines (for example, 2,6-dimethoxy-3,5-dicarbethoxy-1,4-dihydropyridine)
Ascorbic acid derivatives (for example, 1-ascorbic acid palmitate, and ascorbic acid stearate)
Unsaturated aldehydes (for example, ketone)
3-Pyrazolidones Additional reducing agents that can be used as developing agents are substituted hydrazines including sulfonylhydrazines as described in U.S. Pat. No. 5,464,738. Other useful reducing agents are described for example, in U.S. Pat. Nos. 3,074,809, 3,094,417, 3,080,254, and 3,887,417. Auxiliary reducing agents described in U.S. Pat. No. 5,981,151 is also useful. All compounds disclosed in the above patents can be applied for the present invention.

The elements of reducing agent may comprise two or more constitutional elements such as a hindered phenol developing agent and a compound that can be selected from the various classes of co-reducing agents set forth below. Mixture of three developing agents involving the further addition of a contrast-enhancing agent is also useful.

As the co-reducing agent, trityl hydrazide or formylphenylhydrazide described in U.S. Pat. No. 5,496,695 can be used.

Various contrast-enhancing agents, which are used in black and white photothermographic materials, can be used in combination with the co-reducing agent. As the contrast-enhancing agent, the following compounds are useful, but the invention is not limited to these.

Hydroxylamines (including hydroxylamine, and alkyl- and aryl-substituted derivatives thereof), alkanolamines and ammonium phthalamate compounds described, for example, in U.S. Pat. No. 5,545,505, hydroxamic acid compounds described, for example, in U.S. Pat. No. 5,545,507, N-acylhydrazine compounds described, for example, in U.S. Pat. No. 5,558,983, and hydrogen atom donor compounds described in U.S. Pat. No. 5,637,449.

All of these patents can be applied to the present invention.

The all combination of reducing agent and non-photosensitive organic silver salt are not always effective evenly. One of the preferred combination is a combination of, as non-photosensitive silver source, silver salt of benztraizole or their substituted compounds or the mixture thereof, and as reducing agent, ascorbic acid reducing agent.

The reducing agent (or the mixture thereof) described herein is incorporated in an amount of from 1% by weight to 10% by weight (dry weight) of the image forming layer. In multilayer construction, if the reducing agent is added to a layer other than the image forming layer, slightly higher proportions may be more desirable, such as from about 2% by weight to 15% by weight. The co-developing agent is generally incorporated in an amount of from 0.001% by weight to 1.5% by weight (dry weight) of the image forming layer.

The reducing agent of the invention can be added to the image forming layer which comprises a non-photosensitive organic silver salt and a photosensitive silver halide and to the layer adjacent to the image forming layer, but is preferably contained in the image forming layer.

In the invention, the reducing agent may be incorporated into the black and white photothermographic material by being added into the coating solution in any form, such as in the form of solution, emulsion dispersion, solid fine particle dispersion, or the like.

As well known emulsion dispersing method, there can be mentioned a method comprising dissolving the reducing agent in an oil such as dibutylphthalate, tricresylphosphate, glyceryl triacetate, diethylphthalate, or the like, and an auxiliary solvent such as ethyl acetate, cyclohexanone, or the like, followed by mechanically forming an emulsified dispersion.

As solid fine particle dispersing method, there can be mentioned a method comprising dispersing the reducing agent in a proper solvent such as water or the like, by means of ball mill, colloid mill, vibrating ball mill, sand mill, jet mill, roller mill, or ultrasonics, thereby obtaining solid dispersion. A dispersing method using a sand mill is preferable. During the dispersion, there can also be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). An antiseptic (for instance, benzisothiazolinone sodium salt) can be added in the water dispersion.

Particularly preferably, the reducing agent is used as a solid particle dispersion, and the reducing agent is added in the form of fine particles having average particle size from 0.01 μm to 10 μm, preferably, from 0.05 μm to 5 μm, and more preferably, from 0.1 μm to 1 μm. In the invention, other solid dispersions are preferably used with this particle size range.

(Compound which Substantially Reduces Visible Light Absorption by Photosensitive Silver Halide after Thermal Development)

In the present invention, it is preferred that the black and white photothermographic material contains a compound which substantially reduces visible light absorption by photosensitive silver halide after thermal development versus before thermal development.

In the present invention, it is particularly preferred that a silver iodide complex-forming agent is used as the compound which substantially reduces visible light absorption by photosensitive silver halide after thermal development.

<Silver Iodide Complex-forming Agent>

In the present invention, it is preferred to use a compound which practically reduces the visible light absorption derived from photosensitive silver halide by thermal development, and it is particularly preferred to use a silver iodide complex-forming agent.

Concerning the silver iodide complex-forming agent, at least one of a nitrogen atom or a sulfur atom in the compound can contribute to a Lewis acid-base reaction which gives an electron to a silver ion, as a ligand atom (electron donor: Lewis base). The stability of the complex is defined by successive stability constant or total stability constant, but it depends on the combination of silver ion, iodo ion and the silver complex forming agent. As a general guide, it is possible to obtain a large stability constant by a chelate effect from intramolecular chelate ring formation, by means of increasing the acid-base dissociation constant and the like.

In the present invention, the ultra violet-visible light absorption spectrum of the photosensitive silver halide can be measured by a transmission method or a reflection method. When the absorption derived from other compounds added to the photothermographic material overlaps with the absorption of photosensitive silver halide, the ultra violet-visible light absorption spectrum of photosensitive silver halide can be observed by using, independently or in combination, the means of difference spectrum and removal of other compounds by solvent or the like.

As a silver iodide complex-forming agent according to the present invention, a 5 to 7-membered heterocyclic compound containing at least one nitrogen atom is preferable. In the case where the compound does not have a mercapto group, a sulfide group, or a thione group as a substituent, the said 5 to 7-membered nitrogen-containing heterocycle may be saturated or unsaturated, and may have another substituent. The substituent on a heterocycle may bind to each other to form a ring.

As preferable examples of 5 to 7-membered heterocyclic compounds, pyrrole, pyridine, oxazole, isoxazole, thiazole, isothiazole, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, naphthylizine, purine, pterizine, carbazole, acridine, phenanthoridine, phenanthroline, phenazine, phenoxazine, phenothiazine, benzothiazole, benzoxazole, 1,2,4-triazine, 1,3,5-triazine, pyrrolidine, imidazolidine, pyrazolidine, piperidine, piperazine, morpholine, indoline, isoindoline, and the like can be described. More preferably, pyridine, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, 1,8-naphthylizine, 1,10-phenanthroline, benzotriazole, 1,2,4-triazine, 1,3,5-triazine, and the like can be described. Particularly preferably, pyridine, imidazole, pyrazine, pyrimidine, pyridazine, phtharazine, triazine, 1,8-naphthylizine, 1,10-phenanthroline, and the like can be described.

These rings may have a substituent and any substituent can be used as far as it does not negatively impact the photographic property. As preferable examples, a halogen atom (fluorine atom, chlorine atom, bromine atom, or iodine atom), an alkyl group (a straight, a branched, a cyclic alkyl group containing a bicycloalkyl group and an active methine group), an alkenyl group, an alkynyl group, an aryl group, a heterocyclic group (substituted position is not asked), an acyl group, an alkoxycarbonyl group, an aryloxycarbonyl group, a heterocyclic oxycarbonyl group, a carbamoyl group, an N-acylcarbamoyl group, an N-sulfonylcarbamoyl group, an N-carbamoylcarbamoyl group, an N-sulfamoylcarbamoyl group, a carbazoyl group, a carboxyl group and a salt thereof, an oxalyl group, an oxamoyl group, a cyano group, a carbonimidoyl group, a formyl group, a hydroxy group, an alkoxy group (including the group in which ethylene oxy group units or propylene oxy group units are repeated), an aryloxy group, a heterocyclic oxy group, an acyloxy group, an alkoxycarbonyloxy group, an aryloxycarbonyloxy group, a carbamoyloxy group, a sulfonyloxy group, an amino group, an alkylamino group, an arylamino group, a heterocyclic amino group, an acylamino group, a sulfonamide group, a ureido group, a thioureido group, an imide group, an alkoxycarbonylamino group, an aryloxycarbonylamino group, a sulfamoylamino group, a semicarbazide group, an ammonio group, an oxamoylamino group, an N-alkylsulfonylureido group, an N-arylsulfonylureido group, an N-acylureido group, an N-acylsulfamoylamino group, a nitro group, a heterocyclic group containing a quaternary nitrogen atom (e.g., a pyridinio group, an imidazolio group, a quinolinio group, or an isoquinolinio group), an isocyano group, an imino group, an alkylsulfonyl group, an arylsulfonyl group, an alkylsulfinyl group, an arylsulfinyl group, a sulfo group and a salt thereof, a sulfamoyl group, an N-acylsulfamoyl group, an N-sulfonylsulfamoyl group and a salt thereof, a phosphino group, a phosphinyl group, a phosphinyloxy group, a phosphinylamino group, a silyl group, and the like are described. Here, an active methine group means a methine group substituted by two electron-attracting groups, wherein the electron-attracting group means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, a carbonimidoyl group. Herein, two electron-attracting groups may bind each other to form a cyclic structure. And, the salt means a salt formed with positive ion such as an alkaline metal, an alkaline earth metal, a heavy metal, or the like, or organic positive ion such as an ammonium ion, a phosphonium ion, or the like. These substituents may be further substituted by these substituents.

These heterocycles may be further condensed by another ring. In the case where the substituent is an anion group (e.g., $—CO_2^-$, $—SO_3^-$, $—S^-$, or the like), the heterocycle containing nitrogen atom of the invention may become a positive ion (e.g., pyridinium, 1,2,4-triazolium, or the like) and may form an intramolecular salt.

In the case where a heterocyclic compound is pyridine, pyrazine, pyrimidine, pyridazine, phthalazine, triazine, nathtilizine, or phenanthroline derivative, the acid dissociation constant (pKa) of a conjugated acid of nitrogen-containing heterocyclic part in acid dissociation equilibrium of the said compound is preferably 3 to 8 in the mixture solution of tetrahydrofuran/water (3/2) at 25° C., and more preferably, the pKa is 4 to 7.

As the heterocyclic compound, pyridine, pyridazine, or phtharazine derivative is preferable, and particularly preferable is pyridine or phthalazine derivative.

In the case where these heterocyclic compounds have a mercapto group, a sulfide group or a thione group as the substituent, pyridine, thiazole, isothiazole, oxazole, isoxazole, imidazole, pyrazole, pyrazine, pyrimidine, pyridazine, triazine, triazole, thiadiazole, and oxadiazole derivatives are preferable, and thiazole, imidazole, pyrazole, pyrazine, pyrimidine, pyridazine, triazine, and triazole derivatives are particularly preferable.

For example, as the said silver iodide complex-forming agent, the compound represented by the following formulae (1) or (2) can be used.

Formula (1)

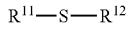

Formula (2)

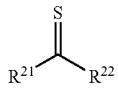

In formula (1), $R^{11}$ and $R^{12}$ each independently represent a hydrogen atom or a substituent. In formula (2), $R^{21}$ and $R^{22}$ each independently represent a hydrogen atom or a substituent. However, both of $R^{11}$ and $R^{12}$ are not hydrogen atoms simultaneously and both of $R^{21}$ and $R^{22}$ are not hydrogen atoms simultaneously. As the substituent herein, the substituent explained as the substituent of a 5 to 7-membered nitrogen-containing heterocyclic type silver iodide complex-forming agent mentioned above can be described.

Further, the compound represented by formula (3) described below can also be used preferably.

Formula (3)

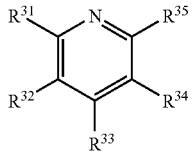

In formula (3), $R^{31}$ to $R^{35}$ each independently represent a hydrogen atom or a substituent. As the substituent represented by $R^{31}$ to $R^{35}$, the substituent of a 5 to 7-membered nitrogen-containing heterocyclic type silver iodide complex-forming agent mentioned above can be used. In the case where the compound represented by formula (3) has a substituent, preferred substituting position is $R^{32}$ to $R^{34}$. $R^{31}$ to $R^{35}$ may bind each other to form a saturated or an unsaturated ring. A preferred substituent is a halogen atom, an alkyl group, an aryl group, a carbamoyl group, a hydroxy group, an alkoxy group, an aryloxy group, a carbamoyloxy group, an amino group, an acylamino group, a ureido group, an alkoxycarbonylamino group, an aryloxycarbonylamino group, or the like.

In the compound represented by formula (3), the acid dissociation constant (pKa) of conjugated acid of pyridine ring part preferably is 3 to 8 in the mixed solution of tetrahydrofuran/water (3/2) at 25° C., and particularly preferably 4 to 7.

Furthermore, the compound represented by formula (4) is also preferable.

Formula (4)

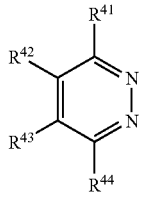

In formula (4), $R^{41}$ to $R^{44}$ each independently represent a hydrogen atom or a substituent. $R^{41}$ to $R^{44}$ may bind each other to form a saturated or an unsaturated ring. As the substituent represented by $R^{41}$ to $R^{44}$, the substituent of a 5 to 7-membered nitrogen-containing heterocyclic type silver iodide complex-forming agent mentioned above can be described. As preferred group, an alkyl group, an alkenyl group, an alkynyl group, an aryl group, a hydroxy group, an alkoxy group, an aryloxy group a heterocyclic oxy group, and a group which forms a phthalazine ring by benzo-condensation are described. In the case where a hydroxy group exists at the carbon atom adjacent to nitrogen atom of the compound represented by formula (4), there exists equilibrium between pyridazinone.

The compound represented by formula (4) more preferably forms a phthalazine ring represented by the following formula (5), and furthermore, this phthalazine ring particularly preferably has at least one substituent.

As examples of $R^{51}$ to $R^{56}$ in formula (5), the substituent of a 5 to 7-membered nitrogen-containing heterocyclic type silver iodide complex-forming agent mentioned above can be described. And as more preferable examples of the substituent, an alkyl group, an alkenyl group, an alkynyl group, an aryl group, a hydroxy group, an alkoxy group, an aryloxy group, and the like are described. An alkyl group, an alkenyl group, an aryl group, an alkoxy group, and an aryloxy group are preferable and an alkyl group, an alkoxy group, and an aryloxy group are more preferable.

Formula (5)

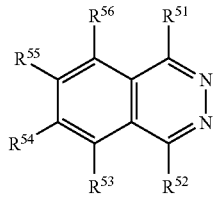

Further, the compound represented by formula (6) described below is also a preferable embodiment.

Formula (6)

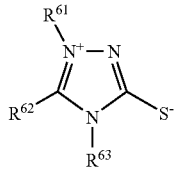

In formula (6), $R^{61}$ to $R^{63}$ each independently represent a hydrogen atom or a substituent. As examples of the substituent represented by $R^{62}$, the substituent of a 5 to 7-membered nitrogen-containing heterocyclic type silver iodide complex-forming agent mentioned above can be described.

As the compound preferably used, the compound represented by the following formula (7) is described.

Formula (7)

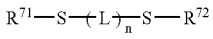

In formula (7), $R^{71}$ and $R^{72}$ each independently represent a hydrogen atom or a substituent. L represents a divalent linking group. n represents 0 or 1. As the substituent represented by $R^{71}$ and $R^{72}$, an alkyl group (containing a cycloalkyl group), an alkenyl group (containing a cycloalkenyl group), an alkynyl group, an aryl group, a heterocyclic group, an acyl group, an aryloxycarbonyl group, an alkoxycarbonyl group, a carbamoyl group, an imide group, and a complex substituent containing these groups are described as examples. A divalent linking group represented by L preferably has the length of 1 to 6 atoms and more preferably has the length of 1 to 3 atoms, and furthermore, may have a substituent.

One more of the compounds preferably used is a compound represented by formula (8).

Formula (8)

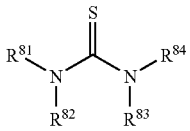

In formula (8), $R^{81}$ to $R^{84}$ each independently represent a hydrogen atom or a substituent. As the substituent represented by $R^{81}$ to $R^{84}$, an alkyl group (including a cycloalkyl group), an alkenyl group (including a cycloalkenyl group), an alkynyl group, an aryl group, a heterocyclic group, an acyl group, an aryloxycarbonyl group, an alkoxycarbonyl group, a carbamoyl group, an imide group, and the like are described as examples.

Among the silver iodide complex-forming agents described above, the compounds represented by formulae (3), (4), (5), (6), or (7) are more preferable and, the compounds represented by formulae (3) or (5) are particularly preferable.

Preferable examples of silver iodide complex-forming agent are described below, however the present invention is not limited in these.

(1)

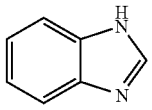

(2)

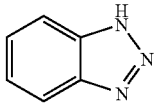

-continued
(3)
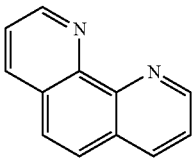
(4)
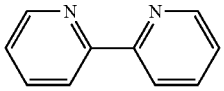
(5)
$C_5H_{11}SC_5H_{11}$
(6)
$C_4H_9SCH_2CH_2SC_4H_9$
(7)
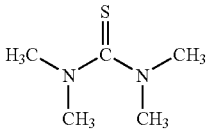
(8)
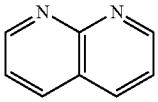
(9)
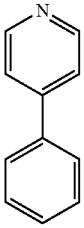
(10)
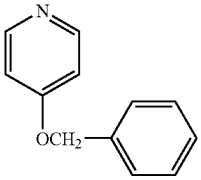
(11)
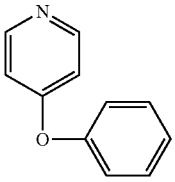
(12)
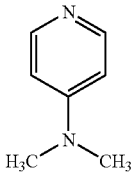
(13)
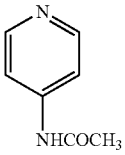
-continued
(14)
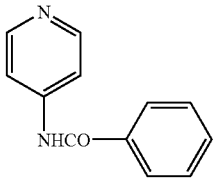
(15)
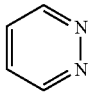
(16)
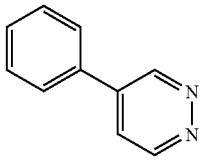
(17)
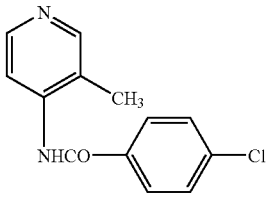
(18)
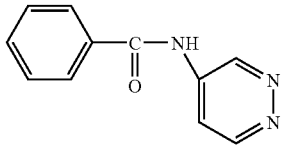
(19)
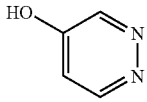
(20)
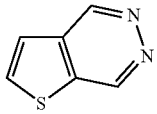
(21)
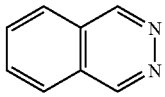
(22)
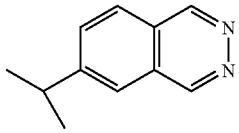
(23)
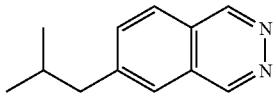
(24)
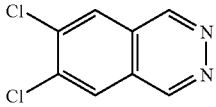

-continued (25)

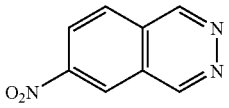

(26)

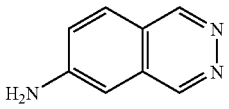

(27)

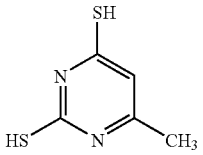

(28)

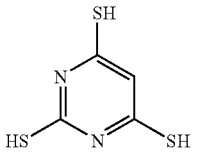

(29)

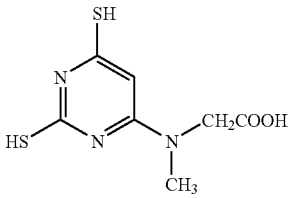

(30)

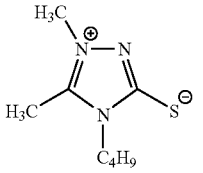

(31)

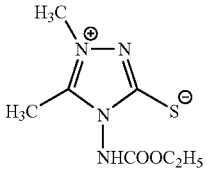

(32)

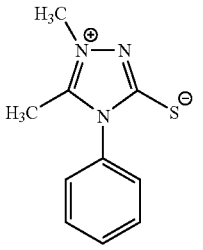

(33)

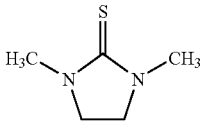

(34)

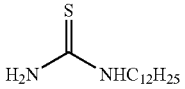

-continued (35)

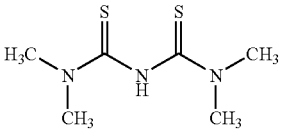

(36)

$HO(CH_2)_3S(CH_2)_2S(CH_2)_3OH$ (37)

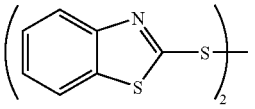

(38)

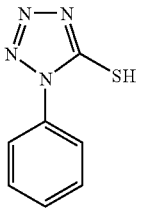

(39)

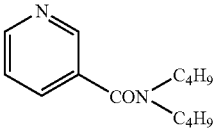

(40)

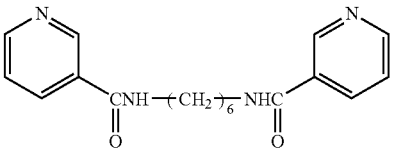

(41)

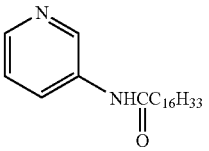

(42)

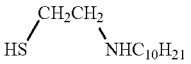

The silver iodide complex-forming agent according to the present invention can also be a compound common to a toner, in the case where the agent achieves the function of conventionally known toner. The silver iodide complex-forming agent according to the present invention can be used in combination with a toner. And, two or more kinds of the silver iodide complex-forming agents may be used in combination.

The silver iodide complex-forming agent according to the present invention preferably exists in a film under the state separated from a photosensitive silver halide, such as a solid state. It is also preferably added to the layer adjacent to the image forming layer. Concerning the silver iodide complex-forming agent according to the present invention, a melting point of the compound is preferably adjusted to a suitable range so that it can be dissolved when heated at the temperature of thermal development.

In the present invention, an absorption intensity of ultra violet-visible light absorption spectrum of photosensitive silver halide after thermal development preferably becomes 80% or less as compared with before thermal development, more preferably 40% or less and, particularly preferably 10% or less.

The silver iodide complex-forming agent according to the invention may be incorporated into a photothermographic material by being added into the coating solution, such as in the form of a solution, an emulsion dispersion, a solid fine particle dispersion, or the like.

Well known emulsion dispersing methods include a method comprising dissolving the silver iodide complex-forming agent in an oil such as dibutylphthalate, tricresylphosphate, glyceryl triacetate, diethylphthalate, or the like, and an auxiliary solvent such as ethyl acetate, cyclohexanone, or the like, followed by mechanically forming an emulsified dispersion.

Solid fine particle dispersing methods include a method comprising dispersing the powder of the silver iodide complex-forming agent according to the invention in a proper solvent such as water or the like, by means of ball mill, colloid mill, vibrating ball mill, sand mill, jet mill, roller mill, or ultrasonics, thereby obtaining a solid dispersion.

In this case, there can also be used a protective colloid (such as polyvinyl alcohol), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia and the like, and Zr and the like eluting from the beads may be incorporated in the dispersion. Depending on the dispersing conditions, the amount of Zr and the like generally incorporated in the dispersion is in a range of from 1 ppm to 1000 ppm. It is practically acceptable so long as Zr is incorporated in the photothermographic material in an amount of 0.5 mg or less per 1 g of silver.

Preferably, an antiseptic (for instance, benzisothiazolinone sodium salt) is added in the water dispersion.

The silver iodide complex-forming agent according to the invention is preferably used in the form of a solid dispersion.

The silver iodide complex-forming agent according to the invention is preferably used in the range from 1 mol % to 5000 mol %, more preferably, from 10 mol % to 1000 mol % and, further preferably, from 50 mol % to 300 mol %, with respect to the photosensitive silver halide in each case.

(Nucleator)

The black and white photothermographic material of the present invention may contain a nucleator.

The nucleator usable in the present invention is a compound, which can form a compound that can newly induce a development by the reaction with a developing product in consequence of an initial development. It was conventionally known to use a nucleator for the ultra-high gradation photosensitive materials suitable for the use in graphic arts. The ultra-high gradation photosensitive materials had an average gradient of 10 or more and were unsuitable for conventional photographic materials, and especially unsuitable for the medical use where high diagnostic ability was required. And because the ultra-high gradation photosensitive material had rough granularity and did not have enough sharpness, there was no potential for medical diagnostic use.

The nucleator in the present invention completely differs from the nucleator in the conventional ultra-high gradation photosensitive material as regards the effect. The nucleator in the present invention does not make a hard gradation.

The nucleator in the present invention is the compound that can cause development sufficiently, even if the number of photosensitive silver halide grains with respect to non-photosensitive silver salt of an organic acid is extremely low. Although that mechanism is not clear, when thermal development is performed using the nucleator according to the present invention, it becomes clear that a large number of developed silver grains exists than the number of photosensitive silver halide grains in the maximum density part, and it is presumed that the nucleator according to the present invention forms the new development points (development nuclei) in those portions where silver halide grains do not exist.

As the nucleator, hydrazine derivative compounds represented by the following formula (H), vinyl compounds represented by the following formula (G), quaternary onium compounds represented by the following formula (P), cyclic olefine compounds represented by formulae (A), (B), or (C), and the like are preferable examples.

Formula (H)

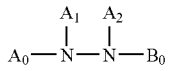

Formula (G)

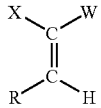

Formula (P)

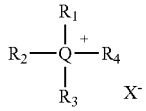

Formula (A)

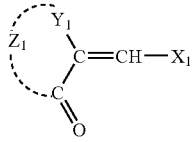

Formula (B)

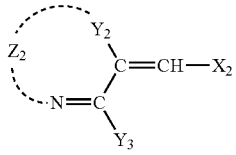

Formula (C)

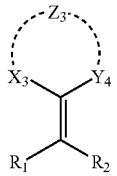

In formula (H), $A_0$ represents one selected from an aliphatic group, an aromatic group, a heterocyclic group, or a $-G_0-D_0$ group, each of which may have a substituent. $B_0$ represents a blocking group. $A_1$ and $A_2$ both represent a hydrogen atom, or one represents a hydrogen atom and the other represents one of an acyl group, a sulfonyl group, and an oxalyl group. Wherein, $G_0$ represents one selected from a —CO— group, a —COCO— group, a —CS— group, a —C(=$NG_1D_1$) group, an —SO— group, an —$SO_2$— group, or a —P(O)($G_1D_1$)— group. $G_1$ represents one selected from a mere bonding hand, an —O— group, an —S— group, or an —N($D_1$)- group, and $D_1$ represents one selected from an aliphatic group, an aromatic group, a heterocyclic group, or a hydrogen atom. In the case where plural $D_1$s exist in a molecule, they may be the same or different. $D_0$ represents one selected from a hydrogen atom, an aliphatic group, an aromatic group, a heterocyclic group, an amino group, an alkoxy group, an aryloxy group, an alkylthio group, or an arylthio group. As preferable $D_0$, a hydrogen atom, an alkyl group, an alkoxy group, an amino group, and the like can be described.

In formula (H), the aliphatic group represented by $A_0$ preferably has 1 to 30 carbon atoms, and particularly preferably is a normal, blanched or cyclic alkyl group having 1 to 20 carbon atoms. For example, a methyl group, an ethyl group, a t-butyl group, an octyl group, a cyclohexyl group, and a benzyl group are described. These may be further substituted by a suitable substituent (e.g., an aryl group, an alkoxy group, an aryloxy group, an alkylthio group, an arylthio group, a sulfoxy group, a sulfonamide group, a sulfamoyl group, an acylamino group, a ureido group, or the like).

In formula (H), the aromatic group represented by $A_0$ is preferably an aryl group of a single or condensed ring. For example, a benzene ring or a naphthalene ring is described. As a heterocycle represented by $A_0$, the heterocycle of a single or condensed ring containing at least one heteroatom selected from a nitrogen atom, a sulfur atom, or an oxygen atom is preferable. For example, a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring and a furan ring are described. The arotamic group, heterocyclic group or $-G_0-D_0$ group, as $A_0$, may have a substituent. As $A_0$, an aryl group or a $-G_0-D_0$ group is particularly preferable.

And, in formula (H), $A_0$ preferably contains at least one of a diffusion-resistant group or an adsorptive group to silver halide. As a diffusion-resistance group, a ballast group usually used as non-moving photographic additive is preferable. As a ballast group, a photochemically inactive alkyl group, alkenyl group, alkynyl group, alkoxy group, phenyl group, phenoxy group, alkylphenoxy group and the like are described and it is preferred that the substituent part has 8 or more carbon atoms in total.

In formula (H), as an adsorption promoting group to silver halide, thiourea, a thiourethane group, a mercapto group, a thioether group, a thione group, a heterocyclic group, a thioamido heterocyclic group, a mercapto heterocyclic group, and an adsorptive group described in JP-A No. 64-90439 are described.

In formula (H), $B_0$ represents a blocking group and preferably a $-G_0-D_0$ group. $G_0$ represents one selected from a —CO— group, a —COCO— group, a —CS— group, a —C(=$NG_1D_1$) group, an —SO— group, an —$SO_2$— group, or a —P(O)($G_1D_1$)— group. As preferable $G_0$, a —CO— group and a —COCO— group are described. $G_1$ represents one selected from a mere bonding hand, an —O— group, an —S— group, or an —N($D_1$)—group, and $D_1$ represents one selected from an aliphatic group, an aromatic group, a heterocyclic group, or a hydrogen atom. In the case where plural $D_1$s exist in a molecule, they may be the same or different. $D_0$ represents one selected from a hydrogen atom, an aliphatic group, an aromatic group, a heterocyclic group, an amino group, an alkoxy group, an aryloxy group, an alkylthio group, or an arylthio group. As preferable $D_0$, a hydrogen atom, an alkyl group, an alkoxy group, an amino group and the like are described. $A_1$ and $A_2$ both represent a hydrogen atom, or one of $A_1$ and $A_2$ represents a hydrogen atom and the other represents one selected from an acyl group (an acetyl group, a trifluoroacetyl group, a benzoyl group or the like), a sulfonyl group (a methanesulfonyl group, a toluenesulfonyl group or the like), or an oxalyl group (an ethoxalyl group or the like).

As specific examples of the compound represented by formula (H), the compound H-1 to H-35 of chemical formula Nos. 12 to 18 and the compound H-1-1 to H-4-5 of chemical formula Nos. 20 to 26 in JP-A No. 2002-131864 are described, however specific examples are not limited in these.

The compounds represented by formula (H) can be easily synthesized by known methods. For example, these can be synthesized by referring to U.S. Pat. Nos. 5,464,738 and 5,496,695.

In addition, hydrazine derivatives preferably used are the compound H-1 to H-29 described in U.S. Pat. No. 5,545,505, columns 11 to 20 and the compounds 1 to 12 described in U.S. Pat. No. 5,464,738, columns 9 to 11. These hydrazine derivatives can be synthesized by known methods.

Next, formula (G) is explained. In formula (G), although X and R are displayed in a cis form, a trans form for X and R is also included in formula (G). This is also similar to the structure display of specific compounds.

In formula (G), X represents an electron-attracting group, and W represents one selected from a hydrogen atom, an alkyl group, an alkenyl group, an alkynyl group, an aryl group, a heterocyclic group, a halogen atom, an acyl group, a thioacyl group, an oxalyl group, an oxyoxalyl group, a thiooxalyl group, an oxamoyl group, an oxycarbonyl group, a thiocarbonyl group, a carbamoyl group, a thiocarbamoyl group, a sulfonyl group, a sulfinyl group, an oxysulfinyl group, a thiosulfinyl group, a sulfamoyl group, an oxysulfinyl group, a thiosulfinyl group, a sulfinamoyl group, a phosphoryl group, a nitro group, an imino group, a N-carbonylimino group, a N-sulfonylimino group, a dicyanoethylene group, an ammonium group, a sulfonium group, a phosphonium group, a pyrylium group, or an immonium group.

R represents one selected from a halogen atom, a hydroxy group, an alkoxy group, an aryloxy group, a heterocyclic oxy group, an alkenyloxy group, an acyloxy group, an alkoxycarbonyloxy group, an aminocarbonyloxy group, a mercapto group, an alkylthio group, an arylthio group, a heterocyclic thio group, an alkenylthio group, an acylthio group, an alkoxycarbonylthio group, an aminocarbonylthio group, an organic or inorganic salt of hydroxy group or mercapto group (e.g., a sodium salt, a potassium salt, a silver salt, or the like), an amino group, an alkylamino group, a cyclic amino group (e.g., a pyrrolidino group), an acylamino group, an oxycarbonylamino group, a heterocyclic group (a 5 or 6-membered nitrogen-containing heterocycle, e.g., a benztriazolyl group, an imidazolyl group, a triazolyl group, a tetrazolyl group, or the like), a ureido group, or a sulfonamide group. X and W, and X and R may bind to each other to form a cyclic structure. As the ring formed by X and W, for example, pyrazolone, pyrazolidinone, cyclopentanedione, β-ketolactone, β-ketolactam, and the like are described.

Explaining formula (G) further, the electron-attracting group represented by X is a substituent which can have a positive value of substituent constant σp. Specifically, a substituted alkyl group (halogen substituted alkyl and the like), a substituted alkenyl group (cyanovinyl and the like), a substituted or unsubstituted alkynyl group (trifluoromethylacetylenyl, cyanoacetylenyl and the like), a substituted aryl group (cyanophenyl and the like), a substituted or unsubstituted heterocyclic group (pyridyl, triazinyl, benzooxazolyl and the like), a halogen atom, a cyano group, an acyl group (acetyl, trifluoroacetyl, formyl and the like), a thioacetyl group (thioacetyl, thioformyl and the like), an oxalyl group (methyloxalyl and the like), an oxyoxalyl group (ethoxalyl and the like), a thiooxalyl group (ethylthiooxalyl and the like), an oxamoyl group (methyloxamoyl and the like), an oxycarbonyl group (ethoxycarbonyl and the like), a carboxyl group, a thiocarbonyl group (ethylthiocarbonyl and the like), a carbamoyl group, a thiocarbamoyl group, a sulfonyl group, a sulfinyl group, an oxysulfonyl group (ethoxysulfonyl and the like), a thiosulfonyl group (ethylthiosulfonyl and the like), a sulfamoyl group, an oxysulfinyl group (methoxysulfinyl and the like), a thiosulfinyl group (methylthiosulfinyl and the like), a sulfinamoyl group, a phosphoryl group, a nitro group, an imino group, a N-carbonylimino group (N-acetylimino and the like), a N-sulfonylimino group (N-methanesulfonylimino and the like), a dicyanoethylene group, an ammonium group, a sulfonium group, a phosphonium group, a pyrylium group, an immonium group and the like are described, and a heterocyclic one formed by an ammonium group, a sulfonium group, a phosphonium group, an immonium group or the like is also included. The substituent having σp value of 0.30 or more is particularly preferable.

As an alkyl group represented by W, methyl, ethyl, trifluoromethyl and the like are described. As an alkenyl group as W, vinyl, halogen-substituted vinyl, cyanovinyl and the like are described. As an alkynyl group as W, acetylenyl, cyanoacetylenyl and the like are described. As an aryl group as W, nitrophenyl, cyanophenyl, pentafluorophenyl and the like are described, and as a heterocyclic group as W, pyridyl, pyrimidyl, triazinyl, succinimide, tetrazolyl, triazolyl, imidazolyl, benzooxazolyl and the like are described. As W, the electron-attracting group having a positive σp value is preferable, and that value is more preferably 0.30 or more.

Among the substituents of R described above, a hydroxy group, a mercapto group, an alkoxy group, an alkylthio group, a halogen atom, an organic or inorganic salt of hydroxy group or mercapto group, and a heterocyclic group are preferably described. More preferably, a hydroxy group, an alkoxy group, an organic or inorganic salt of hydroxy group or mercapto group and a heterocyclic group are described, and particularly preferably, a hydroxy group and an organic or inorganic salt of hydroxy group or mercapto group are described.

And among the substituents of X and W described above, the group having a thioether bond in the substituent is preferable.

As specific examples of the compound represented by formula (G), compound 1-1 to 92-7 of chemical formula Nos. 27 to 50 described in JP-A No. 2002-131864 are described, however specific examples are not limited in these.

In formula (P), Q represents a nitrogen atom or a phosphorus atom. $R_1$, $R_2$, $R_3$, and $R_4$ each independently represent a hydrogen atom or a substituent, and $X^-$ represents an anion. In addition, $R_1$ to $R_4$ may bind to each other to form a cyclic structure.

As the substituent represented by $R_1$ to $R_4$, an alkyl group (a methyl group, an ethyl group, a propyl group, a butyl group, a hexyl group, a cyclohexyl group and the like), an alkenyl group (an allyl group, a butenyl group and the like), an alkynyl group (a propargyl group, a butynyl group and the like), an aryl group (a phenyl group, a naphthyl group and the like), a heterocyclic group (a piperidinyl group, a piperazinyl group, a morpholinyl group, a pyridyl group, a furyl group, a thienyl group, a tetrahydrofuryl group, a tetrahydrothienyl group, a sulforanyl group and the like), an amino group, and the like are described.

As the ring formed by linking $R_1$ to $R_4$ each other, a piperidine ring, a morpholine ring, a piperazine ring, a quinuclidine ring, a pyridine ring, a pyrrole ring, an imidazole ring, a triazole ring, a tetrazole ring, and the like are described.

The group represented by $R_1$ to $R_4$ may have a substituent such as a hydroxy group, an alkoxy group, an aryloxy group, a carboxyl group, a sulfo group, an alkyl group, an aryl group, and the like. As $R_1$, $R_2$, $R_3$, and $R_4$, a hydrogen atom and an alkyl group are preferable.

As the anion represented by $X^-$, an organic or inorganic anion such as a halogen ion, a sulfate ion, a nitrate ion, an acetate ion, a p-toluenesulfonate ion, and the like are described.

As a structure of formula (P), the structure described in paragraph Nos. 0153 to 0163 in JP-A No. 2002-131864 is still more preferable.

As the specific compounds of formula (P), P-1 to P-52 and T-1 to T-18 of chemical formula Nos. 53 to 62 in JP-A No. 2002-131864 can be described, however the specific compound is not limited in these.

The quaternary onium compound described above can be synthesized by referring to known methods. For example, the tetrazolium compound described above can be synthesized by referring to the method described in Chemical Reviews, vol. 55, pages 335 to 483.

Next, the compounds represented by formulae (A) or (B) are explained in detail. In formula (A), $Z_1$ represents a nonmetallic atomic group capable to form a 5 to 7-membered cyclic structure with $—Y_1—C(=CH—X_1)—C(=O)—$. $Z_1$ is preferably an atomic group selected from a carbon atom, an oxygen atom, a sulfur atom, a nitrogen atom, or a hydrogen atom, and several atoms selected from these are bound each other by single bond or double bond to form a 5 to 7-membered cyclic structure with $—Y_1—C(=CH—X_1)—C(=O)—$.

$Z_1$ may have a substituent, and $Z_1$ itself may be an aromatic or a non-aromatic carbon ring, or $Z_1$ may be a part of an aromatic or a non-aromatic heterocycle, and in this case, a 5 to 7-membered cyclic structure formed by $Z_1$ with $—Y_1—C(=CH—X_1)—C(=O)—$ forms a condensed cyclic structure.

In formula (B), $Z_2$ represents a nonmetallic atomic group capable to form a 5 to 7-membered cyclic structure with $—Y_2—C(=CH—X_2)—C(Y_3)=N—$. $Z_2$ is preferably an atomic group selected from a carbon atom, an oxygen atom, a sulfur atom, a nitrogen atom, or a hydrogen atom, and several atoms selected from these are linked each other by single bond or double bond to form a 5 to 7-membered cyclic structure with $—Y_2—C(=CH—X_2)—C(Y_3)=N—$. $Z_2$ may have a substituent, and $Z_2$ itself may be an aromatic or a non-aromatic carbon ring, or $Z_2$ may be a part of an aromatic or a non-aromatic heterocycle and in this case, a 5 to 7-membered cyclic structure formed by $Z_2$ with $—Y_2—C(=CH—X_2)—C(Y_3)=N—$ forms a condensed cyclic structure.

In the case where $Z_1$ and $Z_2$ have a substituent, examples of substituent are selected from the compounds listed below. Namely, as typical substituent, for example, a halogen atom (fluorine atom, chlorine atom, bromine atom or iodine atom), an alkyl group (includes an aralkyl group, a cycloalkyl group and an active methine group), an alkenyl group, an alkynyl group, an aryl group, a heterocyclic group, a heterocyclic group containing a quaternary nitrogen (e.g., a pyridinio group), an acyl group, an alkoxycarbonyl group, an aryloxycarbonyl group, a carbamoyl group, a carboxyl group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including the group in which ethylene oxy group units or propylene oxy group units are repeated), an aryloxy group, a heterocyclic oxy group, an acyloxy group, an alkoxy carbonyloxy group, an aryloxy carbonyloxy group, a carbamoyloxy group, a sulfonyloxy group, an amino group, an alkylamino group, an arylamino group, a heterocyclic amino group, a N-substituted nitrogen-containing heterocyclic group, an acylamino group, a sulfonamide group, a ureido group, a thioureido group, an imide group, an alkoxycarbonylamino group, an aryloxycarbonylamino group, a sulfamoylamino group, a semicarbazide group, a thiosemicarbazide group, a hydrazino group, a quaternary ammonio group, an oxamoylamino group, an alkylsulfonylureido group, an arylsulfonylureido group, an acylureido group, an acylsulfamoylamino group, a nitro group, a mercapto group, an alkylthio group, an arylthio group, a heterocyclic thio group, an alkylsulfonyl group, an arylsulfonyl group, a sulfo group or a salt thereof, a sulfamoyl group, an acylsulfamoyl group, a sulfonylsulfamoyl group or a salt thereof, a group containing phosphoric amide or phosphoric ester structure, a silyl group, a stannyl group, and the like are described. These substituents may be further substituted by these substituents.

Next, $Y_3$ is explained. In formula (B), $Y_3$ represents a hydrogen atom or a substituent, and when $Y_3$ represents a substituent, following group is specifically described as that substituent. Namely, an alkyl group, an aryl group, a heterocyclic group, a cyano group, an acyl group, an alkoxycarbonyl group, an aryloxycarbonyl group, a carbamoyl group, an amino group, an alkylamino group, an arylamino group, a heterocyclic amino group, an acylamino group, a sulfonamide group, a ureido group, a thioureido group, an imide group, an alkoxy group, an aryloxy group, an alkylthio group, an arylthio group, a heterocyclic thio group, and the like are described. These substituents may be substituted by any substituents, and specifically, examples of the substituents which $Z_1$ or $Z_2$ may have, are described.

In formulae (A) and (B), $X_1$ and $X_2$ each independently represent one selected from a hydroxy group (or a salt thereof), an alkoxy group (e.g., a methoxy group, an ethoxy group, a propoxy group, an isopropoxy group, an octyloxy group, a dodecyloxy group, a cetyloxy group, a t-butoxy group, or the like), an aryloxy group (e.g., a phenoxy group, a p-t-pentylphenoxy group, a p-t-octylphenoxy group, or the like), a heterocyclic oxy group (e.g., a benzotriazolyl-5-oxy group, a pyridinyl-3-oxy group, or the like), a mercapto group (or a salt thereof), an alkylthio group (e.g., methylthio group, an ethlythio group, a butylthio group, a dodecylthio group, or the like), an arylthio group (e.g., a phenylthio group, a p-dodecylphenylthio group, or the like), a heterocyclic thio group (e.g., a 1-phenyltetrazoyl-5-thio group, a 2-methyl-1-phenyltriazolyl-5-thio group, a mercaptothiadiazolylthio group, or the like), an amino group, an alkylamino group (e.g., a methylamino group, a propylamino group, an octylamino group, a dimethylamino group, or the like), an arylamino group (e.g., an anilino group, a naphthylamino group, an o-methoxyanilino group, or the like), a heterocyclic amino group (e.g., a pyridylamino group, a benzotriazole-5-ylamino group, or the like), an acylamino group (e.g., an acetamide group, an octanoylamino group, a benzoylamino group, or the like), a sulfonamide group (e.g., a methanesulfonamide group, a benzenesulfonamide group a dodecylsulfonamide group, or the like), or a heterocyclic group.

Herein, a heterocyclic group is an aromatic or non-aromatic, a saturated or unsaturated, a single ring or condensed ring, or a substituted or unsubstituted heterocyclic group. For example, a N-methylhydantoyl group, a N-phenylhydantoyl group, a succinimide group, a phthalimide group, a N,N'-dimethylurazolyl group, an imidazolyl group, a benzotriazolyl group, an indazolyl group, a morpholino group, a 4,4-dimethyl-2,5-dioxo-oxazolyl group, and the like are described.

And herein, a salt represents a salt of an alkali metal (sodium, potassium, or lithium), a salt of an alkali earth metal (magnesium or calcium), a silver salt, a quaternary ammonium salt (a tetraethylammonium salt, a dimethylcetylbenzylammonium salt, or the like), a quaternary phosphonium salt, or the like. In formulae (A) and (B), $Y_1$ and $Y_2$ represent —C(═O)— or —$SO_2$—.

The preferable range of the compounds represented by formulae (A) or (B) is described in JP-A No. 11-231459, paragraph Nos. 0027 to 0043. As specific examples of the compound represented by formulae (A) or (B), compound 1 to 110 of Table 1 to Table 8 in JP-A No. 11-231459 are described, however the invention is not limited in these.

Next, the compound represented by formula (C) is explained in detail. In formula (C), $X_3$ represents one selected from an oxygen atom, a sulfur atom, or a nitrogen atom. In the case where $X_3$ is a nitrogen atom, the bond of $X_3$ and $Z_3$ may be either a single bond or a double bond, and in the case of a single bond, a nitrogen atom may have a hydrogen atom or any substituent. As this substituent, for example, an alkyl group (includes an aralkyl group, a cycloalkyl group, an active methine group, and the like), an alkenyl group, an alkynyl group, an aryl group, a heterocyclic group, an acyl group, an alkoxycarbonyl group, an aryloxycarbonyl group, a carbamoyl group, an alkylsulfonyl group, an arylsulfonyl group, a heterocyclic sulfonyl group, and the like are described.

$Y_4$ represents the group represented by one selected from —C(═O)—, —C(═S)—, —SO—, —$SO_2$—, —C(═$NR_3$)—, or —($R_4$)C═N—. $Z_3$ represents a nonmetallic atomic group capable to form a 5 to 7-membered ring containing $X_3$ and $Y_4$. The atomic group to form that ring is an atomic group which consists of 2 to 4 atoms that are other than metal atoms, and these atoms may be combined by single bond or double bond, and these may have a hydrogen atom or any subsituent (e.g., an alkyl group, an aryl group, a heterocyclic group, an alkoxy group, an alkylthio group, an acyl group, an amino group, or an alkenyl group). When $Z_3$ forms a 5 to 7-membered ring containing $X_3$ and $Y_4$, the ring is a saturated or unsaturated heterocycle, and may be a single ring or may have a condensed ring. When $Y_4$ is the group represented by C(═$NR_3$), ($R_4$)C═N, the condensed ring of this case may be formed by binding $R_3$ or $R_4$ with the substituent of $Z_3$.

In formula (C), $R_1$, $R_2$, $R_3$, and $R_4$ each independently represent a hydrogen atom or a substituent. However, $R_1$ and $R_2$ never bind to each other to form a cyclic structure.

When $R_1$ and $R_2$ represent a monovalent substituent, the following groups are described as a monovalent substituent.

For example, a halogen atom (fluorine atom, chlorine atom, bromine atom, or iodine atom), an alkyl group (including an aralkyl group, a cycloalkyl group, an active methine group, and the like), an alkenyl group, an alkynyl group, an aryl group, a heterocyclic group, a heterocyclic group containing a quaternary nitrogen atom (e.g., a pyridinio group), an acyl group, an alkoxycarbonyl group, an aryloxycarbonyl group, a carbamoyl group, a carboxyl group and a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group and a salt thereof, an alkoxy group (including the group in which ethylene oxy group units or propylene oxy group units are repeated), an aryloxy group, a heterocyclic oxy group, an acyloxy group, an alkoxycarbonyloxy group, an aryloxycarbonyloxy group, a carbamoyloxy group, a sulfonyloxy group, an amino group, an alkylamino group, an arylamino group, an heterocyclic amino group, a N-substituted nitrogen-containing heterocyclic group, an acylamino group, a sulfonamide group, a ureido group, a thioureido group, an imide group, an alkoxycarbonylamino group, an aryloxycarbonylamino group, a sulfamoylamino group, a semicarbazide group, a thiosemicarbazide group, a hydrazino group, a quaternary ammonio group, an oxamoylamino group, an alkylsulfonylureido group, an arylsulfonylureido group, an acylureido group, an acylsulfamoylamino group, a nitro group, a mercapto group and a salt thereof, an alkylthio group, an arylthio group, an heterocyclic thio group, an alkylsulfonyl group, an arylsulfonyl group, an alkylsulfinyl group, an arylsulfinyl group, a sulfo group and a salt thereof, a sulfamoyl group, an acylsulfamoyl group, a sulfonylsulfamoyl group and a salt thereof, a phosphoryl group, a group containing phosphoric amide or phosphoric ester structure, a silyl group, a stannyl group, and the like are described. These substituents may be further substituted by these monovalent substituents.

When $R_3$ and $R_4$ represent a substituent, the same substituent as what $R_1$ and $R_2$ may have except the halogen atom can be described as the substituent. Furthermore, $R_3$ and $R_4$ may further link to $Z_3$ to form a condensed ring.

Next, among the compounds represented by formula (C), preferable compounds are described. In formula (C), $Z_3$ preferably is an atomic group which forms a 5 to 7-membered ring with $X_3$ and $Y_4$, and consists of the atoms selected from 2 to 4 carbon atoms, a nitrogen atom, a sulfur atom, or an oxygen atom. A heterocycle, which is formed by $Z_3$ with $X_3$ and $Y_4$, preferably contains 3 to 40 carbon atoms in total, more preferably 3 to 25 carbon atoms in total, and most preferably 3 to 20 carbon atoms in total. $Z_3$ preferably comprises at least one carbon atom.

In formula (C), $Y_4$ is preferably —C(═O)—, —C(═S)—, —$SO_2$—, or —($R_4$)C═N—, particularly preferably, —C(═O)—, —C(═S)—, or —$SO_2$—, and most preferably, —C(═O)—.

In formula (C), in the case where $R_1$ and $R_2$ represent a monovalent substituent, the monovalent substituent represented by $R_1$ and $R_2$ is preferably one of the following groups having 0 to 25 carbon atoms in total, namely, those are an alkyl group, an aryl group, a heterocyclic group, an alkoxy group, an aryloxy group, a heterocyclic oxy group, an alkylthio group, an arylthio group, a heterocyclic thio group, an amino group, an alkylamino group, an arylamino group, a heterocyclic amino group, a ureido group, an imide group, an acylamino group, a hydroxy group and a salt thereof, a mercapto group and a salt thereof, and an electron-attracting group. Herein, an electron-attracting group means the substituent capable to have a positive value of Hammett substituent constant σp, and specifically a cyano group, a sulfamoyl group, an alkylsulfonyl group, an arylsulfonyl group, a sulfonamide group, an imino group, a nitro group, a halogen atom, an acyl group, a formyl group, a phosphoryl group, a carboxyl group (or a salt thereof), a sulfo group (or a salt thereof), a saturated or unsaturated heterocyclic group, an alkenyl group, an alkynyl group, an acyloxy group, an acylthio group, a sulfonyloxy group, and an aryl group substituted by these electron-attracting group are described. These substituents may have any substituents.

In formula (C), when $R_1$ and $R_2$ represent a monovalent substituent, more preferable are an alkoxy group, an aryloxy group, a heterocyclic oxy group, an alkylthio group, an arylthio group, a heterocyclic thio group, an amino group, an alkylamino group, an arylamino group, a heterocyclic amino group, a ureido group, an imide group, an acylamino group, a sulfonamide group, a heterocyclic group, a hydroxy group or a salt thereof, a mercapto group or a salt thereof, and the like. In formula (C), $R_1$ and $R_2$ particularly preferably are a hydrogen atom, an alkoxy group, an aryloxy group, an alkylthio group, an arylthio group, a heterocyclic group, a hydroxy group or a salt thereof, a mercapto group or a salt thereof, or the like. In formula (C), most preferably, one of $R_1$ and $R_2$ is a hydrogen atom and another is an alkoxy group, an aryloxy group, an alkylthio group, an arylthio group, a heterocyclic group, a hydroxy group or a salt thereof, or a mercapto group or a salt thereof.

In formula (C), when $R_3$ represents a substituent, $R_3$ is preferably an alkyl group having 1 to 25 carbon atoms in total (including an aralkyl group, a cycloalkyl group, an active methine group and the like), an alkenyl group, aryl group, a heterocyclic group, a heterocyclic group containing a quaternary nitrogen (e.g., a pyridinio group), an acyl group, an alkoxycarbonyl group, an aryloxycarbonyl group, a carbamoyl group, an alkylsulfonyl group, an arylsulfonyl group, an alkylsulfinyl group, an arylsulfinyl group, a sulfosulfamoyl group, an alkoxy group, an aryloxy group, a heterocyclic oxy group, an alkylthio group, an arylthio group, a heterocyclic thio group, an amino group, or the like. An alkyl group and an aryl group are particularly preferable.

In formula (C), when $R_4$ represents a substituent, $R_4$ is preferably an alkyl group (including an aralkyl group, a cycloalkyl group, an active methine group, and the like) having 1 to 25 carbon atoms in total, an aryl group, a heterocyclic group, a heterocyclic group containing a quaternary nitrogen atom (e.g., a pyridinio group), an acyl group, an alkoxycarbonyl group, an aryloxycarbonyl group, a carbamoyl group, an alkylsulfonyl group, an arylsulfonyl group, an alkylsulfinyl group, an arylsulfinyl group, a sulfosulfamoyl group, an alkoxy group, an aryloxy group, a heterocyclic oxy group, an alkylthio group, an arylthio group, a heterocyclic thio group, or the like. Particularly preferably, an alkyl group, an aryl group, an alkoxy group, an aryloxy group, a heterocyclic oxy group, an alkylthio group, an arylthio group, a heterocyclic thio group, and the like are described.

Specific compounds represented by formula (C) are represented by A-1 to A-230 of chemical formula Nos. 6 to 18 described in JP-A No. 11-133546, however the invention is not limited in these.

The addition amount of the above nucleator is in a range of $10^{-5}$ mol to 1 mol per 1 mol of organic silver salt, and preferably, in a range of $10^{-4}$ mol to $5\times10^{-1}$ mol.

The nucleator described above may be incorporated into black and white photothermographic material by being added into the coating solution, such as in the form of a solution, an emulsion dispersion, a solid fine particle dispersion, or the like.

As well known emulsion dispersing method, there can be mentioned a method comprising dissolving the nucleator in an oil such as dibutylphthalate, tricresylphosphate, dioctylsebacate, tri(2-ethylhexyl)phosphate, or the like, and an auxiliary solvent such as ethyl acetate, cyclohexanone, or the like, and then adding a surfactant such as sodium dodecylbenzenesulfonate, sodium oleoil-N-methyltaurinate, sodium di(2-ethylhexyl)sulfosuccinate or the like; from which an emulsion dispersion is mechanically produced. During the process, for the purpose of controlling viscosity of oil droplet and refractive index, the addition of polymer such as α-methylstyrene oligomer, poly(t-butylacrylamide), or the like is preferable.

As solid particle dispersing method, there can be mentioned a method comprising dispersing the powder of the nucleator in a proper solvent such as water or the like, by means of ball mill, colloid mill, vibrating ball mill, sand mill, jet mill, roller mill, or ultrasonics, thereby obtaining solid dispersion. In this case, there can also be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)).

In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in a range of from 1 ppm to 1000 ppm. It is practically acceptable so long as Zr is incorporated in an amount of 0.5 mg or less per 1 g of silver.

Preferably, an antiseptic (for instance, benzisothiazolinone sodium salt) is added in the water dispersion.

The nucleator is particularly preferably used as solid particle dispersion, and is added in the form of fine particles having average particle size from 0.01 μm to 10 μm, preferably from 0.05 μm to 5 μm and, more preferably from 0.1 μm to 2 μm.

In the invention, other solid dispersions are preferably used with this particle size range.

In the black and white photothermographic material which is subjected to a rapid development where time period for development is 20 seconds or less, the compound represented by formulae (H) or (P) is used preferably, and the compound represented by formula (H) is used particularly preferably, among the nucleators described above.

In the photothermographic material where low fog is required, the compound represented by formulae (G), (A), (B), or (C) is used preferably, and the compound represented by formulae (A) or (B) is particularly preferably used. Moreover, in the photothermographic materials having a few change of photographic property against environmental conditions when used on various environmental conditions (temperature and humidity), the compound represented by formula (C) is preferably used.

Although preferred specific compounds among the above-mentioned nucleators are shown below, the invention is not limited in these.

SH-1

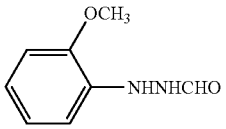

-continued

SH-2

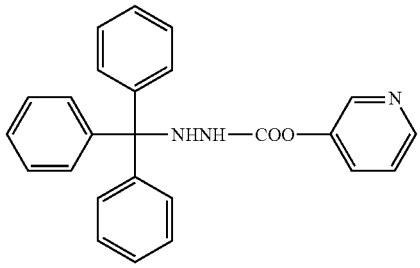

SH-3

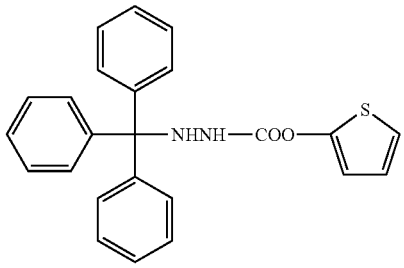

SH-4

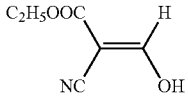

SH-5

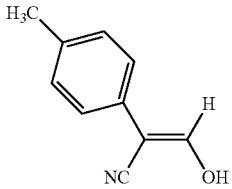

SH-6

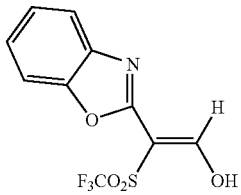

SH-7

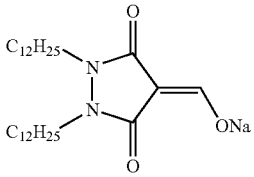

SH-8

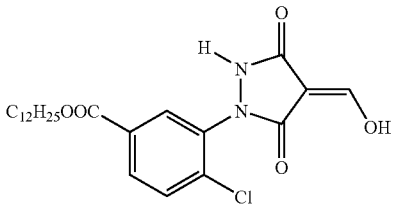

-continued

SH-9

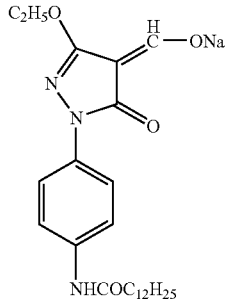

SH-10

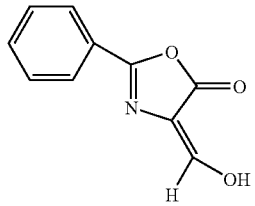

SH-11

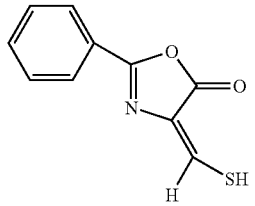

SH-12

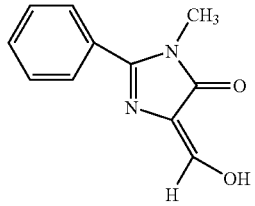

The nucleator of the present invention can be added to the image forming layer or the layer adjacent to the image forming layer, however, it is preferably added to the image forming layer. The addition amount of nucleator is in a range from $10^{-5}$ mol to 1 mol per 1 mol of organic silver salt, and preferably, in a range from $10^{-4}$ mol to $5\times10^{-1}$ mol. The nucleator may be added either only one kind or, two or more kinds in combination.

(Development Accelerator)

In the black and white photothermographic material of the invention, sulfonamidophenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphthalic compounds represented by formula (2) described in the specification of JP-A No. 2001-264929 are used preferably as a development accelerator.

The development accelerator described above is used in a range from 0.1 mol % to 20 mol %, preferably, in a range from 0.5 mol % to 10 mol % and, more preferably, in a range from 1 mol % to 5 mol % with respect to the reducing agent. The introducing methods to the photothermographic material can include similar methods as those for the reducing agent and, it is particularly preferred to add as a solid dispersion or an emulsion dispersion. In the case of adding as an emulsion dispersion, it is preferred to add as an emulsion dispersion dispersed by using a high boiling solvent which is solid at a normal temperature and an auxiliary solvent at a low boiling point, or to add as a so-called oilless emulsion dispersion not using the high boiling solvent.

In the present invention, among the development accelerators described above, it is particularly preferred to use hydrazine compounds represented by formula (1) described in JP-A No. 2002-278017, and phenolic or naphtholic compounds represented by formula (2) described in JP-A No. 2001-264929.

Preferred specific examples for the development accelerator of the invention are to be described below. The invention is not restricted to them.

A-1

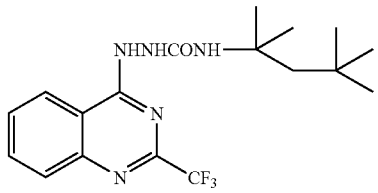

A-2

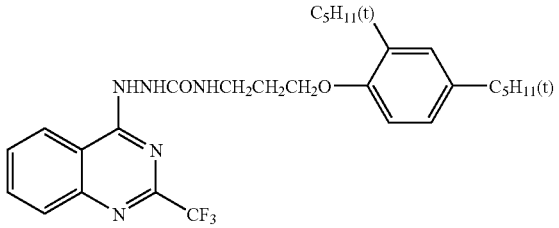

A-3

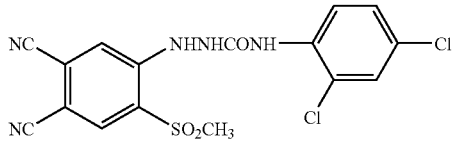

A-4

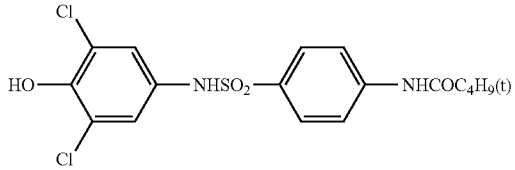

A-5

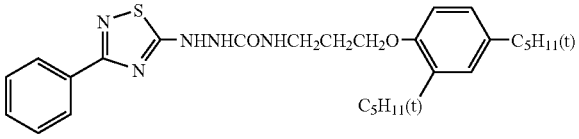

-continued

A-6

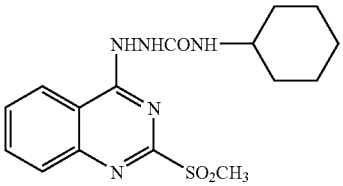

A-7

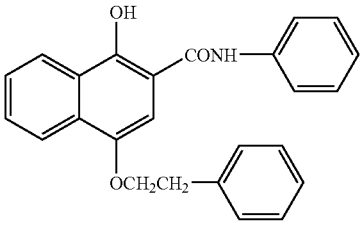

A-8

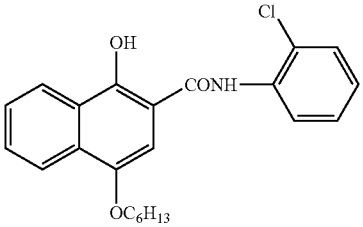

A-9

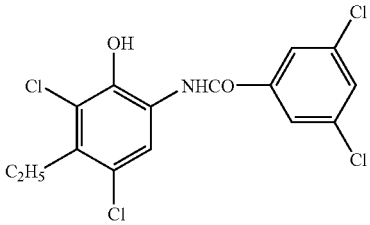

A-10

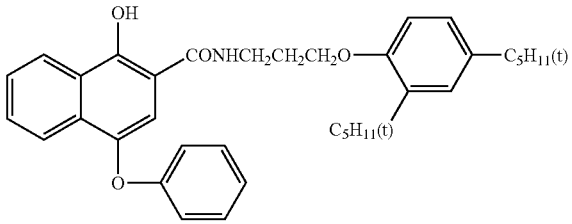

(Hydrogen Bonding Compound)

In the invention, in the case where the reducing agent has an aromatic hydroxy group (—OH) or an amino group, it is preferred to use in combination, a non-reducing compound having a group capable of reacting with these groups of the reducing agent, and that is also capable of forming a hydrogen bond therewith.

As a group capable of forming a hydrogen bond, there can be mentioned a phosphoryl group, a sulfoxide group, a sulfonyl group, a carbonyl group, an amide group, an ester group, a urethane group, a ureido group, a tertiary amino group, a nitrogen-containing aromatic group, and the like. Preferred among them are a phosphoryl group, a sulfoxide group, an amide group (not having >N—H moiety but being blocked in the form of >N—Ra (where, Ra represents a substituent other than H)), a urethane group (not having >N—H moiety but being blocked in the form of >N—Ra (where, Ra represents a substituent other than H)), and a ureido group (not having >N—H moiety but being blocked in the form of >N—Ra (where, Ra represents a substituent other than H)).

In the invention, particularly preferable as the hydrogen bonding compound is the compound expressed by formula (D) shown below.

Formula (D)

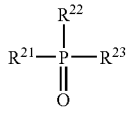

In formula (D), $R^{21}$ to $R^{23}$ each independently represent one selected from an alkyl group, an aryl group, an alkoxy group, an aryloxy group, an amino group, or a heterocyclic group, which may be substituted or unsubstituted.

In the case where $R^{21}$ to $R^{23}$ have a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of an alkyl group represented by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1 -methylcyclohexyl group, a benzyl group, a phenetyl group, a 2-phenoxypropyl group, and the like.

As an aryl group, there can be mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As an alkoxyl group, there can be mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As an aryloxy group, there can be mentioned a phenoxy group, a cresyloxy group, an isopropylphenoxy group, a 4-t-butylphenoxy group, a naphthoxy group, a biphenyloxy group, and the like.

As an amino group, there can be mentioned are a dimethylamino group, a diethylamino group, a dibutylamino group, a dioctylamino group, an N-methyl-N-hexylamino group, a dicyclohexylamino group, a diphenylamino group, an N-methyl-N-phenylamino, and the like.

Preferred as $R^{21}$ to $R^{23}$ are an alkyl group, an aryl group, an alkoxy group, and an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by formula (D) of the invention and others are shown below, but it should be understood that the invention is not limited thereto.

D-1
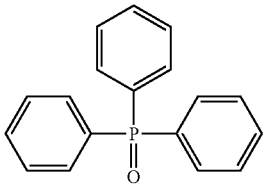
D-2
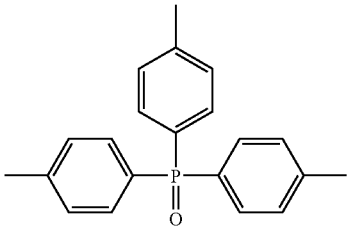
D-3
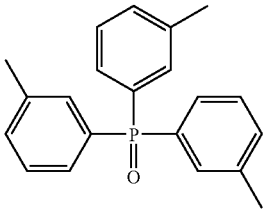
D-4
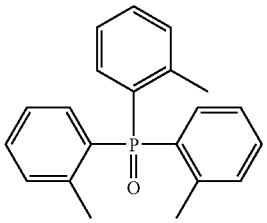
D-5
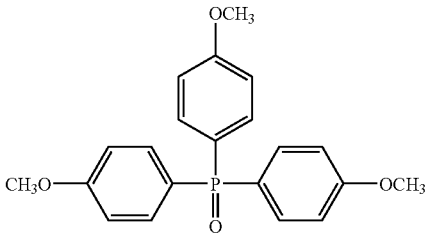
D-6
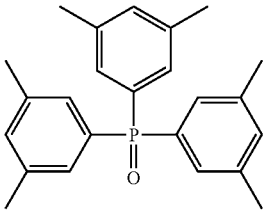
D-7
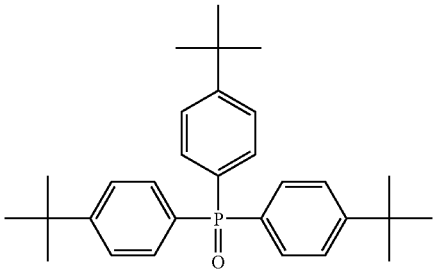
-continued
D-8
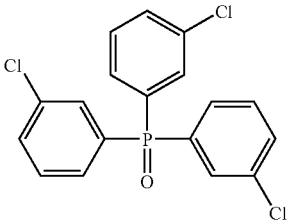
D-9
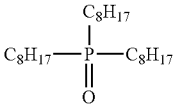
D-10
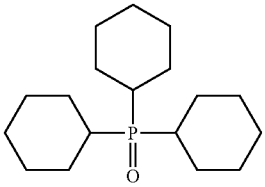
D-11
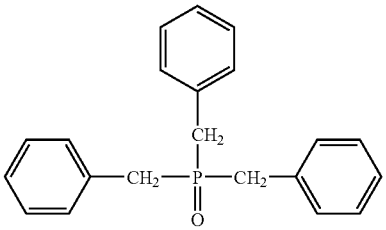
D-12
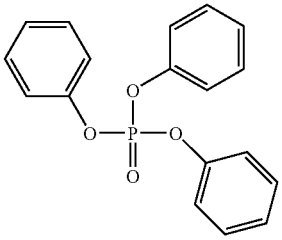
D-13
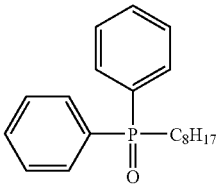
D-14
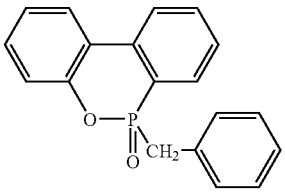
D-15
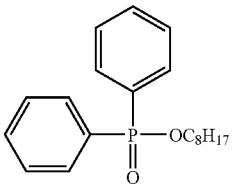

-continued

D-16

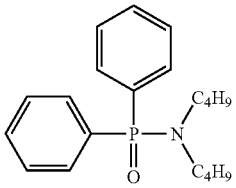

D-17

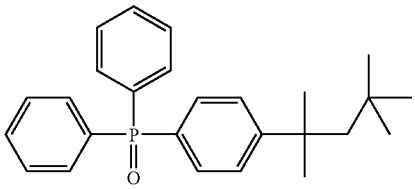

D-18

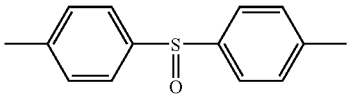

D-19

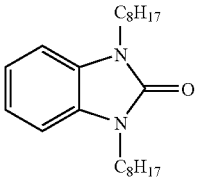

D-20

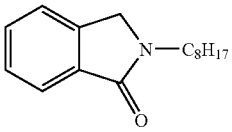

D-21

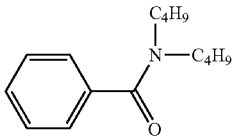

Specific examples of hydrogen bonding compounds other than those enumerated above can be found in those described in JP-A Nos. 2001-281793 and 2002-14438.

The hydrogen bonding compound of the invention can be used in the black and white photothermographic material by being incorporated into the coating solution in the form of solution, emulsion dispersion, or solid fine particle dispersion, similar to the case of the reducing agent.

In the solution, the hydrogen bonding compound of the invention forms a hydrogen-bonded complex with a compound having a phenolic hydroxy group, and can be isolated as a complex in crystalline state depending on the combination of the reducing agent and the compound represented by formula (D).

It is particularly preferred to use the crystal powder thus isolated in the form of a solid fine particle dispersion, because it provides stable performance. Further, it is also preferred to use a method of leading to form complex during dispersion by mixing the reducing agent and the hydrogen bonding compound of the invention in the form of powders and dispersing them with a proper dispersing agent using a sand grinder mill and the like.

The hydrogen bonding compound of the invention is preferably used in a range from 1 mol % to 200 mol %, more preferably from 10 mol % to 150 mol %, and further preferably, from 30 mol % to 100 mol %, with respect to the reducing agent.

(Binder)

The binder used in the black and white photothermographic material of the present invention will be described.

Photosensitive silver halides, non-photosensitive silver sources which are capable of supplying reducible silver ions, reducing agents, toners and any other additives used for the present invention are generally held in one or more binders.

In the present invention, the binder is preferably a hydrophilic polymer or a polymer latex dispersed in a water medium. It is preferred that an aqueous medium (where at least 50% by weight, more preferably at least 70% by weight of the solution may consist of water) is used to prepare the black and white photothermographic material of the present invention.

A mixture of plural binders can also be used as the binder.

1) Hydrophilic Binder

Examples of useful hydrophilic binder include, protein and protein derivatives, gelatin and gelatin derivatives (hardened or unhardened, alkali-treated gelatin, acid-treated gelatin, acetylated gelatin, oxidized gelatin, phthalated gelatin and deionized gelatin), cellulosic materials such as hydroxymethyl cellulose and cellulose ester, acrylamide/methacrylamide polymers, acrylic/methacrylic polymer, poly(vinyl pyrrolidone)s, poly(vinyl alcohol)s, poly(vinyl lactam)s, polymer of sulfoalkyl acrylate or methacrylate, hydrolysised poly(vinyl acetate), polyacrylamide, polysaccarides (for example, dextrans and starch ethers), and other synthetic or natural peptizer which is well known for aqueous photographic emulsion (for example, Research Disclosure, item 38957), but the invention is not limited to these examples. The cationic starches can be preferably used as a peptizer of tabular grain emulsion as described in U.S. Pat. Nos. 5,620,840 and 5,667,955.

Especially, examples of useful hydrophilic binder include gelatin, gelatin derivatives, poly(vinyl alcohol), and cellulosic materials. Gelatin and derivatives thereof are most preferred and preferably present in at least 75% by weight of the total binder when the mixtures of binders are used.

So long as the binder can be selected from hydrophilic polymers in an amount of 50% by weight or more of total binder, "minor" portions of hydrophobic binder may also be present. Examples of typical hydrophobic binder include, but are not limited to these examples, poly(vinyl acetal), poly(vinyl chloride), poly(vinyl acetate), cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers and other materials readily known to one skilled in the art. Copolymers (including trimers) are also included in the definition of polymers. Poly(vinyl acetal) ((for example, poly(vinyl butyral) and poly(vinyl formal)) and vinyl copolymers ((for, example, poly(vinyl acetate) and poly(vinyl chloride)) are particularly preferred. Examples of preferred binder are poly(vinyl butyral) resins that are available as BUTVAR B79 (trade mark, Solutia, Inc.) and PIOLOFORM BS-18, or PIOLOFORM BL-16 (trade mark, Wacker Chemical Company). Water dispersion of hydrophobic binder (for example, latex) in a minor amount can also be used. For example, such latex binder is described in EP No. 0911691A1.

Hardeners for various binders can be used, when necessary. Hydrophilic binders used in the black and white photothermographic material can be hardened partially or completely by a conventional hardener. For example, useful hardeners are well known and include vinyl sulfone synthetic compounds described, for example, in U.S. Pat. No. 6,143,487 and EP No. 040589, and aldehydes and other various hardeners are described in U.S. Pat. No. 6,190,822 and T. H. James, "The THEORY OF THE PHOTOGRAPHIC PROCESS", Fourth Edition, published by Macmillan publishing Co., Inc. (1977), chapter 2, pages 77 to 78.

Where the black and white photothermographic materials require a particular developing time and temperature, the binder should be able to withstand those conditions. Generally, it is preferred that the binder does not decompose or lose its structural integrity at 150° C. for 60 seconds. It is more preferred that it does not decompose or lose its structural integrity at 177° C. for 60 seconds.

The polymer binders are used in an amount sufficient to carry the components dispersed therein. An effective range can be approximately determined by one skilled in the art. Preferably, a binder is used in an amount of about 10% by weight to 90% by weight with respet to the total dry weight of the layer in which it is included, and more preferably about 20% by weight to 70% by weight. In the case of double-sided photothermographic material, the amounts of the binder for both sides may be either the same or different.

2) Polymer Latex

Dispersed states may be a latex, in which water-insoluble fine particles of hydrophobic polymer are dispersed, or such in which polymer molecules are dispersed in molecular states or by forming micelles, but preferred are latex-dispersed particles. The average particle size of the dispersed particles is in a range from 1 nm to 50000 nm, preferably from 5 nm to 1000 nm, more preferably from 10 nm to 500 nm, and further preferably from 50 nm to 200 nm. There is no particular limitation concerning particle size distribution of the dispersed particles, and they may be widely distributed or may exhibit a monodisperse particle size distribution. From the viewpoint of controlling the physical properties of the coating solution, preferred mode of usage includes mixing two or more types of particles each having monodisperse particle distribution.

In the invention, preferred embodiment of the polymers capable of being dispersed in aqueous solvent includes hydrophobic polymers such as acrylic polymers, polyesters, rubbers (e.g., SBR resin), polyurethanes, poly(vinyl chloride)s, poly(vinyl acetate)s, poly(vinylidene chloride)s, polyolefins, and the like. The polymers above may be straight chain polymers, branched polymers, or crosslinked polymers; and may be so-called homopolymers in which one kind of monomer is polymerized, or copolymers in which two or more kinds of monomers are polymerized. In the case of a copolymer, it may be a random copolymer or a block copolymer. The molecular weight of these polymers is, in number average molecular weight, in a range from 5,000 to 1,000,000, and preferably from 10,000 to 200,000. Those having too small a molecular weight exhibit insufficient mechanical strength on forming the image forming layer, and those having too large a molecular weight are also not preferred because the resulting film-forming properties are poor. Further, a polymer latex having crosslinking property is particularly preferably used.

<Specific Examples of Latex>

Specific examples of preferred polymer latexes are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)—(molecular weight 37000, Tg 61° C.)

P-2; Latex of -MMA(70)-2EHA(20)-St(5)-AA(5)—(molecular weight 40000, Tg 59° C.)

P-3; Latex of -St(50)-Bu(47)-MAA(3)—(crosslinking, Tg −17° C.)

P-4; Latex of -St(68)-Bu(29)-AA(3)—(crosslinking, Tg 17° C.)

P-5; Latex of -St(71)-Bu(26)-AA(3)—(crosslinking, Tg 24° C.)

P-6; Latex of -St(70)-Bu(27)-IA(3)—(crosslinking)

P-7; Latex of -St(75)-Bu(24)-AA(1)—(crosslinking, Tg 29° C.)

P-8; Latex of -St(60)-Bu(35)-DVB(3)-MAA(2)—(crosslinking)

P-9; Latex of -St(70)-Bu(25)-DVB(2)-AA(3)—(crosslinking)

P-10; Latex of -VC(50)-MMA(20)-EA(20)-AN(5)-AA(5)—(molecular weight 80000)

P-11; Latex of -VDC(85)-MMA(5)-EA(5)-MAA(5)—(molecular weight 67000)

P-12; Latex of -Et(90)-MAA(10)—(molecular weight 12000)

P-13; Latex of -St(70)-2EHA(27)-AA(3)—(molecular weight 130000, Tg 43° C.)

P-14; Latex of -MMA(63)-EA(35)-AA(2)—(molecular weight 33000, Tg 47° C.)

P-15; Latex of -St(70.5)-Bu(26.5)-AA(3)—(crosslinking, Tg 23° C.)

P-16; Latex of -St(69.5)-Bu(27.5)-AA(3)—(crosslinking, Tg 20.5° C.)

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol L×811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol L×416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of poly(olefin), there can be mentioned Chemipearl S120 and SA100 (all manufactured by Mitsui Petrochemical Industries, Ltd.), and the like.

The polymer latex above may be used alone, or may be used by blending two or more kinds depending on needs.

<Preferable Latex>

Particularly preferable as the polymer latex for use in the invention is that of styrene-butadiene copolymer. The weight ratio of monomer unit for styrene to that of butadiene constituting the styrene-butadiene copolymer is preferably in a range of from 40:60 to 95:5. Further, the monomer unit of styrene and that of butadiene preferably account for 60% by weight to 99% by weight with respect to the copolymer.

Further, the polymer latex of the invention preferably contains acrylic acid or methacrylic acid in a range from 1% by weight to 6% by weight with respect to the sum of styrene and butadiene, and more preferably from 2% by weight to 5% by weight. The polymer latex of the invention preferably contains acrylic acid. Preferable range of molecular weight is similar to that described above.

As the latex of styrene-butadiene copolymer preferably used in the invention, there can be mentioned P-3 to P-8, and P-15, or commercially available LACSTAR 3307B, LACSTAR 7132C, Nipol L×416, and the like.

In the image forming layer of the black and white photothermographic material according to the invention, if necessary, there can be added hydrophilic polymers such as gelatin, poly(vinyl alcohol), methyl cellulose, hydroxypropyl cellulose, carboxymethyl cellulose, or the like. These hydrophilic polymers are added at an amount of 30% by weight or less, and preferably 20% by weight or less, with respect to the total weight of the binder incorporated in the image forming layer.

According to the invention, the layer containing organic silver salt (image forming layer) is preferably formed by using polymer latex for the binder. According to the amount of the binder for the image forming layer, the weight ratio for total binder to organic silver salt (total binder/organic silver salt) is preferably in a range of from 1/10 to 10/1, more preferably from 1/3 to 5/1, and further preferably 1/1 to 3/1.

The image forming layer is, in general, a photosensitive layer containing a photosensitive silver halide, i.e., the photosensitive silver salt; in such a case, the weight ratio for total binder to silver halide (total binder/silver halide) is in a range of from 400 to 5, and more preferably, from 200 to 10.

The total amount of binder in the image forming layer of the invention is preferably in a range from 0.2 $g/m^2$ to 30 $g/m^2$, more preferably from 1 $g/m^2$ to 15 $g/m^2$ and further preferably from 2 $g/m^2$ to 10 $g/m^2$. As for the image forming layer of the invention, there may be added a crosslinking agent for crosslinking, or a surfactant and the like to improve coating properties.

<Preferable Solvent of Coating Solution>

In the invention, a solvent of a coating solution for the image forming layer in the black and white photothermographic material of the invention (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide, ethyl acetate, and the like. A water content in a solvent is more preferably 50% by weight or more and still more preferably 70% by weight or more. Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

(Antifoggant)

In order to control the characteristic of the properties of photothermographic material (e.g., gradation, Dmin, sensitivity, and fog), it is also preferred to add one or more heteroaromatic ring mercapto compound or heteroaromatic ring disulfide compound represented by the formulae Ar—S—$M^1$ or Ar—S—S—Ar. Herein, $M^1$ represents a hydrogen atom or an alkali metal atom, and Ar represents a hetero aromatic ring or a heteroaromatic condensed ring containing at least one or more among a nitrogen atom, a sulfur atom, an oxygen atom, a selenium atom, and a tellurium atom.

As a preferred heteroaromatic ring, benzimidazole, naphthoimidazole, benzothaizole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, and quinazoline are described. The heteroaromatic ring compound, which functions as a supersensitizer, is also preferred. For example, the heteroaromatic ring mercapto compound is described in EP-A No. 0559228 as a supersensitizer for infrared photothermographic materials.

In the black and white photothermographic material of the present invention, an antifoggant or a stabilizer can be used to prevent the generation of fog and to improve the deterioration in sensitivity at the storage. Mercury (II) salt can be also added to the image forming layer, when necessary. The preferred mercury (II) salts for these purposes are mercury acetate and mercury bromide. Another useful mercury salts are described in U.S. Pat. No. 2,728,663.

As suitable antifoggant and stabilizer used by a combination of another method or alone, thiazolium salts described in U.S. Pat. Nos. 2,131,038 and 2,694,716, azaindenes described in U.S. Pat. No. 2,886,437, triazaindolidines described in U.S. Pat. No. 2,444,605, urazoles described in U.S. Pat. No. 3,287,135, sulfocatechols described in U.S. Pat. No. 3,235,652, oximes described in G.B. Patent No. 623448, multivalent metal salts described in U.S. Pat. No. 2,839,405, thiuronium salts described in U.S. Pat. No. 3,220,839, palladium, platinum, and gold salts described in U.S. Pat. Nos. 2,566,263 and 2,597,915, the compound having a —$SO_2CBr_3$ group described in U.S. Pat. Nos. 5,594,143 and 5,374,514, 2-(tribromomethylsulfonyl) quinoline compounds described in U.S. Pat. No. 5,460,938, and the like are described.

The stabilizer precursor, which can release a stabilizer according to the heat during thermal development, can be also used. Such precursor compounds are described in, for example, U.S. Pat. Nos. 5,158,866, 5,175,081, 5,298,390, and 5,300,420.

Further, it was proved that benzotriazoles having a substituted sulfonyl group (e.g., alkylsulfonylbenzotriazoles and arylsulfonylbenzotriazoles) were useful stabilizers (for example, improvement in stability after development) as described in U.S. Pat. No. 6,171,767.

Further, another useful antifoggants/stabilizers are described in U.S. Pat. No. 6,083,681 in more detail.

The black and white photothermographic material of the present invention may have a polyhalogen antifoggant containing one or more polyhalogen substituents having a dichloro group, a dibromo group, a trichloro group, a tribromo group, or the like. These antifoggants may be an aliphatic, alycyclic, or aromatic synthetic compound including a heterocycle or a carbocycle.

Especially useful of this type of antifoggant is a polyhalogen compound having a $—SO_2(X')_3$ group. Herein, X' represents a halogen atom, which is the same or different.

As another useful antifoggant, the compound represented by the following formula (I) and having the pKa of 8 or less can be described.

$$R'—SO_2—C(R^2)R^3—(CO)_m—(L_1)_n—SG \quad \text{Formula (I)}$$

wherein, $R^1$ represents an aliphatic group or a cyclic group. $R^2$ and $R^3$ each independently represent a hydrogen atom or a bromine atom, at least one of them is bromine. $L_1$ represents a divalent aliphatic linking group, m and n each independently represent 0 or 1, and SG represents a soluble group having the pKa of 8 or less.

As preferred embodiment of formula (I):

Both of m and n are O, SG is one selected from a carboxyl group (or a salt thereof), a sulfo group (or a salt thereof), a phospho group (or a salt thereof), $(—SO_2N^-COR^4)(M^2)^+$, and $(—N^-SO_2R^4)(M^2)^+$.

m is 1 and n is 0, and SG is one selected from a carboxyl group (or a salt thereof), a sulfo group (or a salt thereof), a phospho group (or salt thereof), and $(—N^-SO_2R^4)(M^2)^+$.

Both of m and n are 1, SG is one selected from a carboxyl group (or a salt thereof), a sulfo group (or a salt thereof), a phospho group (or a salt thereof), and $(—SO_2N^-COR^4)(M^2)^+$.

Herein, $R^4$ is an aliphatic group or a cyclic group and $(M^2)^+$ is an anion other than a proton.

(Other Additives)

1) Toner

A toner is a synthetic compound, which improves color tone of a developed silver image and increases optical density of developed image.

In a black and white photothermographic material, especially useful toner is the compound, which attributes to form the image having pure black tone.

Therefore, it is desirable to use a toner or a derivative thereof, and it is desirable to contain it in the black and white photothermographic material of present invention.

Such compound is well known in the technology of black and white photothermographic materials and described in U.S. Pat. Nos. 3,080,254, 3,847,612, 4,123,282, 4,082,901, 3,074,809, 3,446,648, 3,844,797, 3,951,660, 5,599,647, 4,220,709, 4,451,561, 4,543,309, 3,832,186, 4,201,582, and 3,881,938, and G.B. Patent No. 1439478.

Special examples are described in the following, however, the invention is not limited in these. Phthalimide, N-hydroxyphthalimide, cyclic imide (e.g., succinimide), pyrazoline-5-one, quinazoline, 1-phenylurazole, 3-phenyl-2-pyrazoline-5-one, 2,4-thiazolidinedione, naphthalimide (e.g., N-hydroxy-1,8-naphthalimide), cobalt complex (e.g., hexaminocobalt(3+)trifluoroacetate), mercaptan (e.g., mercaptotriazoles including 3-mercapto-1,2,4-triazole, 3-mercapto-4-phenyl-1,2,4-triazole, 4-phenyl-1,2,4-triazolidine-3,5-dithione, 4-allyl-3-amine-5-mercapto-1,2,4-triazole, 4-methyl-5-thioxo-1,2,4-triazolidine-3-one and the like, pyrimides including 2,4-dimercaptopyrimidine, thiadiazoles including 2,5-dimercapto-1,3,4-thiadiazole and 5-methyl-1,3,4-thiadiazolyl-2-thiol, mercaptotetrazoles including 1-phenyl-5-mercaptotetrazole, and 5-acetylamino-1,3,4-thiadiazoline-2-thione, mercaptoimidazoles including 1,3-dihydro-1-phenyl-2H-imidazole-2-thione), N-(aminomethyl)allyldicarboxyimides [e.g., (N,N-dimethylaminomethyl)phthalimide, and N-(dimethylaminomethyl)naphthalene-2,3-dicarboxyimide], a combination of blocked pyrazoles, isothiuronium derivatives, and special photographic bleaching agent [e.g., a combination of N,N'-hexamethylene-bis-(1-carbamoyl-3,5-dimethylpyrazole), 1,8-(3,6-diazaoctane)bis(isothiuronium) trifluoroacetate, and 2-(tribromomethylsulfonyl)benzothiazole], merocyanine dye {e.g., 3-ethyl-5-[(3-ethyl-2-benzothiazolinylidene)-1-methylethylidene]-2-thio-2,4-oazolidinedione}, phthalazine and derivatives thereof [e.g., described in U.S. Pat. No. 6,146,822], phtahalazinone and derivatives thereof or a metal salt of the derivative [e.g., 4-(1-naphthyl)phthalazinone, 6-chlorophthalazinone, 5,7-dimethoxyphthalazinone, and 2,3-dihydro-1,4-phthalazinedione], a combination of phthalazine (or a derivative thereof) and one or more phthalic acid derivatives (e.g., phthalic acid, 4-methylphthalic acid, 4-nitrophthalic acid, and tetrachlorophthalic anhydride), quinazolinediones, benzoxazines or naphthoxazine derivatives, rhodium complex which has not only the function of toner but also is the halogen source to form a silver halide in-situ [e.g., 6 chlororhodium (III) ammonium, rhodium bromide, rhodium nitrate and 6 chlororhodium (III) potassium], benzoxazine-2,4-diones (e.g., 1,3-benzoxazine-2,4-dione, 8-methyl-1,3-benzoxazine-2,4-dione, and 6-nitro-1,3-benzoxazine-2,4-dione), pyrimidines and asym-triazines (e.g., 2,4-dihydroxypyrimidine, 2-hydroxy-4-aminopyrimidine, and azauracil) and tetrazapentalene derivatives [e.g., 3,6-dimercapto-1,4-diphenyl-1H,4H-2,3a,5,6a-tetrazapentalene and 1,4-di(o-chlorophenyl)-3,6-dimercapto-1H,4H-2,3a,5,6a-tetrazapentalene].

In the case where a silver salt of nitrogen-containing heterocyclic compound is used as a non-photosensitive silver source which is capable of supplying reducible silver ions, and ascorbic acid, an ascorbic acid complex, or an ascorbic acid derivative is used as a reducing agent, the mercapto compound represented by formula (II) is a especially useful toner of the present invention.

Formula (II)

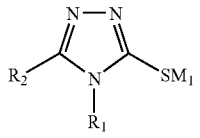

In formula (II), $R_1$ and $R_2$ each independently represent one selected from a hydrogen atom, a substituted or unsubstituted alkyl group having 1 to 7 carbon atoms (e.g., a methyl group, an ethyl group, an isopropyl group, a t-butyl group, a n-hexyl group, a hydroxymethyl group, and a benzyl group), a substituted or unsubstituted alkenyl group wherein the hydrocarbon chain has 2 to 5 carbon atoms (e.g., an ethynyl group, a 1,2-propenyl group, a methallyl group, and a 3-butene-1-yl group), a substituted or unsubstituted cycloalkyl group where its ring is formed by 5 to 7 carbon atoms (e.g., a cyclopentyl group, a cyclohexyl group and a 2,3-dimethylcyclohexyl group), a substituted or unsubstituted, aromatic or non-aromatic heterocycle wherein the heterocycle is formed by 5 or 6 carbon atoms and a nitrogen atom, an oxygen atom, or a sulfur atom (e.g., pyridyl, furanyl, thiazolyl, and thienyl), an amino group or an amide group (e.g., an amino group or an acetamide group) and a substituted or unsubstituted aryl group wherein the aromatic ring is formed by 6 to 10 carbon atoms (e.g., phenyl, toluyl, naphthyl and 4-ethoxyphenyl).

Further, $R_1$ and $R_2$ are substituted or unsubstituted $Y_1$—$(CH_2)_k$—, herein, $Y_1$ is a substituted or unsubstituted aryl group having 6 to 10 carbon atoms defined by $R_1$ and $R_2$ described above or a substituted or unsubstituted, aromatic or non-aromatic heterocyclic group defined by $R_1$ and k is an integer from 1 to 3.

Or, by linking each other, $R_1$ and $R_2$ are a substituted or unsubstituted 5 to 7-membered aromatic or non-aromatic heterocycle including a carbon atom, a nitrogen atom, an oxygen atom, or a sulfur atom. As examples, pyridyl, diazinyl, triazinyl, piperidine, morpholine, pyrrolidine, pyrazolidine, and thiomorpholine can be described.

Further, $R_1$ and $R_2$ may be a divalent linking group which link with two mercaptotriazole groups (e.g., a phenylene group, a methylene group, and an ethylene group), and $R_2$ may further be a carboxyl group and a salt thereof.

$M_1$ is a hydrogen atom or a monovalent anion (e.g., an alkali metal anion, an ammonium ion, or a pyridinium ion).

The mercaptotriazole of formula (II) is preferred to fulfill the following conditions.

(1) $R_1$ and $R_2$ are not hydrogen atoms simultaneously.

(2) When $R_1$ is a substituted or unsubstituted phenyl group or benzyl group, $R_2$ is not a substituted or unsubstituted phenyl group or benzyl group.

(3) When $R_2$ is a hydrogen atom, $R_1$ is not an allenyl, 2,2-diphenylethyl, α-methylbenzyl, or phenyl group having a cyano group or a sulfonic acid group.

(4) When $R_1$ is a benzyl group or a phenyl group, $R_2$ is not a 1,2-dihydroxyethyl group or a 2-hydroxy-2-propyl group having a substituent.

(5) When $R_1$ is a hydrogen atom, $R_2$ is not a 3-phenylthiopropyl group.

Furthermore, one of preferred embodiment is the following black and white photothermographic material.

(6) The pH of at least one image forming layer capable of being thermal developed is 7 or less.

$R_1$ is preferably a methyl group, a t-butyl group, a substituted phenyl group, or a benzyl group. And $R_1$ more preferably is a benzyl group. $R_1$ can represent a divalent linking group which link two mercaptotriazole groups (e.g., phenylene, methylene, or an ethylene group).

$R_2$ is preferably a hydrogen atom, an acetamide group, or a hydroxymethyl group, and more preferably, a hydrogen atom. $R_2$ can represent a divalent linking group which link two mercaptotriazole groups (e.g., phenylene, methylene, or an ethylene group).

As described above, one embodiment is that the pH of at least one image forming layer capable of being thermal developed is 7 or less. The pH of the layer may be controlled to acidic by adding an ascorbic acid as a developing agent. Or the pH may be controlled by adjusting the pH of a silver salt dispersion before coating by addition of a mineral acid, for example, sulfuric acid or nitric acid, or an organic acid such as citric acid.

The pH of at least one image forming layer is preferably less than 7, and more preferably, less than 6. This pH value can be determined by using surface pH electrode after dropping one drop of $KNO_3$ solution on a sample surface. Such electrode can be obtained from Corning Co., Ltd. (Corning (N.Y.)).

Many of toners described here are heterocyclic synthetic compounds. It is known well that a tautomer exists in a heterocyclic synthetic compound. Furthermore, a cyclic tautomer and a substituent tautomer are also possible. For example, it is possible that at least 3 tautomers (1H-type, 2H-type, and 4H-type) exist in 1,2,4-mercaptotetrazole which is a preferable toner.

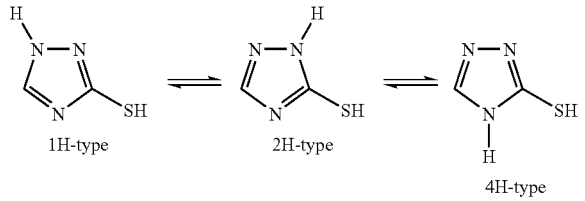

Furthermore, 1,2,4-mercaptotriazole can form thiol-thione substituent tautomer.

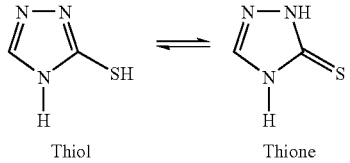

The mutual conversion of these tautomers can be occurred rapidly. And one tautomer may be dominant although each tautomer can not be isolated.

In the present invention, 1,2,4-mercaptotriazole is described as a 4H-thiol structure, however it is used on the assumption that such tautomers exist.

In the case where silver salt of benzotriazole is used as a non-photosensitive silver source which is capable of supplying reducible silver ions and ascorbic acid is used as a reducing agent, the mercaptotriazole compound represented by formula (II) is particularly preferred. A black image having high image density can be obtained by using the compound represented by formula (II).

Representative examples T-1 to T-59 of the compound represented by formula (II), which are preferably used in the present invention, are shown below.

T-1

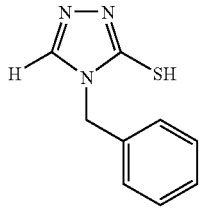

T-2

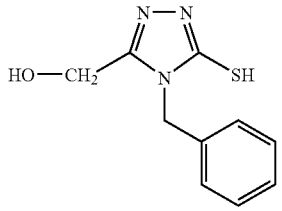

-continued
T-3
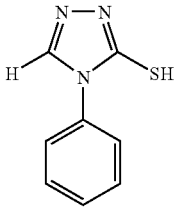
T-4
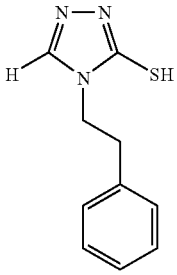
T-5
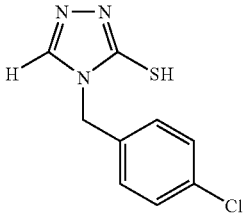
T-6
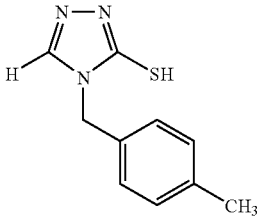
T-7
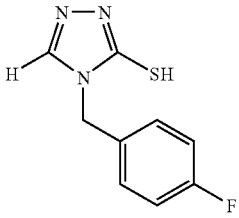
T-8
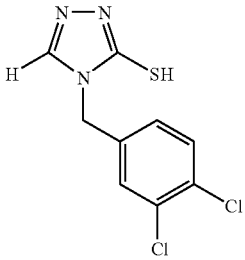
-continued
T-9
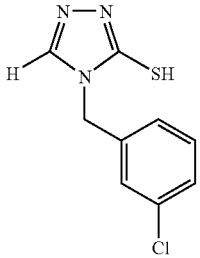
T-10
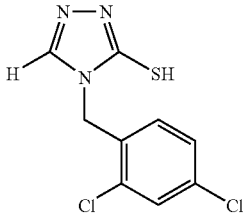
T-11
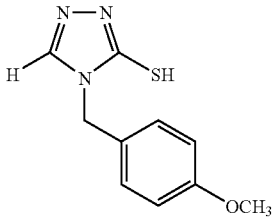
T-12
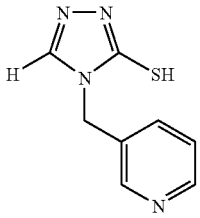
T-13
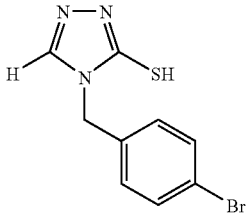
T-14
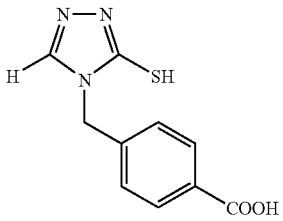
T-15
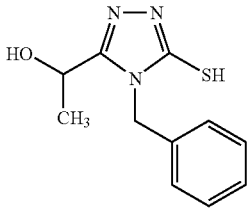

-continued
T-16
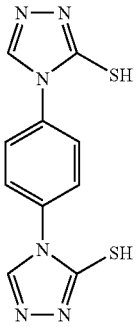
T-17
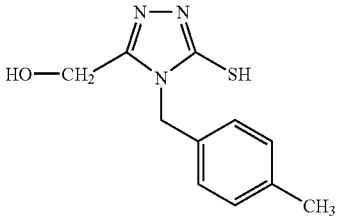
T-18
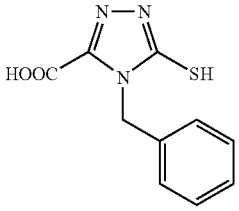
T-19
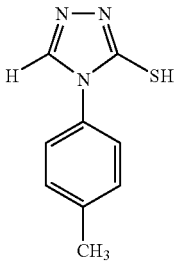
T-20
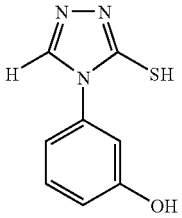
T-21
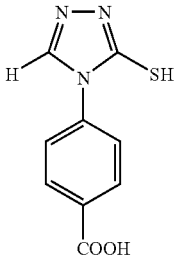
-continued
T-22
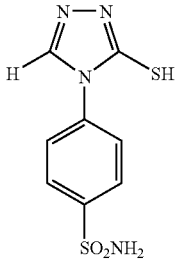
T-23
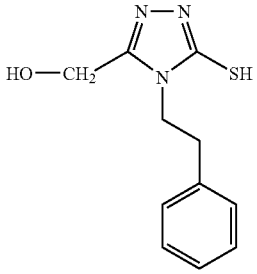
T-24
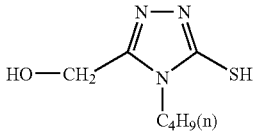
T-25
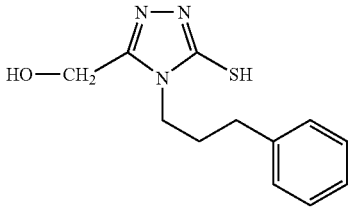
T-26
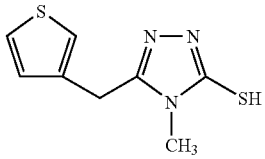
T-27
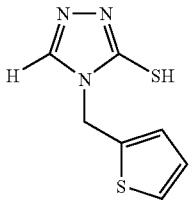
T-28
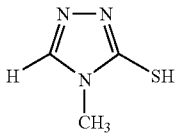
T-29
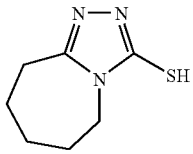

-continued
T-30
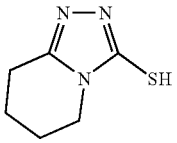
T-31
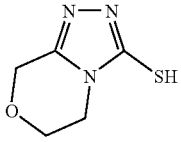
T-32
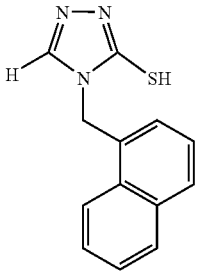
T-33
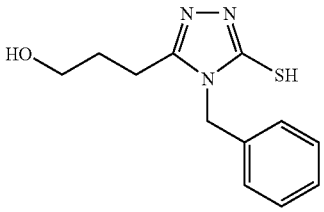
T-34
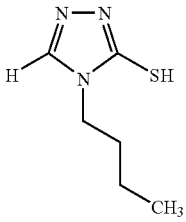
T-35
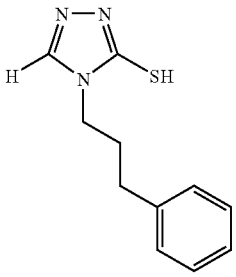
T-36
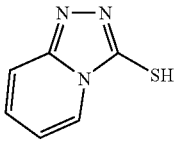
T-37
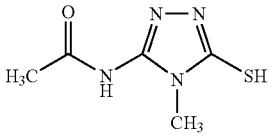
-continued
T-38
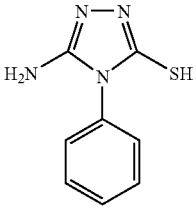
T-39
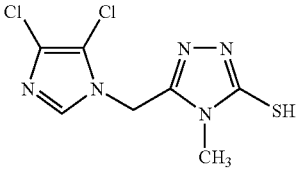
T-40
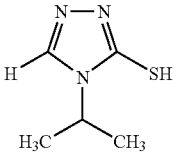
T-41
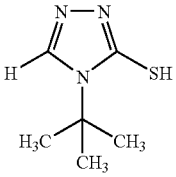
T-42
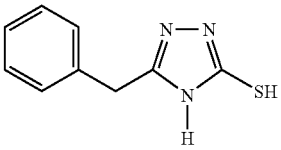
T-43
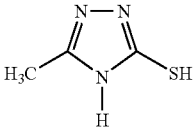
T-44
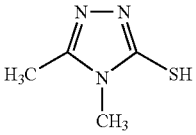
T-45
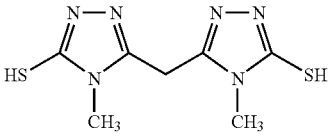
T-46
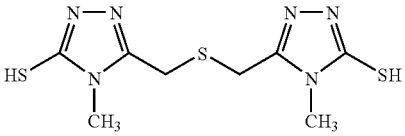

-continued
T-47
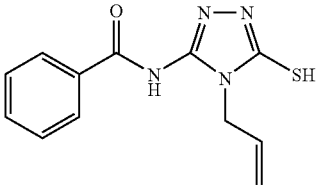
T-48
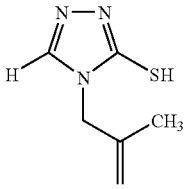
T-49
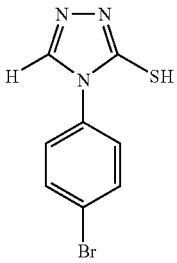
T-50
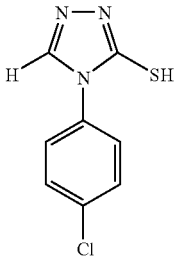
T-51
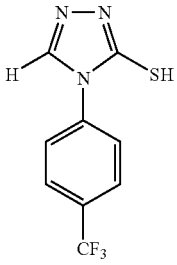
T-52
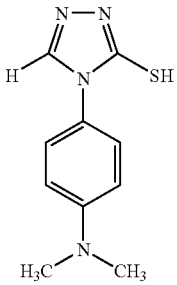
-continued
T-53
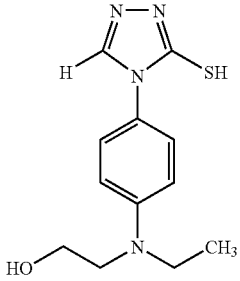
T-54
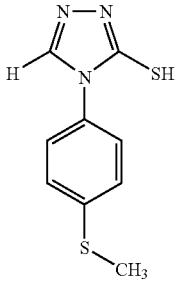
T-55
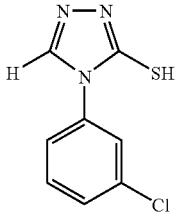
T-56
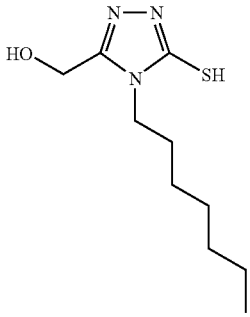
T-57
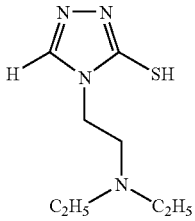
T-58
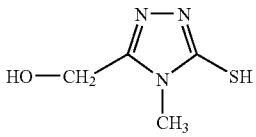

-continued

T-59

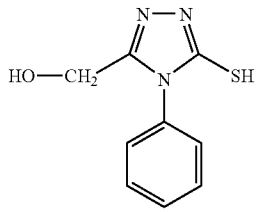

In the present invention, compound Nos. T-1, T-2, T-3, T-11, T-12, T-16, T-37, T-41, and T-44 are more preferred, and compound Nos. T-1, T-2, and T-3 are particularly preferred.

The mercaptotriazole toner can be easily prepared by the well-known synthetic method. For example, compound No. T-1 can be prepared according to the description in U.S. Pat. No. 4,628,059.

The synthetic methods of various mercaptotriazoles are described in U.S. Pat. Nos. 3,769,411, 4,183,925, 6,074,813, DE Patent No. 1670604, and Chemical Abstract, 69, 52114j, 1968. Some mercaptotriazole compounds are commercially available.

As well known in the art, two or more of the mercaptotriazole compounds represented by formula (II) may be used if necessary and plural toners can exist in a same layer or different layer of the black and white photothermographic material.

Furthermore, conventional toner can be additionally included with one or more mercaptotriazole compounds described above. Those compounds are well-known compounds in the technology of black and white photothermographic materials as described in U.S. Pat. Nos. 3,080,254, 3,847,612, 4,123,282, 4,082,901, 3,074,809, 3,446,648, 3,844,797, 3,951,660, and 5,599,647, and G.B. Patent No. 1439478.

A mixture of a mercaptotriazole compound and additional toner (for example, 3 -mercapto-4-benzyl-1,2,4-triazole and phthalazine) is also preferred in the practice of the present invention.

Generally, the addition amount of one or more toners is preferably in a range from about 0.01% by weight to 10% by weight with respect to the total dry weight of the layer containing those toners, and more preferably about from 0.1% by weight to 10% by weight.

The toner may be contained in a layer adjacent to the image forming layer, for example in a protective overcoat layer or a lower "carrier layer", as well as the image forming layer capable of being thermal developed. If the image forming layer capable of being thermal developed exists in the both sides of a support, a toner can also be contained in both sides of a support.

2) Plasticizer and Lubricant

Plasticizers and lubricants usable in the image forming layer of the invention are described in paragraph No. 0117 of JP-A No. 11-65021. Lubricants are described in paragraph Nos. 0061 to 0064 of JP-A No. 11-84573.

3) Dyes and Pigments

From the viewpoint of improving color tone, preventing the generation of interference fringes and preventing irradiation on laser exposure, various kinds of dyes and pigments (for instance, C.I. Pigment Blue 60, C.I. Pigment Blue 64, and C.I. Pigment Blue 15:6) can be used in the image forming layer of the invention. Detailed description can be found in WO No. 98/36322, JP-A Nos. 10-268465 and 11-338098, and the like.

4) Nucleation Accelerator

In the case of using a nucleator in the black and white photothermographic material of the invention, it is preferred to use a nucleation accelerator in combination. As for a nucleation accelerator, description can be found in paragraph No. 0102 of JP-A No. 11-65021, and in paragraph Nos. 0194 to 0195 of JP-A No. 11-223898.

In the case of using a nucleator in the black and white photothermographic material of the invention, it is preferred to use an acid resulting from hydration of diphosphorus pentaoxide, or a salt thereof in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The addition amount of the acid obtained by hydration of diphoshorus pentaoxide or the salt thereof (i.e., the coating amount per 1 $m^2$ of the photothermographic material) may be set as desired depending on sensitivity and fogging, but preferred is an amount of from 0.1 $mg/m^2$ to 500 $mg/m^2$, and more preferably, from 0.5 $mg/m^2$ to 100 $mg/m^2$.

(Preparation of Coating Solution and Coating)

The temperature for preparing the coating solution for the image forming layer of the invention is preferably in a range of from 30° C. to 65° C., more preferably, in a range of 35° C. or more and less than 60° C., and further preferably, in a range of from 35° C. to 55° C. Furthermore, the temperature of the coating solution for the image forming layer immediately after adding the polymer latex is preferably maintained in the temperature range from 30° C. to 65° C.

2. Layer Constitution and Other Constituting Components

The image forming layer of the invention is constructed on a support by one or more layers. In the case of constituting the layer by a single layer, it comprises an organic silver salt, a photosensitive silver halide, a reducing agent, and a binder, which may further comprise additional materials as desired and necessary, such as a toner, a film-forming promoting agent, and other auxiliary agents. In the case of constituting the image forming layer from two or more layers, the first image forming layer (in general, a layer placed nearer to the support) contains an organic silver salt and a photosensitive silver halide, and some of the other components are incorporated in the second image forming layer or in both of the layers.

The photothermographic material according to the invention can have a non-photosensitive layer in addition to the image forming layer. The non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer provided to the side opposite to the image forming layer.

Furthermore, a layer that functions as an optical filter may be provided as (a) or (b) above. An antihalation layer may be provided as (c) or (d) to the photothermographic material.

1) Surface Protective Layer

The black nad white photothermographic material of the invention may comprise a surface protective layer with an object to prevent adhesion of the image forming layer. The surface protective layer may be a single layer, or plural layers.

Description of the surface protective layer may be found in paragraph Nos. 0119 to 0120 of JP-A No. 11-65021 and in JP-A No. 2000-171936.

Preferred as the binder of the surface protective layer of the invention is gelatin, but poly(vinyl alcohol) (PVA) may be used preferably instead, or in combination. As gelatin, there can be used an inert gelatin (e.g., Nitta gelatin 750), a phthalated gelatin (e.g., Nitta gelatin 801), and the like. Usable as PVA are those described in paragraph Nos. 0009 to 0020 of JP-A No. 2000-171936, and preferred are the completely saponified product PVA-105 and the partially saponified PVA-205 and PVA-335, as well as modified poly(vinyl alcohol) MP-203 (trade name of products from Kuraray Ltd.). The coating amount of poly(vinyl alcohol) (per 1 $m^2$ of support) in the protective layer (per one layer) is preferably in a range from 0.3 $g/m^2$ to 4.0 $g/m^2$, and more preferably, from 0.3 g/m to 2.0 $g/m^2$.

The coating amount of total binder (including water-soluble polymer and latex polymer) (per 1 $m^2$ of support) in the surface protective layer (per one layer) is preferably in a range from 0.3 g/m to 5.0 $g/m^2$, and more preferably, from 0.3 $g/m^2$ to 2.0 $g/m^2$.

Further, it is preferred to use a lubricant such as a liquid paraffin, a aliphatic ester, or the like, in the surface protective layer. The addition amount of the lubricant is in a range from 1 $mg/m^2$ to 200 $mg/m^2$, preferably from 10 $mg/m^2$ to 150 $mg/m^2$, and more preferably from 20 $mg/m^2$ to 100 $mg/m^2$.

2) Antihalation Layer

The black and white photothermographic material of the present invention can comprise an antihalation layer provided to the side farther from the light source with respect to the image forming layer.

Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case the exposure wavelength is in the infrared region, an infrared-absorbing dye may be used, and in such a case, preferred are dyes having no absorption in the visible region.

In the case of preventing halation from occurring by using a dye having absorption in the visible region, it is preferred that the color of the dye would not substantially remain after image formation, and is preferred to employ a means for decoloring by the heat of thermal development; in particular, it is preferred to add a thermal bleaching dye and a base precursor to the non-photosensitive layer to impart function as an antihalation layer. Those techniques are described in JP-A No. 11-231457 and the like.

The addition amount of the bleaching dye is determined depending on the usage of the dye. In general, it is used at an amount as such that the optical density (absorbance) exceeds 0.1 when measured at the desired wavelength. The optical density is preferably in a range of from 0.15 to 2, and more preferably from 0.2 to 1. The addition amount of dyes to obtain optical density in the above range is generally from about 0.001 $g/m^2$ to 1 $g/m^2$.

By decoloring the dye in such a manner, the optical density after thermal development can be lowered to 0.1 or lower. Two or more kinds of bleaching dyes may be used in combination in a black and white photothermographic material. Similarly, two or more kinds of base precursors may be used in combination.

In the case of thermal decolorization by the combined use of a bleaching dye and a base precursor, it is advantageous from the viewpoint of thermal decolorization efficiency to further use a substance capable of lowering the melting point by at least 3° C. (deg) when mixed with the base precursor (e.g., diphenylsulfone, 4-chlorophenyl(phenyl)sulfone, 2-naphthyl benzoate, or the like) as disclosed in JP-A No. 11-352626.

3) Back Layer

Back layers usable in the invention are described in paragraph Nos. 0128 to 0130 of JP-A No. 11-65021.

In the invention, coloring matters having maximum absorption in a wavelength range from 300 nm to 450 nm can be added in order to improve color tone of developed silver images and a deterioration of the images during aging. Such coloring matters are described in JP-A Nos. 62-210458, 63-104046, 63-103235, 63-208846, 63-306436, 63-314535, 01-61745, 2001-100363, and the like.

Such coloring matters are generally added in a range of from 0.1 $mg/m^2$ to 1 $g/m^2$, preferably to the back layer which is provided to the side opposite to the image forming layer.

Further, in order to control the basic color tone, it is preferred to use a dye having an absorption peak in the wavelength range of from 580 nm to 680 nm. As a dye satisfying this purpose, preferred are oil-soluble azomethine dyes described in JP-A Nos. 4-359967 and 4-359968, or water-soluble phthalocyanine dyes described in JP-A No. 2003-295388, which have low absorption intensity on the short wavelength side. The dyes for this purpose may be added to any of the layers, but more preferred is to add them in a non-photosensitive layer on the image forming side, or in the back side.

The photothermographic material of the invention is preferably a so-called one-side photosensitive material, which comprises at least one layer of a image forming layer containing silver halide emulsion on one side of the support, and a back layer on the other side.

4) Matting Agent

In the invention, a matting agent is preferably added in order to improve transportability. Description of the matting agent can be found in paragraphs Nos. 0126 to 0127 of JP-A No. 11-65021. The addition amount of the matting agent is preferably in a range from 1 $mg/m^2$ to 400 $mg/m^2$, and more preferably, from 5 $mg/m^2$ to 300 $mg/m^2$, with respect to the coating amount per 1 $m^2$ of the black and white photothermographic material.

In the invention, the shape of the matting agent may be fixed form or non-fixed form. Preferred is to use those having fixed form and globular shape.

Volume weighted mean equivalent spherical diameter of the matting agent used in the image forming layer surface is preferably in a range from 0.3 μm to 10 μm, and more preferably, from 0.5 μm to 7 μm. Further, the particle distribution of the matting agent is preferably set as such that the variation coefficient may become from 5% to 80%, and more preferably, from 20% to 80%. The variation coefficient, herein, is defined by (the standard deviation of particle diameter)/(mean diameter of the particle)×100. Furthermore, two or more kinds of matting agents having different mean particle size can be used in the image forming layer surface. In this case, it is preferred that the difference between the mean particle size of the biggest matting agent and the mean particle size of the smallest matting agent is from 2 μm to 8 μm, and more preferred, from 2 μm to 6 μm.

Volume weighted mean equivalent spherical diameter of the matting agent used in the back surface is preferably in a range from 1 μm to 15 μm, and more preferably, from 3 μm to 10 μm. Further, the particle distribution of the matting agent is preferably set as such that the variation coefficient may become from 3% to 50%, and more preferably, from 5% to 30%. Furthermore, two or more kinds of matting agents having different mean particle size can be used in the back surface. In this case, it is preferred that the difference between the mean particle size of the biggest matting agent and the mean particle size of the smallest matting agent is from 2 μm to 14 μm, and more preferred, from 2 μm to 9 μm.

The level of matting on the image forming layer surface is not restricted as far as star-dust trouble occurs, but the level of matting of 30 seconds to 2000 seconds is preferred, particularly preferred, 40 seconds to 1500 seconds as Beck's smoothness. Beck's smoothness can be calculated easily, by using Japan Industrial Standared (JIS) P8119 "The method of testing Beck's smoothness for papers and sheets using Beck's test apparatus", or TAPPI standard method T479.

The level of matting of the back layer in the invention is preferably in a range of 1200 seconds or less and 10 seconds or more; more preferably, 800 seconds or less and 20 seconds or more; and further preferably, 500 seconds or less and 40 seconds or more, when expressed by Beck smoothness.

In the present invention, a matting agent is preferably contained in an outermost layer, in a layer which can function as an outermost layer, or in a layer nearer to outer surface, and also preferably is contained in a layer which can function as a so-called protective layer.

5) Polymer Latex

A polymer latex is preferably incorporated in the surface protective layer or the back layer, in the black and white photothermographic material of the present invention. As for such polymer latex, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Oyo (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there can be mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl acrylate (25.4% by weight)/styrene (8.6% by weight)/2-hydroethyl methacrylate (5.1% by weight)/acrylic acid (2.0% by weight) copolymer, a latex of methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer, and the like.

Furthermore, as the binder for the surface protective layer, there can be applied the technology described in paragraph Nos. 0021 to 0025 of the specification of JP-A No. 2000-267226, and the technology described in paragraph Nos. 0023 to 0041 of the specification of JP-A No. 2000-19678. The polymer latex in the surface protective layer is preferably contained in an amount of from 10% by weight to 90% by weight, particularly preferably, from 20% by weight to 80% by weight of the total weight of binder.

6) Surface pH

The surface pH of the black and white photothermographic material according to the invention preferably yields a pH of 7.0 or lower, and more preferably, 6.6 or lower, before thermal developing process. Although there is no particular restriction concerning the lower limit, the lower limit of pH value is about 3. Most preferred surface pH range is from 4 to 6.2. From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

7) Hardener

A hardener can be used in each of image forming layer, protective layer, back layer, and the like. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193 and the like, epoxy compounds of U.S. Pat. No. 4,791,042 and the like, and vinyl sulfone compounds of JP-A No. 62-89048.

The hardener is added as a solution, and the solution is added to the coating solution for protective layer 180 minutes before coating to just before coating, preferably 60 minutes before to 10 seconds before coating. However, so long as the effect of the invention is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "EKITAI KONGO GIJUTSU (Liquid Mixing Technology)" (Nikkan Kogyo Shinbunsha, 1989), and the like.

8) Surfactant

As for the surfactant, the solvent, the support, the antistatic or electrically conductive layer, and the method for obtaining color images applicable in the invention, there can be mentioned those disclosed in paragraph Nos. 0132, 0133, 0134, 0135, and 0136, respectively, of JP-A No. 11-65021. The lubricant is described in paragraph Nos. 0061 to 0064 of JP-A No. 11-84573 and in paragraph Nos. 0049 to 0062 of JP-A No. 2000-208857.

In the invention, preferably used are fluorocarbon surfactants. Specific examples of fluorocarbon surfactants can be found in those described in JP-A Nos. 10-197985, 2000-19680, and 2000-214554. Polymer fluorocarbon surfactants described in JP-A 9-281636 can be also used preferably.

For the black and white photothermographic material of the invention, fluorocarbon surfactants described in JP-A Nos. 2002-82411, 2003-57780, and 2001-264110 are preferably used. Especially, the usage of the fluorocarbon surfactants described in JP-A Nos. 2003-57780 and 2001-264110 in an aqueous coating solution is preferred viewed from the standpoint of capacity in static control, stability of the coating surface state and sliding facility. The fluorocarbon surfactants described in JP-A No. 2001-264110 are most preferred because of high capacity in static control and that it needs small amount to use.

In the invention, the fluorocarbon surfactant can be used on either side of image forming layer side or back layer side, but is preferred to use on the both sides. Further, it is particularly preferred to use in combination with electrically conductive layer including aforementioned metal oxides. In this case, the amount of the fluorocarbon surfactant on the side of the electrically conductive layer can be reduced or removed.

The addition amount of the fluorocarbon surfactant is preferably in a range from 0.1 mg/m$^2$ to 100 mg/m$^2$ on each side of image forming layer and back layer, more preferably from 0.3 mg/m$^2$ to 30 mg/m$^2$, and further preferably from 1 mg/m$^2$ to 10 mg/m$^2$. Especially, the fluorocarbon surfactant described in JP-A No. 2001-264110 is effective, and used preferably in a range from 0.01 mg/m$^2$ to 10 mg/m$^2$, and more preferably from 0.1 mg/m$^2$ to 5 mg/m$^2$.

9) Antistatic Agent

The black and white photothermographic material of the invention preferably contains an electrically conductive layer including metal oxides or electrically conductive polymers. The antistatic layer may serve as an undercoat layer, a back surface protective layer, or the like, but can also be placed specially. As an electrically conductive material of the antistatic layer, metal oxides having enhanced electric conductivity by the method of introducing oxygen defects or different types of metallic atoms into the metal oxides are preferably for use. Examples of metal oxides are preferably selected from ZnO, $TiO_2$ and $SnO_2$. As the combination of different types of atoms, preferred are ZnO combined with Al, or In; $SnO_2$ with Sb, Nb, P, halogen atoms, or the like; $TiO_2$ with Nb, Ta, or the like.

Particularly preferred for use is $SnO_2$ combined with Sb. The addition amount of different types of atoms is preferably in a range of from 0.01 mol % to 30 mol %, and more preferably, in a range of from 0.1 mol % to 10 mol %. The shape of the metal oxides can include, for example, spherical, needle-like, or tabular. The needle-like particles, with the rate of (the major axis)/(the minor axis) is 2.0 or more, and more preferably, 3.0 to 50, is preferred viewed from the standpoint of the electric conductivity effect. The metal oxides is used preferably in a range from 1 mg/m$^2$ to 1000 mg/m$^2$, more preferably from 10 mg/m$^2$ to 500 mg/m$^2$, and further preferably from 20 mg/m$^2$ to 200 mg/m$^2$. The antistatic layer can be laid on either side of the image forming layer side or the back layer side, but it is preferred to set between the support and the back layer. Specific examples of the antistatic layer in the invention include described in paragraph Nos. 0135 of JP-A No. 11-65021, in JP-A Nos. 56-143430, 56-143431, 58-62646, and 56-120519, and in paragraph Nos. 0040 to 0051 of JP-A No. 11-84573, in U.S. Pat. No. 5,575,957, and in paragraph Nos. 0078 to 0084 of JP-A No. 11-223898.

10) Support

As the transparent support, preferably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development. In the case of a black and white photothermographic material for medical use, the transparent support may be colored with a blue dye (for instance, dye-1 described in the Example of JP-A No. 8-240877), or may be uncolored. As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684, and the like. The moisture content of the support is preferably 0.5% by weight or less when coating for image forming layer and back layer is conducted on the support.

11) Other Additives

Furthermore, antioxidant, stabilizing agent, plasticizer, UV absorbent, or a film-forming promoting agent may be added to the black and white photothermographic material. Each of the additives is added to either of the image forming layer or the non-photosensitive layer. Reference can be made to WO No. 98/36322, EP No. 803764A1, JP-A Nos. 10-186567 and 10-18568, and the like.

12) Coating Method

The black and white photothermographic material of the invention may be coated by any method. More specifically, various types of coating operations inclusive of extrusion coating, slide coating, curtain coating, immersion coating, knife coating, flow coating, or an extrusion coating using the kind of hopper described in U.S. Pat. No. 2,681,294 are used. Preferably used is extrusion coating or slide coating described in pages 399 to 536 of Stephen F. Kistler and Petert M. Schweizer, "LIQUID FILM COATING" (Chapman & Hall, 1997), and particularly preferably used is slide coating. Example of the shape of the slide coater for use in slide coating is shown in FIG. 11*b*.1, page 427, of the same literature. If desired, two or more layers can be coated simultaneously by the method described in pages 399 to 536 of the same literature, or by the method described in U.S. Pat. No. 2,761,791 and British Patent No. 837095. Particularly preferred in the invention is the method described in JP-A Nos. 2001-194748, 2002-153808, 2002-153803, and 2002-182333.

The coating solution for the image forming layer in the invention is preferably a so-called thixotropic fluid. Concerning this technology, reference can be made to JP-A No. 11-52509. Viscosity of the coating solution for the image forming layer in the invention at a shear velocity of 0.1 $S^{-1}$ is preferably from 400 mPa·s to 100,000 mPa·s, and more preferably, from 500 mPa·s to 20,000 mPa·s. At a shear velocity of 1000 $S^{-1}$, the viscosity is preferably from 1 mPa·s to 200 mPa·s, and more preferably, from 5 mPa·s to 80 mPa·s.

In the case of mixing two types of liquids on preparing the coating solution of the invention, known in-line mixer and in-plant mixer can be used preferably. Preferred in-line mixer of the invention is described in JP-A No. 2002-85948, and the in-plant mixer is described in JP-A No. 2002-90940.

The coating solution of the invention is preferably subjected to defoaming treatment to maintain the coated surface in a fine state. Preferred defoaming treatment method in the invention is described in JP-A No. 2002-66431.

When applying the coating solution of the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image forming layer in the invention, it is important to precisely control the drying wind and the drying temperature. Preferred drying method for use in the invention is described in detail in JP-A Nos. 2001-194749 and 2002-139814.

In order to improve the film-forming properties in the black and white photothermographic material of the invention, it is preferred to apply a heat treatment immediately after coating and drying. The temperature of the heat treatment is preferably in a range of from 60° C. to 100° C. at the film surface, and time period for heating is preferably in a range of from 1 second to 60 seconds. More preferably, heating is performed in a temperature range of from 70° C. to 90° C. at the film surface, and the time period for heating is from 2 seconds to 10 seconds. A preferred method of heat treatment for the invention is described in JP-A No. 2002-107872.

Furthermore, the producing methods described in JP-A Nos. 2002-156728 and 2002-182333 are favorably used in the invention in order to stably and continuously produce the black and white photothermographic material of the invention.

The black and white photothermographic material is preferably of mono-sheet type (i.e., a type which can form image on the black and white photothermographic material without using other sheets such as an image-receiving material).

13) Wrapping Material

In order to suppress fluctuation from occurring on the photographic property during a preservation of the black and white photothermographic material of the invention before thermal development, or in order to improve curling or winding tendencies when the photothermographic material is manufactured in a roll state, it is preferred that a wrapping material having low oxygen transmittance and/or vapor transmittance is used. Preferably, oxygen transmittance is 50 $mL \cdot atm^{-1} m^{-2} day^{-1}$ or lower at 25° C., more preferably, 10 $mL \cdot atm^{-1} m^{-2} day^{-1}$ or lower, and further preferably, 1.0 $mL \cdot atm^{-1} m^{-2} day^{-1}$ or lower. Preferably, vapor transmittance is 10 $g \cdot atm^{-1} m^{-2} day^{-1}$ or lower, more preferably, 5 $g \cdot atm^{-1} m^{-2} day^{-1}$ or lower, and further preferably, 1 $g \cdot atm^{-1} m^{-2} day^{-1}$ or lower.

As specific examples of a wrapping material having low oxygen transmittance and/or vapor transmittance, reference can be made to, for instance, the wrapping material described in JP-A Nos. 8-254793 and 2000-206653.

14) Other Applicable Techniques

Techniques which can be used for the black and white photothermographic material of the invention also include those in EP No. 803764A1, EP No. 883022A1, WO No. 98/36322, JP-A Nos. 56-62648, and 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, and 11-343420, JP-A Nos. 2000-187298, 2000-10229, 2000-47345, 2000-206642, 2000-98530, 2000-98531, 2000-112059, 2000-112060, 2000-112104, 2000-112064, and 2000-171936.

3. Image Forming Method 3-1. Imagewise Exposure

The black and white photothermographic material of the present invention may be either "single-sided type" having an image forming layer on one side of the support, or "double-sided type" having image forming layers on both sides of the support.

(Double-sided Type Photothermographic Material)

The black and white photothermographic material of the present invention is preferably applied for an image forming method to record radiation images using a fluorescent intensifying screen.

The image forming method using the black and white photothermographic materials described above comprises:

(a) providing an assembly for forming an image by placing the photothermographic material between a pair of fluorescent intensifying screens;

(b) putting an analyte between the assembly and an X-ray source;

(c) irradiating the analyte with X-rays having an energy level in a range of 25 kVp to 125 kVp;

(d) taking the photothermographic material out of the assembly; and (e) heating the removed photothermographic material in a temperature range of 90° C. to 180° C.

The black and white photothermographic material used for the assembly in the present invention is subjected to X-ray exposure through a step wedge tablet and thermal development. On the photographic characteristic curve having an optical density (D) and an exposure amount (log E) along the rectangular coordinates having the equal axis-of-coordinate unit, it is preferred to adjust so that the thermal developed image may have the photographic characteristic curve where the average gamma (γ) made at the points of a density of fog+(optical density of 0.1) and a density of fog+(optical density of 0.5) is from 0.5 to 0.9, and the average gamma (γ) made at the points of a density of fog+(optical density of 1.2) and a density of fog+(optical density of 1.6) is from 3.2 to 4.0.

For the X-ray radiography employed in the practice of the present invention, the use of photothermographic material having the aforesaid photographic characteristic curve would give the radiation images with excellent photographic properties that exhibit an extended bottom portion and high gamma value at a middle density area. According to this photographic property, the photographic properties mentioned have the advantage of that the depiction in low density portion on the mediastinal region and the heart shadow region having little X-ray transmittance becomes excellent, and that the density becomes easy to view, and that gradation in the images on the lung field region having much X-ray transmittance becomes excellent.

The black and white photothermographic material having the preferred photographic characteristic curve mentioned above can be easily prepared, for example, by the method where each of the image forming layers of both sides may be constituted of two or more image forming layers containing silver halide and having a sensitivity different from each other. Especially, the aforesaid image forming layer preferably comprises an emulsion of high sensitivity for the upper layer and an emulsion with photographic properties of low sensitivity and high gradation for the lower layer.

In the case of preparing the image forming layer comprising two layers, the sensitivity difference between the silver halide emulsion in each layer is preferably from 1.5 times to 20 times, and more preferably from 2 times to 15 times. The ratio of the amount of emulsion used for forming each layer may depend on the sensitivity difference between emulsions used and the covering power. Generally, as the sensitivity difference is large, the ratio of the using amount of high sensitivity emulsion is reduced.

For example, if the sensitivity difference is two times, and the covering power is equal, the ratio of the amount of high sensitivity emulsion to low sensitivity emulsion would be preferably adjusted to be in the range from 1:20 to 1:50 based on silver amount.

As the techniques for crossover cut (in the case of double-sided photosensitive material) and anti-halation (in the case of single-sided photosensitive material), dyes or combined use of dye and mordant described in JP-A. No. 2-68539, (from page 13, left lower column, line 1 to page 14, left lower column, line 9) can be employed.

Next the fluorescent intensifying screen employed in the practice of the present invention is explained below. The fluorescent intensifying screen essentially comprises a support and a fluorescent substance layer coated on one side of the support as the fundamental structure. The fluorescent substance layer is a layer where the fluorescent substance is dispersed in binders. On the surface of a fluorescent substance layer opposite to the support side (the surface of the side that does not face on the support), a transparent protective layer is generally disposed to protect the fluorescent substance layer from chemical degradation and physical shock.

Preferred fluorescent substances of the present invention are described below. Tungstate fluorescent substances ($CaWO_4$, $MgWO_4$, $CaWO_4$:Pb, and the like), terbium activated rare earth sulfoxide fluorescent substances ($Y_2O_2S$:Tb, $Gd_2O_2S$:Tb, $La_2O_2S$:Tb, $(Y,Gd)_2O_2S$:Tb, $(Y,Gd)O_2S$:Tb, Tm, and the like), terbium activated rare earth phosphate fluorescent substances ($YPO_4$:Tb, $GdPO_4$:Tb, $LaPO_4$:Tb, and the like), terbium activated rare earth oxyhalogen fluorescent substances (LaOBr:Tb, LaOBr:Tb, Tm, LaOCl:Tb, LaOCl:Tb, Tm, LaOBr:Tb, GdOBr:Tb, GdOCl:Tb, and the like), thulium activated rare earth oxyhalogen fluorescent substances (LaOBr:Tm, LaOCl:Tm, and the like), barium sulfate fluorescent substances ($BaSO_4$:Pb, $BaSO_4$:$Eu^{2+}$, (Ba, Sr)$SO_4$:$Eu^{2+}$, and the like), divalent europium activated alkali earth metal phosphate fluorescent substances ($(Ba_2PO_4)_2$:$Eu^{2+}$, $(Ba_2PO_4)_2$:$Eu^{2+}$, and the like), divalent europium activated alkali earth metal fluorinated halogenide fluorescent substances (BaFCl:$Eu^{2+}$, BaFBr:$Eu^{2+}$, BaFCl:$Eu^{2+}$, Tb, BaFBr:$Eu^{2+}$, Tb, $BaF_2$.BaCl.KCl:$Eu^{2+}$, (Ba,Mg)$F_2$.BaCl.KCl:$Eu^{2+}$, and the like), iodide fluorescent substances (CsI:Na, CsI:Tl, NaI, KI:Tl, and the like), sulfide fluorescent substances (ZnS:Ag(Zn,Cd)S:Ag, (Zn,Cd)S:Cu, (Zn,Cd)S:Cu, Al, and the like), hafnium phosphate fluorescent substances ($HfP_2O_7$:Cu and the like), $YTaO_4$ and a substance in which various activator is added as an emission center to $YTaO_4$. However, the fluorescent substance used in the present invention is not particularly limited to these specific examples, so long as to emit light in visible or near ultraviolet region by exposure to a radioactive ray.

The fluorescent intensifying screen which is more preferred for the present invention is a screen where 50% or more of the emission light has a wavelength region from 350 nm to 420 nm. Especially, as the fluorescent substance, a divalent europium activated fluorescent substance is preferred, and a divalent europium activated barium halide fluorescent substance is more preferred. The emission wavelength region is preferably from 360 nm to 420 nm, and more preferably from 370 nm to 420 nm. Moreover, the preferred fluorescent screen can emit 70% or more of the above region, and more preferably 85% or more thereof.

The ratio of the emission light can be calculated from the following method; the emission spectrum is measured where an antilogarithm of the emission wavelength is plotted on the abscissa axis at equal interval and a number of the emitted photon is plotted on the ordinate. The ratio of the emission light in the wavelength region from 350 nm to 420 nm is defined as a value dividing the area from 350 nm to 420 nm on the chart by the entire area of the emission spectrum. The black and white photothermographic materials of the present invention used in combination with the fluorescent substance emitting the above wavelength region can attain high sensitivity.

In order that most of the emission light of the fluorescent substance may exist in the above wavelength region, the narrower half band width is preferred. The preferred half band width is from 1 nm to 70 nm, more preferably from 5 nm to 50 nm, and still more preferably from 10 nm to 40 nm.

So long as the fluorescent substance has the above emission, the fluorescent substance used in the present invention is not particularly limited, but the europium activated fluorescent substance where the divalent europium is an emission center is preferred to attain high sensitivity as the purpose of the invention.

Specific examples of these fluorescent substances are described below, but the scope of the present invention is not limited to the examples.

BaFCl:Eu, BaFBr:Eu, BaFI:Eu, and the fluorescent substances where their halogen composition is changed; $BaSO_4$:Eu, SrFBr:Eu, SrFCl:Eu, SrFI:Eu, $(Sr,Ba)Al_2Si_2O_8$:Eu, $SrB_4O_7F$:Eu, $SrMgP_2O_7$:Eu, $Sr_3(PO_4)_2$:Eu, $Sr_2P_2O_7$:Eu, and the like.

More preferred fluorescent substance is a divalent europium activated barium halide fluorescent substance expressed by the following formula:

$$MX_1X_2:Eu$$

wherein, M represents Ba as a main component, but a small amount of Mg, Ca, Sr, or other compounds may be included. $X_1$ and $X_2$ each represent a halogen atom, and can be selected from F, Cl, Br and I. Herein, $X_1$ is more preferably a fluorine atom. $X_2$ can be selected from Cl, Br, and I, and the mixture with other halogen composition may be used preferably. More preferably X=Br. Eu represents an europium atom. Eu as an emission center is preferably contained at a ratio from $10^{-7}$ to 0.1, based on Ba, more preferably from $10^{-4}$ to 0.05. Preferably the mixture with a small quantity of other compounds can be included. As most preferred fluorescent substance, BaFCl:Eu, BaFBr:Eu, and $BaFBr_{1-X}I_X$:Eu can be described.

FIG. 1 shows an emission spectrum of a fluorescent intensifying screen A using BaFBr:Eu, which can be more preferably used in the present invention, by X-ray excitation.

The fluorescent intensifying screen preferably consists of a support, an undercoat layer on the support, a fluorescent substance layer, and a surface protective layer.

The fluorescent substance layer is prepared as follows. A dispersion solution is prepared by dispersing the fluorescent substance particles described above in an organic solvent solution containing binder resins. The thus-prepared solution is coated directly on the support (or on the undercoat layer such as a light reflective layer provided beforehand on the support) and dried to form the fluorescent substance layer. Besides the above method, the fluorescent substance layer may be formed by the steps of coating the above dispersion solution on the temporary support, drying the coated dispersion to form a fluorescent substance layer sheet, peeling off the sheet from the temporary support, and fixing the sheet onto a permanent support by means of an adhesive agent.

The particle size of the fluorescent substance particles used in the present invention is not particularly restricted, but is usually in a range of from about 1 μm to 15 μm, and preferably from about 2 μm to 10 μm. The higher volume filling factor of the fluorescent substance particles in the fluorescent substance layer is preferred, usually in the range of from 60% to 85%, preferably from 65% to 80%, and particularly preferably from 68% to 75%. (The ratio of the fluorescent substance particles in the fluorescent substance layer is usually 80% by weight or more, preferably 90% by weight or more, and particularly preferably 95% by weight or more). Various kinds of known documents have described the binder resins, organic solvents, and the various additives used for forming the fluorescent substance layer. The thickness of the fluorescent substance layer may be set arbitrary according to the target sensitivity, but is preferably in a range of from 70 μm to 150 μm for the front side screen, and in a range of from 80 μm to 400 μm for the backside screen. The X-ray absorption efficiency of the fluorescent substance layer depends on the coating amount of the fluorescent substance particles in the fluorescent substance layer.

The fluorescent substance layer may consist of one layer, or may consist of two or more layers. It preferably consists of one to three layers, and more preferably, one or two layers. For example, the layer may be prepared by coating a plurality of layers comprising the fluorescent substance particles with different particle size having a comparatively narrow particle size distribution. In that case, the particle size of the fluorescent substance particles contained in each layer may gradually decrease from the top layer to the bottom layer provided next to the support. Especially, the fluorescent substance particles having a large particle size is preferably coated at the side of the surface protective layer and fluorescent substance particles having a small particle size is preferably coated at the side of the support. Hereto, the small particle size of fluorescent substance is preferably in a range from 0.5 μm to 2.0 μm and the large size is preferably in a range from 10 μm to 30 μm.

The fluorescent substance layer may be formed by mixing the fluorescent substance particles with different particle sizes, or the fluorescent substances may be packed in a particle size graded structure as described in JP-A No. 55-33560 (page 3, line 3 on the left column to page 4, line 39 on the left column). Usually, a variation coefficient of a particle size distribution of the fluorescent substance is in a range of from 30% to 50%, but a monodispersed fluorescent substance particles with a variation coefficient of less than 30% can also be preferably used.

Attempts to attain a desired sharpness by dying the fluorescent substance layer with respect to the emission light wavelength are practiced. However, the layer with least dying is preferably required. The absorption length of the fluorescent substance layer is preferably 100 μm or more, and more preferably 1000 μm or more.

The scattering length of the fluorescent substance layer is preferably designed to be from 0.1 μm to 100 μm, and more preferably from 1 μm to 100 μm. The scattering length and the absorption length can be calculated from the equation based on the theory of Kubelka-Munk mentioned below.

As for the support, any support can be selected from various kinds of supports used in the well-known radiographic intensifying screen depending on the purpose. For example, a polymer film containing white pigments such as titanium dioxide or the like, and a polymer film containing black pigments such as carbon black or the like may be preferably used. An undercoat layer such as a light reflective layer containing a light reflective agent may be preferably coated on the surface of the support (the surface of the fluorescent substance layer side). The light reflective layer as described in JP-A No. 2001-124898 may be preferably used. Especially, the light reflective layer containing yttrium oxide described in Example 1 of the above patent or the light reflective layer described in Example 4 thereof is preferred. As for the preferred light reflective layer, the description in JP-A No. 23001-124898 (paragraph 3, 15 line on the right side to paragraph 4, line 23 on the right side) can be referred.

A surface protective layer is preferably coated on the surface of the fluorescent substance layer. The light scattering length measured at the main emission wavelength of the fluorescent substance is preferably in a range of from 5 μm to 80 μm, and more preferably from 10 μm to 70 μm, and particularly preferably from 10 μm to 60 μm. The light scattering length indicates a mean distance in which a light travels straight until it is scattered. Therefore a short scattering length means that the light scattering efficiency is high.

On the other hand, the light absorption length, which indicates a mean free distance until a light is absorbed, is optional. From the viewpoint of the screen sensitivity, no absorption by the surface protective layer favors preventing the desensitization. In order to compensate the scattering loss, a very slightly absorption may be allowable. A preferred absorption length is 800 μm or more, and more preferably 1200 μm or more. The light scattering length and the light absorption length can be calculated from the equation based on the theory of Kubelka-Munk using the measured data obtained by the following method.

Three or more film samples comprising the same component composition as the surface protective layer of the aimed sample but a different thickness from each other are prepared, and then the thickness (μm) and the diffuse transmittance (%) of each of the samples is measured. The diffuse transmittance can be measured by means of a conventional spectrophotometer equipped with an integrating sphere.

For the measurement of the present invention, an automatic recording spectrophotometer (type U-3210, manufactured by Hitachi Ltd.) equipped with an integrating sphere of 150ϕ (150-0901) is used. The measuring wavelength must correspond to the wavelength of the main emission peak of the fluorescent substance in the fluorescent substance layer having the surface protective layer. Thereafter, the film thickness (μm) and the diffuse transmittance (%) obtained in the above measurement is introduced to the following equation (A) derived from the theoretical equation of Kubelka-Munk. For example, the equation (A) can be derived easily, under the boundary condition of the diffuse transmittance (%), from the equations 5•1•12 to 5•1•15 on page 403 described in "Keikotai Hando Bukku" (the Handbook of Fluorescent Substance) (edited by Keikotai Gakkai, published by Ohmsha Ltd. 1987).

$$T/100=4\beta/[(1+\beta)^2\cdot\exp(\alpha d)-(1-\beta)^2\cdot\exp(-\alpha d)] \quad \text{Equation (A)}$$

wherein, T represents a diffuse transmittance (%), d represents a film thickness (μm) and, α and β are defined by the following equation respectively.

$$\alpha=[K\cdot(K+2S)]^{1/2}$$

$$\beta=[K/(K+2S)]^{1/2}$$

T (diffuse transmittance: %) and d (film thickness: μm) measured from three or more film samples are introduced respectively to the equation (A), and thereby the value of K and S are determined to satisfy the equation (A). The scattering length (μm) and the absorption length (μm) are defined by 1/S and 1/K respectively.

The surface protective layer may preferably comprise light scattering particles dispersed in a resin material. The light refractive index of the light scattering particles is usually 1.6 or more, and more preferably 1.9 or more. The particle size of the light scattering particles is in a range of from 0.1 μm to 1.0 μm. Examples of the light scattering particles may include the fine particles of aluminum oxide, magnesium oxide, zinc oxide, zinc sulfide, titanium oxide, niobium oxide, barium sulfate, lead carbonate, silicon oxide, polymethyl methacrylate, styrene, and melamine.

The resin materials used to form the surface protective layer are not particularly limited, but poly(ethylene terephthalate), poly(ethylene naphthalate), polyamide, aramid, fluororesin, polyesters, or the like are preferably used. The surface protective layer can be formed by the step of dispersing the light scattering particles set forth above in an organic solvent solution containing the resin material (binder resin) to prepare a dispersion solution, coating the dispersion solution on the fluorescent substance layer directly (or via an optionally provided auxiliary layer), and then drying the coated solution.

By other way, the surface protective sheets prepared separately can be overlaid on the fluorescent substance layer by means of an adhesive agent. The thickness of the surface protective layer is usually in a range of from 2 μm to 12 μm, and more preferably from 3.5 μm to 10 μm.

In addition, in respect with the preferred producting methods and the materials used for the process of the radiographic intensifying screen, references can be made to various publications, for example, JP-A No. 9-21899 (page 6, line 47 on left column to page 8, line 5 on left column), JP-A No. 6-347598 (page 2, line 17 on right column to page 3, line 33 on left column) and (page 3, line 42 on left column to page 4, line 22 on left column).

In the fluorescent intensifying sheets used for the present invention, the fluorescent substance is preferably packed in a particle size graded structure. Especially, the fluorescent substance particles having a large particle size are preferably coated at the side of the surface protective layer and fluorescent substance particles having a small particle size are preferably coated at the side of the support. The small particle size of fluorescent substance is preferably in the range from 0.5 μm to 2.0 μm, and the large size is preferably in the range from 10 μm to 30 μm.

(Single-sided Type Photothermographic Material)

The single-sided type photothermographic material of the present invention is favorably applied for an X-ray photosensitive material used for mammography.

To use the single-sided type photothermographic material for that purpose, it is very important to design the gradation of the obtained image in a suitable range.

Concerning the preferable constitution for a photosensitive material used for mammography, reference can be made to JP-A Nos. 5-45807, 10-62881, 10-54900, 11-109564.

(Combined Use with Ultraviolet Fluorescent Intensifying Screen)

Concerning the image forming method using the black and white photothermographic material according to the present invention, it is preferred that the image forming method is performed in combination with a fluorescent substance having a main emission peak at 400 nm or lower. More preferably, the image forming method is performed in combination with a fluorescent substance having a main emission peak at 380 nm or lower. Either single-sided photosensitive material or double-sided photosensitive material can be applied for the assembly. As the screen having a main emission peak at 400 nm or lower, the screens described in JP-A No. 6-11804 and WO No. 93/01521 are used, but the present invention is not limited to these. As the techniques of crossover cut (for double-sided photosensitive material) and anti-halation (for single-sided photosensitive material) of ultraviolet light, the technique described in JP-A No. 8-76307 can be applied. As an ultraviolet absorbing dye, the dye described in JP-A No. 2001-144030 is particularly preferable.

3-2. Thermal Development

Although any method may be used for the development of the black and white photothermographic material of the invention, the thermal developing process is usually performed by elevating the temperature of the black and white photothermographic material exposed imagewise. The temperature for the development is preferably in a range from 90° C. to 180° C., and more preferably, from 100° C. to 140° C.

Time period for development is preferably in a range from 1 second to 60 seconds, more preferably from 5 second to 30 seconds, and particularly preferably from 5 seconds to 20 seconds.

Concerning the process for thermal development, a plate type heater process is preferred. A preferable process for thermal development by a plate type heater is a process described in JP-A No. 11-133572, which discloses a thermal developing apparatus in which a visible image is obtained by bringing a black and white photothermographic material with a formed latent image into contact with a heating means at a thermal developing section, wherein the heating means comprises a plate heater, and a plurality of pressing rollers are oppositely provided along one surface of the plate heater, the thermal developing apparatus is characterized in that thermal development is performed by passing the photothermographic material between the pressing rollers and the plate heater. It is preferred that the plate heater is divided into 2 to 6 steps, with the leading end having a lower temperature by about 1° C. to 10° C.

Such a process is also described in JP-A No. 54-30032, which allows for passage of moisture and organic solvents included in the black and white photothermographic material out of the system, and also allows for suppressing the change of shapes of the support of the black and white photothermographic material upon rapid heating of the black and white photothermographic material.

3-3. System

Examples of a medical laser imager equipped with an exposing portion and a thermal developing portion include Fuji Medical Dry Laser Imager FM-DPL. In connection with the system, description is found in Fuji Medical Review No. 8, pages 39 to 55. The described techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

4. Application of the Invention

The black and white photothermographic material and the image forming method of the invention are preferably employed as photothermographic materials for use in medical diagnosis, photothermographic materials for use in industrial photographs, photothermographic materials for use in graphic arts, as well as photothermographic materials for COM and image forming methods using the same.

The present invention is specifically explained by way of Examples below, which should not be construed as limiting the invention thereto.

EXAMPLES

Example 1

1. Preparation of PET Support and Undercoating 1-1. Film Manufacturing

PET having IV (intrinsic viscosity) of 0.66 (measured in phenol/tetrachloroethane=6/4 (weight ratio) at 25° C.) was obtained according to a conventional manner using terephthalic acid and ethylene glycol. The product was pelletized, dried at 130° C. for 4 hours, and colored blue with the blue dye (1,4-bis(2,6-diethylanilinoanthraquinone). Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

1-2. Surface Corona Discharge Treatment

Both surfaces of the support were treated at room temperature at 20 m/minute using Solid State Corona Discharge Treatment Machine Model 6 KVA manufactured by Piller GmbH. It was proven that treatment of 0.375 KV·A·minute·m$^{-2}$ was executed, judging from the readings of current and voltage on that occasion. The frequency upon this treatment was 9.6 kHz, and the gap clearance between the electrode and dielectric roll was 1.6 mm.

1-3. Undercoating

1) Preparations of Coating Solution for Undercoat Layer Formula (1) (for Undercoat Layer on the Image Forming Layer Side)

1) Preparation of Coating Solution for Undercoat Layer

| | |
|---|---|
| Pesresin A520 manufactured by Takamatsu Oil & Fat Co., Ltd. (30% by weight solution) | 46.8 g |
| BAIRONAARU MD1200 manufactured by Toyo Boseki Co., Ltd. | 10.4 g |
| Polyethylene glycol monononylphenylether (average ethylene oxide number = 8.5) 1% by weight solution | 11.0 g |
| MP1000 manufactured by Soken Chemical & Engineering Co., Ltd. (PMMA polymer fine particle, mean particle diameter of 0.4 μm) | 0.91 g |
| distilled water | 931 mL |

2) Undercoating

Both surfaces of the aforementioned biaxially tentered polyethylene terephthalate support having the thickness of 175 μm were subjected to the corona discharge treatment as described above. Thereafter, the aforementioned formula (1) of coating solution for the undercoat was coated with a wire bar so that the amount of wet coating became 6.6 mL/m$^2$ (per one side), and dried at 180° C. for 5 minutes. Thus, an undercoated support was produced.

2. Image Forming Layer, Intermediate Layer, and Surface Protective Layer 2-1. Preparations of Coating Material 1) Preparation of Photosensitive Silver Halide Emulsion <Preparation of Photosensitive Silver Halide Emulsion>

95 mL of a 1% by weight potassium bromide solution, and then 3.5 mL of 0.5 mol/L sulfuric acid and 3.2 g of phthalated gelatin were added to 1500 mL of distilled water. The liquid was kept at 35° C. while stirring in a stainless steel reaction vessel, and thereto were added total amount of: solution A prepared through diluting 2.19 g of silver nitrate by adding distilled water to give the volume of 44.7 mL; and solution B prepared through diluting 2.31 g of potassium bromide and 0.13 g of potassium iodide with distilled water to give the volume of 70 mL, over 55 seconds at a constant flow rate. The temperature of the mixture was elevated to 75° C. and then 100 mL of solution dissolving 25 g of phthalated gelatin was added. Thereafter, a solution C prepared through diluting 75.3 g of silver nitrate by adding distilled water to give the volume of 230 mL and a solution D prepared through diluting 61.18 g of potassium bromide and 8.38 g of potassium iodide with distilled water to give the volume of 300 mL were added. A controlled double jet method was executed through adding total amount of the solution C over 30 minutes at the flow rate which at final stage was 4 times of the start, accompanied by adding the solution D while maintaining the pAg at 8.6.

Potassium hexachloroiridate (III) was added in its entirely to give $1\times10^{-4}$ mol per 1 mol of silver, at 10 minutes post initiation of the addition of the solution C and the solution D.

Moreover, at 5 seconds after completing the addition of the solution C, a potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The above-described silver halide dispersion was kept at 38° C. with stirring, and thereto was added 5 mL of a 0.34% by weight methanol solution of 1,2 -benzisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mol per 1 mol of silver. The resulting dispersion was subjected to the following spectral sensitization.

Grains in thus prepared silver halide emulsion had a mean projected area equivalent diameter of 1.12 μm, a variation coefficient of a projected area equivalent diameter distribution of 17.7%, a mean thickness of 0.074 μm, a variation coefficient of a thickness distribution of 18.3%, and a mean aspect ratio of 15.2. Tabular grains having an aspect ratio of 2 or more occupied 80% or more of the total projected area. The grains were tabular silver iodobromide grains having a mean equivalent spherical diameter of the grains was 0.52 μm and an average iodide content of 9.0 mol.

Sequentially, the obtained emulsion was divided into five parts, and subjected to the following spectral sensitizing process.

<Spectral Sensitizing Process No. 1 (Comparative)>

The above-described emulsion was dissolved at 60° C., and thereto was added a methanol solution of sensitizing dye 1 at $1.5\times10^{-3}$ mol per 1 mol of silver, followed by ripening for 5 minutes.

<Spectral Sensitizing Process No. 2 (Comparative)>

The above-described emulsion was dissolved at 60° C., and thereto was added a methanol solution of sensitizing dye 1 at $2.34\times10^{-3}$ mol per 1 mol of silver, followed by ripening for 5 minutes.

<Spectral Sensitizing Process No. 3 (Invention)>

The above-described emulsion was dissolved at 60° C., and thereto was added a methanol solution of sensitizing dye 1 at $1.5\times10^{-3}$ mol per 1 mol of silver, followed by ripening for 5 minutes. After cooling the temperature to 40° C., a methanol solution of sensitizing dye 2 was added at $0.41\times10^{-3}$ mol per 1 mol of silver, followed by ripening for 5 minutes. Furthermore, a methanol solution of sensitizing dye 3 was added at $0.41\times10^{-3}$ mol per 1 mol of silver, followed by ripening for 20 minutes.

<Spectral Sensitizing Process No. 4 (Invention)>

The above-described emulsion was dissolved at 60° C., and thereto was added a methanol solution of sensitizing dye 1 at $1.5\times10^{-3}$ mol per 1 mol of silver, followed by ripening for 5 minutes. After cooling the temperature to 40° C., a methanol solution of sensitizing dye 2 was added at $1.42\times10^{-3}$ mol per 1 mol of silver, followed by ripening for 5 minutes. Furthermore, a methanol solution of sensitizing dye 3 was added at $1.40\times10^{-3}$ mol per 1 mol of silver, followed by ripening for 20 minutes.

<Spectral Sensitizing Process No. 5 (Invention)>

The above-described emulsion was dissolved at 60° C., and thereto was added a methanol solution of sensitizing dye 4 at $1.43\times10^{-3}$ mol per 1 mol of silver, followed by ripening for 5 minutes.

Then, the obtained emulsions each were subjected to the following chemical sensitizing process.

At additional 5 minutes later, tellurium sensitizer C in a methanol solution was added at $4.3\times10^{-6}$ mol per 1 mol of silver, followed by ripening for 91 minutes. At 1 minute later, 1.3 mL of a 0.8% by weight methanol solution of N,N'-dihydroxy-N",N"-diethylmelamine was added thereto, and at additional 4 minutes thereafter, 5-methyl-2-mercaptobenzimidazole in a methanol solution at $2.2\times10^{-3}$ mol per 1 mol of silver, 1-phenyl-2-heptyl-5-mercapto-1,3,4-triazole in a methanol solution at $2.2\times10^{-3}$ mol per 1 mol of silver, and 1-(3-methylureidophenyl)-5-mercaptotetrazole in an aqueous solution at $3.1\times10^{-3}$ mol per 1 mol of silver were added.

The silver halide emulsion treated by spectral sensitizing process No. 1, No. 2, No. 3, No. 4, and No. 5 each were expressed as silver halide emulsion No. 1-1, No. 1-2, No. 1-3, No. 1-4, and No. 1-5 respectively.

<Preparations of Emulsion Nos. 1-1 to 1-5 for Coating Solution>

Each of the silver halide emulsion Nos. 1-1 to 1-5 was dissolved and thereto was added benzothiazolium iodide in a 1% by weight aqueous solution at $2\times10^{-3}$ mol per 1 mol of silver.

Further, as "a compound that can be one-electron-oxidized to provide a one-electron oxidation product, which releases one or more electrons", the compounds Nos. 1, 2, and 3 were added respectively in an amount of $5\times10^{-4}$ mol per 1 mol of silver in silver halide.

Thereafter, as "a compound having an adsorptive group and a reducing group", the compound Nos. 1 and 2 were added respectively in an amount of $5\times10^{-4}$ mol per 1 mol of silver halide.

Further, water was added thereto to give the content of silver halide of 15.6 g in terms of silver, per 1 liter of the emulsion for a coating solution.

(Measurement of the Amount of Adsorbed Dye on Silver Halide Grains)

<Measurement of Dye Amount>

The obtained liquid emulsion was subjected to the centrifugal precipitation for 10 minutes at a rotating speed of 4,000 rpm, and then the precipitate was dried by freezing. Thereafter, to 0.02 g of the precipitate were added 25 mL of 10% by weight aqueous solution of sodium thiosulfate, 12.5 mL of DMF, and methanol to give the volume of 50 mL. The obtained solution was analyzed by using a high performance liquid chromatography and thereby the concentration of dyes was quantitatively determined.

The single layer saturated coverage amount of dye on silver halide grains can be determined from the adsorption isotherm curve for individual dye as described in the [Detail Description of Invention] of this specification.

<Measurement of Light Absorption by Microspectroscopy>

The measurement of light absorptivity and light absorption intensity of individual silver halide grains were performed as follows. The obtained emulsion were thinly coated on a slide glass, and the transmission spectrum and the reflection spectrum of individual grains were measured by the following method using a microspectrophotometer MSP 65 produced by Karl Zweiss Co. Ltd., to obtain the absorption spectrum. The area where grains were absent was used as the reference for the transmission spectrum, and a silicon carbide with known reflectance was used as the reference for the reflection spectrum. The measured part was a circular aperture part having a diameter of 0.75 μm. While adjusting the position such that the aperture part did not overlap the contour of a grain, the transmission spectrum and the reflection spectrum were measured in the wavenumber region of from 14000 $cm^{-1}$ (714 nm) to 28000 $cm^{-1}$ (356 nm). From absorptivity A defined by formula (1−T(Transmission)−R(Reflection)), the adsorption spectrum was obtained.

Using absorptivity A' resulting from subtracting the absorption by the silver halide, a light absorption intensity per unit area was obtained by integrating −Log(1−A') with respect to the wavenumber ($cm^{-1}$) and halving the resulting value. The integration range is from 14000 $cm^{-1}$ to 28000 $cm^{-1}$.

At the measurement of light absorption, a tungsten lamp was used as the light source and the light source voltage was 8 V. In order to minimize the damage of the dye by irradiation of light, the monochromator was used in the primary side and the wavelength distance and the slit width were set to 2 nm and 2.5 nm, respectively <Result of Measurement>

Emulsion No. 1-1

The surface coverage of sensitizing dye 1 accounted for 99% of the addition amount, and the amount of adsorbed dye was estimated to be 84% of the single layer saturated coverage amount.

Emulsion No. 1-2

The surface coverage of sensitizing dye 1 accounted for 75% of the addition amount, and the amount of adsorbed dye was estimated to be 99% of the single layer saturated coverage amount.

Emulsion No. 1-3

The surface coverage of sensitizing dye 1, 2, and 3 accounted for 98%, 99%, and 87% respectively of the addition amount. The amount of adsorbed dyes was estimated to be 126% of the single layer saturated coverage amount.

Emulsion No. 1-4

The surface coverage of sensitizing dye 1, 2, and 3 accounted for 98%, 95%, and 85% respectively of the addition amount, and the amount of adsorbed dye was estimated to be 223% of the single layer saturated coverage amount.

Emulsion No. 1-5

The surface coverage of sensitizing dye 4 accounted for 94% of the addition amount, and the amount of adsorbed dye was estimated to be 76% of the single layer saturated coverage amount.

In addition, using the method mentioned above, the measurement of light absorption by a microspectroscopy of silver halide grains selected randomly revealed that no difference in the light absorption intensity per unit area was seen among grains and the sensitizing dyes were adsorbed uniformly on almost all grains.

2) Preparation of Dispersion of Non-Photosensitive Silver Salt

A solution was prepared by dissolving 85 g of lime processed gelatin, 25 g of phthalated gelatin in 2 liters of ion-exchange water in a reaction vessel and stirred well (solution A). A solution containing 185 g of benzotriazole and 1405 mL of ion-exchange water (solution B), and 680 g of 2.5 mol/L sodium hydroxide solution were prepared. The solution of the reaction vessel was adjusted to keep the pAg and pH at 7.25 and 8.0, respectively, if required, by adding solution B and 2.5 mol/L sodium hydroxide solution. And the temperature of the mixture was kept at 36° C.

Solution C containing 228.5 g of silver nitrate and 1222 mL of ion-exchange water was added into the reaction vessel at an accelerated flow rate (flow rate: $16(1+0.002\ t^2)$ mL/min, wherein t represents time expressed in minute). And then solution B was concurrently added to keep the pAg at 7.25. When the addition of solution C was finished, the process was stopped. And then, solution D containing 80 g of phthalated gelatin and 700 mL of ion-exchange water was added thereto at 40° C., while stirring the resulting reaction solution mixture, the pH of the mixture was adjusted at 2.5 by adding 2 mol/L sulfuric acid to aggregate silver salt emulsion.

The aggregates were washed well twice by 5 liters of ion-exchange water. Thereafter the pH and pAg were adjusted to 6.0 and 7.0, respectively, by adding 2.5 mol/L sodium hydroxide solution and solution B to redisperse the aggregates. The obtained silver salt dispersion contained fine crystals of silver salt of benzotriazole.

<Shape of Particles>

The shape of the obtained fine particles of silver salt of benzotriazole was evaluated by an electron microscope. The particles were flake shaped crystals having a mean projected area equivalent diameter of 0.05 μm, a long axis length of 0.2 μm, a short axis length of 0.05 μm, a grain thickness of 0.05 μm, and a variation coefficient of an projected area equivalent diameter distribution between the grains of 21%.

3) Preparation of Hydrogen Bonding Compound-1 Dispersion

To 10 kg of hydrogen bonding compound-1 (tri(4-t-butylphenyl)phosphineoxide) and 16 kg of a 10% by weight aqueous solution of modified poly(vinyl alcohol) (manufactured by Kuraray Co., Ltd., Poval MP203) was added 10 kg of water, and thoroughly mixed to give a slurry.

This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 4 hours. Thereafter, 0.2 g of a benzisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion.

Particles of the hydrogen bonding compound included in the resulting hydrogen bonding compound dispersion had a median diameter of 0.45 μm, and a maximum particle diameter of 1.3 μm or less. The resultant hydrogen bonding compound dispersion was subjected to filtration with a polypropylene filter having a pore size of 3.0 μm to remove foreign substances such as dust, and stored.

4) Preparation of Development Accelerator-1 Dispersion

To 10 kg of development accelerator-1 and 20 kg of a 10% by weight aqueous solution of modified poly(vinyl alcohol) (manufactured by Kuraray Co., Ltd., Poval MP203) was added 10 kg of water, and thoroughly mixed to give a slurry.

This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzisothiazolinone sodium salt and water were added thereto, thereby adjusting the concentration of the development accelerator to be 20% by weight. Accordingly, development accelerator-1 dispersion was obtained.

Particles of the development accelerator included in the resulting development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

Also concerning solid dispersions of development accelerator-2 and color-tone-adjusting agent-1, dispersion was executed similar to the development accelerator-1, and thus dispersions of 20% by weight and 15% by weight were respectively obtained.

5) Preparation of Pigment-1 Dispersion

C.I. Pigment Blue 60 in an amount of 64 g and 6.4 g of DEMOL N manufactured by Kao Corporation were added to 250 g of water and thoroughly mixed to give a slurry. Zirconia beads having the mean particle diameter of 0.5 mm were provided in an amount of 800 g, and charged in a vessel with the slurry. Dispersion was performed with a dispersing machine (1/4G sand grinder mill: manufactured by AIMEX Co., Ltd.) for 25 hours. Thereto was added water to adjust so that the concentration of the pigment became 5% by weight to obtain a pigment-1 dispersion. Particles of the pigment included in the resulting pigment dispersion had a mean particle diameter of 0.21 μm.

6) Preparation of Nucleator Dispersion 2.0 g of poly(vinyl alcohol) (manufactured by Kuraray Co., Ltd., PVA217) and 87.5 g of water are added to 10 g of nucleator No. SH-7, and thoroughly admixed to give a slurry. This slurry is allowed to stand for 3 hours. Zirconia beads having a mean particle diameter of 0.5 mm are provided in an amount of 250 g, and charged in a vessel with the slurry. Dispersion is performed with a dispersing machine (1/4G sand grinder mill: manufactured by AIMEX Co., Ltd.) for 10 hours to obtain a solid fine particle dispersion of nucleator. Particles of the nucleator included in the resulting nucleator dispersion have a mean particle diameter of 0.45 μm, and 80% by weight of the particles has a particle diameter of 0.10 μm to 1.0 μm.

7) Preparation of Toner Dispersion

The dispersions of compound Nos. T-59 and T-3 used for toner dispersions were prepared as follows.

4 g of triazole compound No. T-59 (5-hydroxymethyl-4-benzyl-1,2,4-triazole-3-thiol), 10% by weight of poly(vinyl pyrrolidone) solution and 18 mL of ion-exchange water were thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours.

15 g of 30% by weight lime-processed gelatin was added to the above dispersion and the mixture was heated to 50° C. to obtain fine particle dispersion of mercaptotriazole T-59.

Dispersion of triazole compound No. T-3 (4-benzyl-1,2,4-triazole-3-thiol) was prepared in a similar manner.

8) Preparations of Various Solutions

<Preparation of Reducing Agent Solution>

A 10% by weight aqueous solution of ascorbic acid was prepared.

<Preparations of Aqueous Solution of Mercapto Compound>

Mercapto compound-1 (1-(3-sulfophenyl)-5-mercaptotetrazole sodium salt) in an amount of 7 g was dissolved in 993 g of water to give a 0.7% by weight aqueous solution.

Mercapto compound-2 (1-(3-methylureidophenyl)-5-mercaptotetrazole) in an amount of 20 g was dissolved in 980 g of water to give a 2.0% by weight aqueous solution.

<Preparations of Thermal Solvent Solution>

A 5% by weight aquous solution of 1,3-dimethylurea and a 10% by weight aquous solution of succinimide were prepared.

2-2. Preparations of Coating Solution

1) Preparations of Coating Solution for Image Forming Layer-1 to -5

To the dispersion of non-photosensitive silver salt obtained as described above in an amount of 1000 g were serially added the aqueous solution of gelatin, the pigment-1 dispersion, the hydrogen bonding compound-1 dispersion, the development accelerator-1 dispersion, the development accelerator-2 dispersion, the color-tone-adjusting agent-1 dispersion, the reducing agent solution, the toner dispersion, the mercapto compound-1 aqueous solution, the mercapto compound-2 aqueous solution, the thermal solvent aqueous solutions, and the nucleator dispersion. The silver halide emulsion Nos. 1-1 to 1-5 for coating solution was added thereto just prior to the coating.

2) Preparation of Coating Solution for Intermediate Layer

To 772 g of a 10% by weight aqueous solution of poly(vinyl alcohol) PVA-205 (manufactured by Kuraray Co., Ltd.), 5.3 g of pigment-1 dispersion, and 226 g of a 27.5% by weight solution of methyl methacrylate/styrene/butyl acrylate/hydroxyethyl methacrylate/acrylic acid copolymer (weight ratio of the copolymerization of 64/9/20/5/2) latex, were added 2 mL of a 5% by weight aqueous solution of aerosol OT (manufactured by American Cyanamid Co.), 10.5 mL of a 20% by weight aqueous solution of ammonium secondary phthalate and water to give total amount of 880 g. The mixture was adjusted with sodium hydroxide to give the pH of 7.5. Accordingly, the coating solution for the intermediate layer was prepared, and was fed to a coating die to provide 10 mL/m 3) Preparation of Coating Solution for First Layer of Surface Protective Layers In water was dissolved 64 g of inert gelatin, and thereto were added 80 g of a 27.5% by weight solution of methyl methacrylate/styrene/butyl acrylate/hydroxyethyl methacrylate/acrylic acid copolymer (weight ratio of the copolymerization of 64/9/20/5/2) latex, 23 mL of a 10% by weight methanol solution of phthalic acid, 23 mL of a 10% by weight aqueous solution of 4-metyl phthalic acid, 28 mL of 0.5 mol/L sulfuric acid, 5 mL of a 5% by weight aqueous solution of aerosol OT, 0.5 g of phenoxyethyl alcohol, and 0.1 g of benzisothiazolinone. Water was added to give total amount of 750 g. Immediately before coating, 26 mL of a 4% by weight chrome alum which had been mixed with a static mixer was fed to a coating die so that the amount of the coating solution became 18.6 mL/m 4) Preparation of Coating Solution for Second Layer of Surface Protective Layers In water was dissolved 80 g of inert gelatin and thereto were added 102 g of a 27.5% by weight solution of methyl methacrylate/styrene/butyl acrylate/hydroxyethyl methacrylate/acrylic acid copolymer (weight ratio of the copolymerization of 64/9/20/5/2) latex, 3.2 mL of a 5% by weight solution of a fluorocarbon surfactant (F-1), 32 mL of a 2% by weight aqueous solution of another fluorocarbon surfactant (F-2), 23 mL of a 5% by weight aqueous solution of aerosol OT, 4 g of polymethyl methacrylate fine particles (mean particle diameter of 0.7 μm), 21 g of polymethyl methacrylate fine particles (mean particle diameter of 4.5 μm), 1.6 g of 4-methyl phthalic acid, 4.8 g of phthalic acid, 44 mL of 0.5 mol/L sulfuric acid, and 10 mg of benzisothiazolinone. Water was added to give total amount of 650 g. Immediately before coating, 445 mL of a aqueous solution containing 4% by weight chrome alum and 0.67% by weight phthalic acid were added and admixed with a static mixer to give a coating solution for the second layer of the surface protective layers, which was fed to a coating die so that 8.3 mL/$m^2$ could be provided.

2-3. Coating

On both sides of the support mentioned above, simultaneous coating was subjected in order of the image forming layer, intermediate layer, first layer of the surface protective layers, and second layer of the surface protective layers, and dried. starting from the undercoated face. Thus photothermographic materials were produced. The amount of coated silver was 1.65 g/m per one side, with respect to the sum of silver salt of fatty acid and silver halide. And, the total amount of coated silver in the image forming layers on both sides was 3.3 g/$m^2$.

The coating amount of each compound (g/$m^2$) for the image forming layer per one side is as follows.

| | |
|---|---|
| Non-photosensitive silver salt (on the basis of Ag content) | 0.686 |
| Gelatin | 3.5 |
| Pigment (C.I. Pigment Blue 60) | 0.036 |
| Triazole compound No. T-59 | 0.04 |
| Triazole compound No. T-3 | 0.04 |
| Ascorbic acid | 1.1 |

-continued

| | |
|---|---|
| Hydrogen bonding compound-1 | 0.28 |
| Development accelerator-1 | 0.019 |
| Development accelerator-2 | 0.016 |
| Nucleator No. SH-7 | 0.036 |
| Color-tone-adjusting agent-1 | 0.006 |
| Mercapto compound-1 | 0.001 |
| Mercapto compound-2 | 0.003 |
| Thermal solvent: 1,3-dimethlyurea | 0.24 |
| Thermal solvent: succinimide | 0.08 |
| Silver halide (on the basis of Ag content) | 0.139 |

Chemical structures of the compounds used in Examples of the invention are shown below.

Tellurium sensitizer C

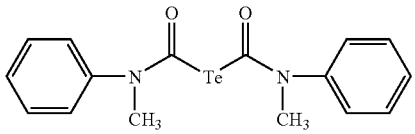

Compound 1 that can be one-electron-oxidized to provide a one-electron oxidation product which releases one or more electrons

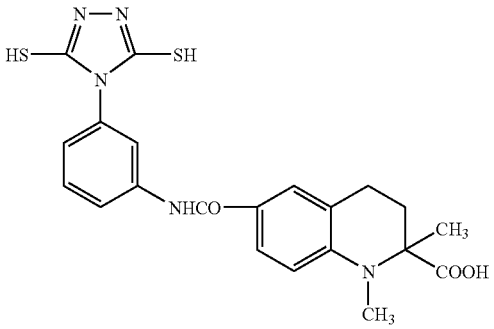

Compound 2 that can be one-electron-oxidized to provide a one-electron oxidation product which releases one or more electrons

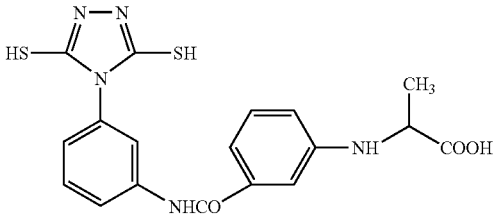

Compound 3 that can be one-electron-oxidized to provide a one-electron oxidation product which releases one or more electrons

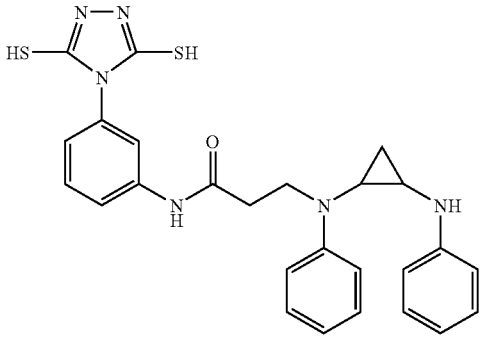

Compound 1 having adsorptive group and reducing group

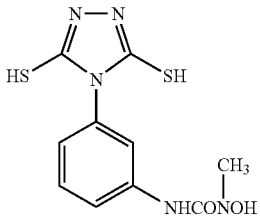

Compound 2 having adsorptive group and reducing group

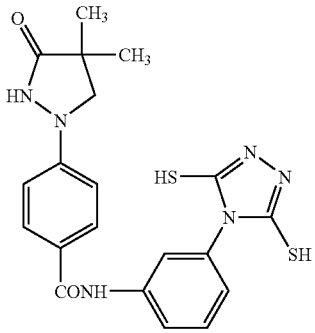

Sensitizing dye 1

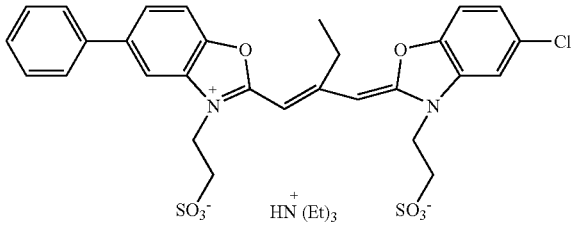

Sensitizing dye 2

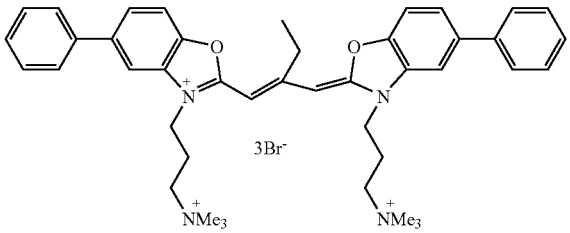

-continued

Sensitizing dye 3

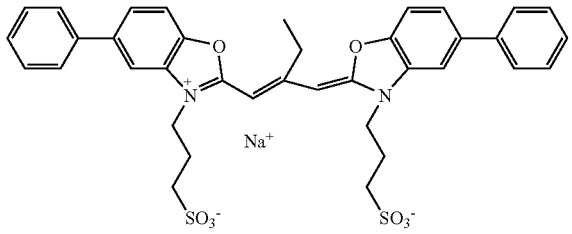

Sensitizing dye 4

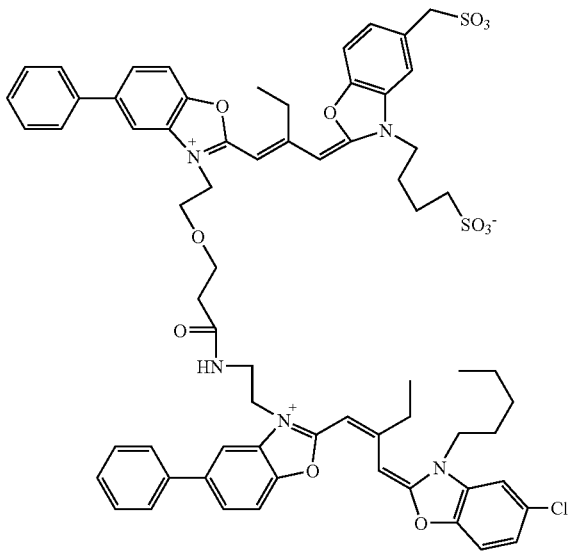

Hydrogen bonding compound-1

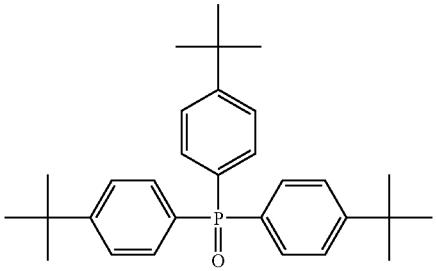

Mercapto compound-1

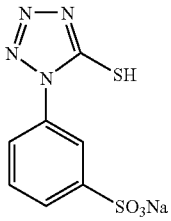

Mercapto compound-2

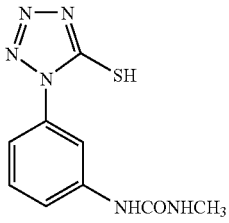

-continued

Development accelerator-1

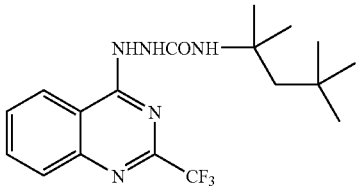

Development accelerator-2

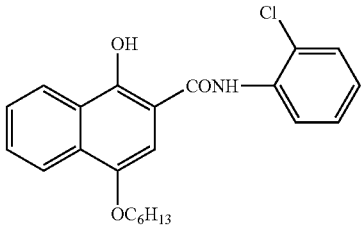

Color-tone-adjusting agent-1

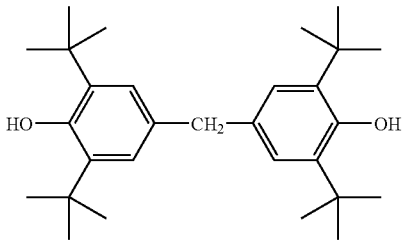

(F-1)

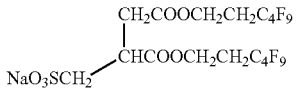

(F-2)

Mixture of 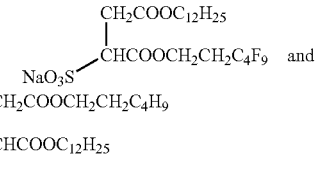 and

3. Evaluation of Photographic Properties 3-1. Preparation

The resulting sample was cut into a half-cut size, and was wrapped with the following packaging material under an environment of 25° C. and 50% RH, and stored for 2 weeks at an ambient temperature.

<Packaging Material>

A film laminated with PET 10 μm/PE 12 μm/aluminum foil 9 μm/Ny 15 μm/polyethylene 50 μm containing carbon at 3% by weight:

oxygen permeability at 25° C.: 0.02 $mL \cdot atm^{-1} m^{-2} day^{-1}$;

vapor permeability at 25° C.: 0.10 $g \cdot atm^{-1} m^{-1} day^{-1}$.

3-2. Condition for Evaluation

Two sheets of X-ray orthochomatic screen HG-M produced by Fuji Photo Film Co., Ltd. were used. The assembly for image formation was provided by inserting the Sample Nos. 1 to 5 between them.

This assembly was subjected to X-ray exposure for 0.05 seconds, and then X-ray sensitometry is performed. The X-ray apparatus used was DRX-3724HD (trade name) produced by Toshiba Corp., and a tungsten target tube was used.

X-ray emitted by a pulse generator operated at three phase voltage of 80 kVp and penetrated through a filter comprising 7 cm thickness of water having the absorption ability almost the same as human body was used as the light source. By the method of distance, varying the exposure value of X-ray, the sample was subjected to exposure with a step wedge tablet having a width of 0.15 in terms of log E. After exposure, the samples were thermally developed under the following thermal developing process condition. Evaluation on an obtained image was performed with a densitometer.

The thermal developing section of Fuji Medical Dry Laser Imager FM-DPL was modified so that it can heat from both sides, and by another modification the conveying rollers in the thermal developing section were changed to the heating drum so that the sheet of film could be conveyed. The temperatures of four panel heaters were set to 112° C.-118° C.-120° C.-120° C., and the temperature of the heating drum was set to 120° C. By increasing the speed of transportation, the total time period for thermal development was set to be 14 seconds.

2) Terms for Evaluation (Photographic Properties)

Fog: A density of an unexposed portion is expressed as fog.

Sensitivity: Sensitivity is the reciprocal of the exposure value giving an image density of fog+1.0. The sensitivities are shown in relative value, detecting the sensitivity of Sample No. 1 to be 100.

Average gradient: Average gradient is expressed as a gradient of a straight line connecting the points at fog+0.5 and fog+2.0 on the photographic characteristic curve.

Color tone of developed silver images: Color tone of developed silver images was evaluated by visual observation according to the following three criteria:

○: cold black tone, preferable level for practical use in medical diagnosis.

Δ: slightly cold black tone, but acceptable level for practical use in medical diagnosis.

X: Yellowish and warm tone, and unpreferable level for practical use in medical diagnosis.

(Degree of Dependence on Humidity of Thermal Development)

The obtained samples were each subjected to packaging, exposure, and development under an environment of 25° C. and 10 RH %, and then fog and sensitivity were measured which were represented by fog(10) and S(10) respectively. And, fog and sensitivity measured under an environment of 25° C. and 80RH % were represented by fog(80) and S(80) respectively. The absolute value of (fog(10)−fog(80)) was represented by Δ fog and the absolute value of (S(10)−S(80)) was represented by ΔS. The smaller ΔFog and ΔS are, the smaller are the variations in photographic properties due to changes in environmental conditions and it is more preferred.

3-3. Results of Evaluation

The obtained results are shown in Table 2.

From the results shown in Table 2, it is revealed that Sample Nos. 3 to 5 exhibit excellent results in fog and sensitivity compared with Sample Nos. 1 to 2 where dyes are adsorbed in monolayer. Further, it is seen that the variations in fog and sensitivity due to humidity change of thermal development are improved by the use of multilayered-adsorbed dye. In particular, the performance difference between Sample No. 2 and Sample No. 3, both of which have the same addition amount of dye, is so large. The effect of the present invention is remarkable.

TABLE 1

| Sample No. | Silver Halide Emulsion No. | Addition Amount of Sensitizing Dye 1 ($\times 10^{-3}$ mol/mol Ag) | Addition Amount of Sensitizing Dye 2 ($\times 10^{-3}$ mol/mol Ag) | Addition Amount of Sensitizing Dye 3 ($\times 10^{-3}$ mol/mol Ag) | Addition Amount of Sensitizing Dye 4 ($\times 10^{-3}$ mol/mol Ag) | Total Addition Amount of Sensitizing Dyes ($\times 10^{-3}$ mol/mol Ag) | Ratio of Saturated Coverage Amount (%) | Note |
|---|---|---|---|---|---|---|---|---|
| 1 | A-1 | 1.50 | — | — | — | 1.50 | 84 | Comparative |
| 2 | A-2 | 2.34 | — | — | — | 2.34 | 99 | Comparative |
| 3 | A-3 | 1.50 | 0.41 | 0.41 | — | 2.32 | 126 | Invention |
| 4 | A-4 | 1.50 | 1.42 | 1.40 | — | 4.32 | 223 | Invention |
| 5 | A-5 | — | — | — | 1.43 | 1.43 | 76 | Invention |

TABLE 2

| Sample | Photographic Properties | | | | Degree of Dependence on Humidity of Thermal Development | | |
|---|---|---|---|---|---|---|---|
| No. | Fog | Sensitivity | Gradation (γ) | Color Tone of Developed Silver Images | Δfog | ΔS | Note |
| 1 | 0.24 | 100 | 1.2 | x | 0.17 | 21 | Comparative |
| 2 | 0.22 | 75 | 0.6 | x | 0.15 | 33 | Comparative |
| 3 | 0.15 | 145 | 1.8 | Δ | 0.07 | 6 | Invention |
| 4 | 0.12 | 240 | 2.3 | ○ | 0.05 | 3 | Invention |
| 5 | 0.16 | 150 | 1.7 | ○ | 0.09 | 15 | Invention |

Example 2

1. Preparation of Photosensitive Silver Halide Emulsion 1-1. Formations of Emulsion Grain <Preparation of Photosensitive Silver Halide Emulsion No. 2-1 (Silver Iodide-rich Emulsion No. 1)>

10.1 mL of 1% by weight potassium iodide solution, and then 3.5 mL of 0.5 mol/L sulfuric acid, 6.3 g of phthalated gelatin, and 150 mL of 5% by weight methanol solution of 2,2'-(ethylenedithio)diethanol were added to 1452 mL of distilled water. The solution was kept at 75° C. while stirring in a stainless steel reaction vessel, and thereto were added total amount of: solution A prepared through diluting 23.0 g of silver nitrate by adding distilled water to give the volume of 750 mL; and solution B prepared through diluting 36.6 g of potassium iodide and 0.81 g of potassium bromide with distilled water to give the volume of 750 mL. A controlled double jet method was executed through adding total amount of the solution A over 15 minutes at a constant flow rate, accompanied by adding the solution B while maintaining the pAg at 10.8.

Thereafter, 10.8 mL of a 10% by weight aqueous solution of benzimidazole was added. And then, the entire amount of solution C prepared through diluting 53 g of silver nitrate by adding distilled water to give the volume of 250 mL and solution D prepared through diluting 80 g of potassium iodide and 1.99 g of potassium bromide with distilled water to give the volume of 830 mL were added. A method of controlled double jet was executed through adding total amount of the solution C at a constant flow rate over 60 minutes, accompanied by adding the solution D while maintaining the pAg at 10.8. Thereafter, 200 mL of a 3.5% by weight aqueous solution of hydrogen peroxide was added and stirred for 20 minutes. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

The obtained silver halide host emulsion was silver iodobromide emulsion having a silver iodide content of 98%. Grains in the emulsion had a mean projected area equivalent diameter of 1.11 μm, a variation coefficient of a projected area equivalent diameter distribution of 18.2%, a mean thickness of 0.072 μm, a variation coefficient of a thickness distribution of 17.2%, and a mean aspect ratio of 15.5. Tabular grains having an aspect ratio of 2 or more occupied 80% or more of the total projected area. A mean equivalent spherical diameter of the grains was 0.51 μm. 70% or more of the silver iodide existed in γ phase from the result of powder X-ray diffraction analysis.

1300 g of an aqueous solution prepared by mixing 0.39 mol of the above silver iodide-rich emulsion, 20 g of phthalated gelatin, and 0.035 mol of sodium hydroxide was heated at 40° C. 350 mL of solution E containing 5.18 g of silver nitrate and 500 mL of solution F containing 7.46 g of potassium bromide were added thereto. A method of controlled double jet was executed through adding total amount of the solution E at a constant flow rate over 22 minutes, accompanied by adding the solution F while maintaining the pAg at 7.5. Potassium hexachloroiridate (III) was added in its entirety to give $1\times10^{-4}$ mol per 1 mol of silver, at 5 minutes post initiation of the addition of the solution E and the solution F. Moreover, at 5 seconds after completing the addition of the solution E, potassium hexacyanoferrate (II) in an aqueous solution was added in its entirety to give $2\times10^{-4}$ mol per 1 mol of silver. And after that, 200 mL of a 3.5% by weight aqueous solution of hydrogen peroxide was added and then stirred for 20 minutes. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.7.

The above-mentioned silver halide dispersion was kept at 38° C. with stirring, and thereto was added 5 mL of a 0.34% by weight methanol solution of 1,2-benzisothiazoline-3-one, and after 40 minutes the temperature was elevated to 47° C. At 20 minutes after elevating the temperature, sodium benzene thiosulfonate in a methanol solution was added at $5.6\times10^{-5}$ mol per 1 mol of silver.

Grains in the obtained emulsion were tabular grains having a silver bromide content of 9 mol % and having epitaxy on the corner and edge portions thereof.

<Preparation of Photosensitive Silver Halide Emulsion Nos. 2-2 and 2-3 (Preparation of Silver Iodide-Rich Emulsion No. 2 and Silver Iodide-rich Emulsion No. 3)>

Silver iodide-rich emulsion No. 2 having a silver iodide content of 85 mol % and silver iodide-rich emulsion No. 3 having a silver iodide content of 55 mol % were prepared in a similar manner to the process in the preparation of silver iodide-rich emulsion No. 1 except that the amounts of potassium iodide and potassium bromide in the solution B and solution D were each adjusted. At that time, the temperature of grain growth, the pAg and the addition speeds of silver nitrate and halogen ion were adjusted that the form of the grain would be close to that of the host silver iodide-rich emulsion No. 1.

<Preparation of Photosensitive Silver Halide Emulsion No. 2-4 (Preparation of Silver Iodide-rich Emulsion No. 4)>

Silver iodide-rich emulsion No. 4 was prepared in a simlar manner to the process in the preparation of silver iodide-rich emulsion No. 1 except that the temperature of grain growth and the pAg were changed. The host grains obtained on the way had a mean projected area equivalent diameter of 0.68 μm, a variation coefficient of a projected area equivalent diameter distribution of 16.2%, a mean thickness of 0.193 μm, a variation coefficient of a thickness distribution of 14.2%, and a mean aspect ratio of 3.5. Tabular grains having an aspect ratio of 2 or more occupied 80% or more of the total projected area. A mean equivalent spherical diameter of the grains was 0.51 μm.

1-2. Spectral Sensitization

Sequentially, the obtained emulsions were subjected to the following spectral sensitizing process.

<Spectral Sensitizing Process No. 11>

The above emulsion No. 2-1 was dissolved at 60° C., and thereto was added sensitizing dye 5 at $2.3\times10^{-3}$ mol per 1 mol of silver, followed by ripening for 5 minutes.

<Spectral Sensitizing Process No. 12>

The above emulsion No. 2-1 was dissolved at 60° C., and thereto was added sensitizing dye 5 at $3.6\times10^{-3}$ mol per 1 mol of silver, followed by ripening for 5 minutes.

<Spectral Sensitizing Process No. 13>

The above emulsion Nos. 2-1 to 2-3 were dissolved at 60° C., and thereto was added sensitizing dye 5 at $2.3\times10^{-3}$ mol per 1 mol of silver, followed by ripening for 5 minutes. After cooling the temperature to 40° C., sensitizing dye 6 was added at $0.63\times10^{-3}$ mol per 1 mol of silver, followed by ripening for 5 minutes. Furthermore, sensitizing dye 5 was added at $0.63\times10^{-3}$ mol per 1 mol of silver, followed by ripening for 20 minutes.

<Spectral Sensitizing Process No. 14>

The above emulsion No. 2-1 was dissolved at 60° C., and thereto was added sensitizing dye 5 at $2.3\times10^{-3}$ mol per 1 mol of silver, followed by ripening for 5 minutes. After cooling the temperature to 40° C., sensitizing dye 6 was added at $2.17\times10^{-3}$ mol per 1 mol of silver, followed by ripening for 5 minutes. Furthermore, sensitizing dye 5 was added at $2.15\times10^{-3}$ mol per 1 mol of silver, followed by ripening for 20 minutes.

<Spectral Sensitizing Process No. 15>

The above emulsion No. 2-4 was dissolved at 60° C., and thereto was added sensitizing dye 5 at $1.2\times10^{-3}$ mol per 1 mol of silver, followed by ripening for 5 minutes. After cooling the temperature to 40° C., sensitizing dye 6 was added at $0.33\times10^{-3}$ mol per 1 mol of silver, followed by ripening for 5 minutes. Furthermore, sensitizing dye 5 was added at $0.33\times10^{-3}$ mol per 1 mol of silver, followed by ripening for 20 minutes.

Sensitizing dye 5

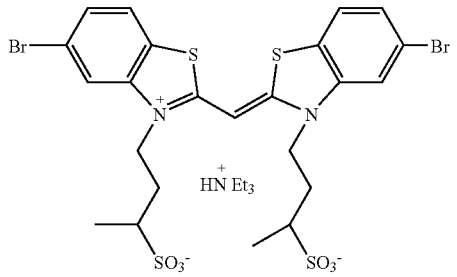

Sensitizing dye 6

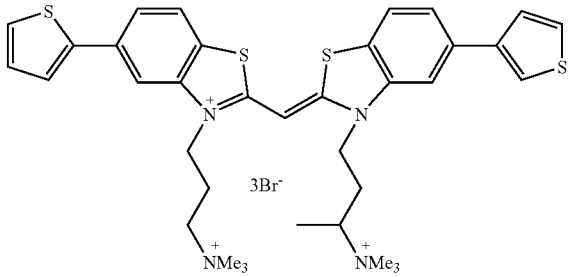

The silver halide emulsion treated by spectral sensitizing process No. 11 is expressed as silver halide emulsion No. B-1, the silver halide emulsion treated by spectral sensitizing process No. 12 is expressed as silver halide emulsion No. B-2, the silver halide emulsions treated by spectral sensitizing process No. 13 are expressed as silver halide emulsion Nos. B-3-1, B-3-2, and B-3-3, the silver halide emulsion treated by spectral sensitizing process No. 14 is expressed as silver halide emulsion No. B-4, and the silver halide emulsion treated by spectral sensitizing process No. 15 is expressed as silver halide emulsion No. B-5.

1-3. Chemical Sensitization

At additional 5 minutes later, tellurium sensitizer C in a methanol solution was added at $2.0\times10^{-3}$ mol per 1 mol of silver to each emulsion, followed by ripening for 91 minutes. And then, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureido phenyl)-5-mercaptotetrazole in an aqueous solution at $8.5\times10^{-3}$ mol per 1 mol of silver were added.

1-4. Preparations of Emulsion for Coating Solution

The above-described silver halide emulsion was dissolved and thereto was added benzothiazolium iodide in a 1% by weight aqueous solution at $7\times10^{-3}$ mol per 1 mol of silver. Further, as "a compound that can be one-electron-oxidized to provide a one-electron oxidation product, which releases one or more electrons", the compounds Nos. 1, 2, and 3 were added respectively in an amount of $2\times10^{-3}$ mol per 1 mol of silver in silver halide.

Thereafter, as "a compound having an adsorptive group and a reducing group", the compound Nos. 1 and 2 were added respectively in an amount of $8\times10^{-3}$ mol per 1 mol of silver halide.

Further, water was added thereto to give the content of silver halide of 15.6 g in terms of silver, per 1 liter of the emulsion for a coating solution.

1-5. Measurement of the Amount of Adsorbed Dye on Silver Halide Grains

It was done similar to Example 1. Results of the measurement are shown in Table 3.

2. Preparation of Coated Sample

Similar to Example 1, to the dispersion of non-photosensitive silver salt in an amount of 1000 g were serially added the aqueous solution of gelatin, the pigment-1 dispersion, the silver iodide complex-forming agent solution described below, the hydrogen bonding compound-1 dispersion, the development accelerator-1 dispersion, the development accelerator-2 dispersion, the color-tone-adjusting agent-1 dispersion, the reducing agent solution, the toner dispersion, the mercapto compound-1 aqueous solution, the mercapto compound-2 aqueous solution, the thermal solvent aqueous solutions, and the nucleator dispersion. The emulsion for coating solution was added thereto just prior to the coating.

Double-sided type photothermographic materials were prepared similar to Example 1. Corresponding to silver halide emulsion Nos. B-1 to B-5, samples are expressed as Sample Nos. 11 to 17.

<Preparation of Silver Iodide Complex-forming Agent Solution>

8 kg of modified poly(vinyl alcohol) MP203 was dissolved in 175 kg of water, and thereto were added 3.2 kg of a 20% by weight aqueous solution of sodium triisopropylnaphthalenesulfonate and 14.28 kg of a 70% by weight aqueous solution of compound No. 22 as a silver iodide complex-forming agent. Accordingly, a 5% by weight solution of silver iodide complex-forming agent was prepared.

The coating amount of each compound (g/m$^2$) for the image forming layer per one side is as follows.

| | |
|---|---|
| Non-photosensitive silver salt (on the basis of Ag content) | 0.686 |
| Gelatin | 3.5 |
| Pigment (C.I. Pigment Blue 60) | 0.036 |
| Triazole compound No. T-59 | 0.04 |
| Triazole compound No. T-3 | 0.04 |
| Silver iodide complex-forming agent | 0.46 |
| Ascorbic acid | 1.1 |
| Nucleator No. SH-7 | 0.036 |
| Hydrogen bonding compound-1 | 0.15 |
| Development accelerator-1 | 0.005 |
| Development accelerator-2 | 0.035 |
| Color-tone-adjusting agent-1 | 0.002 |
| Mercapto compound-1 | 0.001 |
| Mercapto compound-2 | 0.003 |
| Thermal solvent: 1,3-dimethlyurea | 0.24 |
| Thermal solvent: succinimide | 0.08 |
| Silver halide (on the basis of Ag content) | 0.175 |

3. Evaluation

Evaluation was performed similar to Example 1, except that the fluorescent intensifying screens were changed from HGM screen to X-ray regular screen H1-SCREEN-B3 produced by Fuji Photo Film Co., Ltd. Results are shown in Table 4. Sensitivities are shown in relative value, detecting the sensitivity of Sample No. 11 to be 100.

TABLE 3

| Sample No. | Silver Halide Emulsion No. | Average Content of AgI | Aspect Ratio | Addition Amount of Sensitizing Dye 5 ($\times 10^{-3}$ mol/mol Ag) | Addition Amount of Sensitizing Dye 6 ($\times 10^{-3}$ mol/mol Ag) | Total Addition Amount of Sensitizing Dyes ($\times 10^{-3}$ mol/mol Ag) | Ratio of Saturated Coverage Amount (%) | Note |
|---|---|---|---|---|---|---|---|---|
| 11 | B-1 | 91 | 15.5 | 2.30 | — | 2.30 | 88 | Comparative |
| 12 | B-2 | 91 | 15.5 | 3.59 | — | 3.59 | 99 | Comparative |
| 13 | B-3-1 | 91 | 15.5 | 2.93 | 0.63 | 3.56 | 130 | Invention |
| 14 | B-3-2 | 85 | 15.3 | 2.93 | 0.63 | 3.56 | 135 | Invention |
| 15 | B-3-3 | 55 | 15.7 | 2.93 | 0.63 | 3.56 | 145 | Invention |
| 16 | B-4 | 91 | 15.5 | 4.45 | 2.17 | 6.62 | 232 | Invention |
| 17 | B-5 | 91 | 3.5 | 1.53 | 0.33 | 1.86 | 128 | Invention |

TABLE 4

| Sample No. | Photographic Properties: Fog | Sensitivity | Gradation (γ) | Color Tone of Developed Silver Images | Degree of Dependence on Humidity of Development: Δfog | ΔS | Note |
|---|---|---|---|---|---|---|---|
| 11 | 0.18 | 100 | 1.20 | x | 0.17 | 21 | Comparative |
| 12 | 0.12 | 77 | 0.60 | x | 0.15 | 33 | Comparative |
| 13 | 0.15 | 115 | 1.85 | Δ | 0.07 | 6 | Invention |
| 14 | 0.17 | 112 | 1.95 | Δ | 0.08 | 8 | Invention |
| 15 | 0.18 | 110 | 2.02 | Δ | 0.10 | 10 | Invention |
| 16 | 0.12 | 125 | 2.33 | ○ | 0.05 | 3 | Invention |
| 17 | 0.15 | 98 | 1.95 | Δ | 0.12 | 14 | Invention |

Similar to Example 1, also in the case of using silver iodide-rich silver halide, the effect of the present invention becomes remarkable by the multilayered adsorption of dye. Further, in the case where the content of silver iodide is increased, the higher is the aspect ratio, the more remarkable is the effect of the present invention exhibited.

Example 3

The gelatin used for water-soluble binder of the image forming layer in Example 2 was changed to SBR latex. The SBR latex was prepared according to the following.

<Preparation of SBR Latex Solution>

To a polymerization tank of a gas monomer reaction apparatus (manufactured by Taiatsu Techno Corporation, TAS-2J type), were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature is elevated to 60° C.

Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ratio of $Na^+$ ion: $NH_4^+$ ion=1:5.3, and thus, the pH of the mixture was adjusted to 8.4.

Thereafter, filtration with a polypropylene filter having the pore size of 1.0 μm was conducted to remove foreign substances such as dust followed by storage. Accordingly, SBR latex was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., solid matter concentration of 44% by weight, the equilibrium moisture content at 25° C. and 60% RH of 0.6% by weight, ionic conductance of 4.80 mS/cm (measurement of the ionic conductance performed using a conductivity meter CM-30S manufactured by To a Electronics Ltd. for the latex stock solution (44% by weight) at 25° C.) and pH of 8.4.

Photothermographic materials were prepared similar to Example 2, except that using the above-described SBR latex as a binder of the image forming layer. The samples were evaluated similar to Example 2. Similar to Example 2, the photothermographic materials of the present invention have low fog and high sensitivity, excellent gradation suitable for medical diagnosis, and preferable color tone of developed silver images. Further, the photothermographic materials of the present invention have stable fog and sensitivity with respect to the change in environmental humidity.

Example 4

1. Preparation of Fluorescent Intensifying Screen A (1) Undercoating

A light reflecting layer comprising alumina powder was coated on a polyethylene terephthalate film (support) having a thickness of 250 μm in a similar manner to the Example 4 in JP-A. No. 2001-124898. The light reflecting layer which had a film thickness of 50 μm after drying, was prepared.

(2) Preparation of Fluorescent Substance Sheet 250 g of BaFBr:Eu fluorescent substance (mean particle size of 3.5 μm), 8 g of polyurethane type binder resin (manufactured by Dai Nippon Ink & Chemicals, Inc., trade name: PANDEX T5265M), 2 g of epoxy type binder resin (manufactured by Yuka Shell Epoxy Co., Ltd., trade name: EPIKOTE 1001) and 0.5 g of isocyanate compounds (manufactured by Nippon Polyurethane Industry Co., Ltd., trade name: CORONATE HX) were added into methylethylketone, and the mixture was then dispersed by a propeller mixer to prepare the coating solution for the fluorescent substance layer having a viscosity of 25 PS (25° C.). This coating solution was coated on the surface of a temporary support (pretreated by coating a silicone agent on the surface of polyethylene terephthalate film), and dried to make the fluorescent substance layer. Thereafter, the fluorescent substance sheet was prepared by peeling the fluorescent substance layer from the temporary support.

(3) Overlaying the Fluorescent Substance Sheet on Light Reflective Layer.

The fluorescent substance sheet prepared above was overlaid on the surface of the light reflective layer of the support having a light reflective layer made in the above process (1), and then pressed by a calendar roller at the pressure of 400 kgw/cm$^2$ and the temperature of 80° C. to form the fluorescent substance layer on the light reflective layer. The thickness of the obtained fluorescent substance layer was 125 μm and the volume filling factor of fluorescent substance particles in the fluorescent substance layer was 68%.

(4) Preparation of Surface Protective Layer

Polyester type adhesive agents were coated on one side of a polyethylene terephthalate (PET) film having a thickness of 6 μm, and thereafter the surface protective layer was formed on the fluorescent substance layer by a laminating method. As described above, the fluorescent intensifying screen A comprising a support, a light reflective layer, a fluorescent substance layer and a surface protective layer was prepared.

(5) Emission Characteristics

The emission spectrum of the intensifying screen A was measured by X-ray at 40 kVp and is shown in FIG. 1. The fluorescent intensifying screen A showed an emission having a peak at 390 nm and a narrow half band width.

2. Evaluation of Photographic Properties

Evaluation was done similar to Example 2, using the fluorescent intensifying screen on both sides, and using the samples of Examples 2 and 3.

The samples of the present invention showed excellent results similar to Example 2 and 3.

Example 5

1. Preparations of Fluorescent Intensifying Screen

Preparations of fluorescent intensifying screen C, D, and E were conducted in a similar manner to the process in the preparation of fluorescent intensifying screen A, except that changing the coating amount of the fluorescent substance coating solution. The thickness of the fluorescent substance layer and the volume filling factor of the fluorescent substance in the fluorescent intensifying screen prepared above are shown in Table 5.

TABLE 5

| Fluorescent Intensifying Screen | Fluorescent Substance | Thickness of Fluorescent Substance Layer (μm) | Volume Filling Factor of Fluorescent Substance (%) |
|---|---|---|---|
| A | BaFBr:Eu | 125 | 68 |
| C | BaFBr:Eu | 70 | 70 |
| D | BaFBr:Eu | 160 | 66 |
| E | BaFBr:Eu | 250 | 64 |

2. Evaluation of Photographic Properties

The double-sided photosensitive materials were subjected to an X-ray exposure in combination with the fluorescent intensifying screen as described below instead of using the fluorescent intensifying screen A. The frontscreen used herein means a screen located in near side to X-ray source against the material, and the backscreen herein means a screen located in far side from X-ray source.

The photothermographic materials of the present invention similarly give preferable results.

TABLE 6

| Frontscreen | Backscreen |
|---|---|
| A | A |
| C | C |
| C | A |
| C | D |
| C | E |
| A | E |

What is claimed is:

1. A black and white photothermographic material comprising, on at least one side of a support, an image forming layer comprising at least a photosensitive silver halide, a non-photosensitive organic silver salt, a reducing agent for silver ions, and a binder, wherein 1) the non-photosensitive organic silver salt comprises at least one compound selected from the group consisting of a silver salt of an azole compound and a silver salt of a mercapto compound,
2) the photosensitive silver halide has a spectral sensitizing dye in the form of a multilayer adsorbed on its surface, and
3) 50% by weight or more of the binder is formed by a hydrophilic binder.

2. The black and white photothermographic material according to claim 1 wherein the silver salt of an azole compound comprises a silver salt of a nitrogen-containing heterocyclic compound.

3. The black and white photothermographic material according to claim 2, wherein the silver salt of a nitrogen-containing heterocyclic compound comprises at least one compound selected from the group consisting of a silver salt of a triazole compound and a silver salt of a tetrazole compound.

4. The black and white photothermographic material according to claim 3, wherein the silver salt of a nitrogen-containing heterocyclic compound comprises a silver salt of a benzotriazole compound.

5. The black and white photothermographic material according to claim 1, wherein the silver salt of a mercapto compound comprises at least one compound selected from the group consisting of a silver salt of an aliphatic mercapto compound and a silver salt of a heterocyclic mercapto compound.

6. The black and white photothermographic material according to claim 5, wherein the silver salt of a mercapto compound comprises a silver salt of an aliphatic mercapto compound having 10 or more carbon atoms.

7. The black and white photothermographic material according to claim 1, wherein the hydrophilic binder comprises at least one selected from the group consisting of gelatin and a derivative thereof.

8. The black and white photothermographic material according to claim 1, wherein 50% by weight or more of the binder is formed by a polymer latex.

9. The black and white photothermographic material according to claim 1, wherein the reducing agent for silver ions comprises at least one selected from the group consisting of ascorbic acid and a derivative thereof.

10. The black and white photothermographic material according to claim 1 further comprising as a toner at least one compound selected from the group consisting of mercapto triazole and a derivative thereof.

11. The black and white photothermographic material according to claim 1, wherein an average silver bromide content of the photosensitive silver halide is 60 mol % or higher.

12. The black and white photothermographic material according to claim 11, wherein the average silver bromide content of the photosensitive silver halide is 80 mol % or higher.

13. The black and white photothermographic material according to claim 1, wherein an average silver iodide content of the photosensitive silver halide is 40 mol % or higher.

14. The black and white photothermographic material according to claim 13, wherein the average silver iodide content of the photosensitive silver halide is 80 mol % or higher.

15. The black and white photothermographic material according to claim 14, wherein the average silver iodide content of the photosensitive silver halide is 90 mol % or higher.

16. The black and white photothermographic material according to claim 1, wherein 50% or more of a total projected area of the photosensitive silver halide is occupied by tabular grains having an aspect ratio of 2 or more.

17. The black and white photothermographic material according to claim 16, wherein 50% or more of a total projected area of the tabular grains is occupied by grains having an aspect ratio of 5 or more.

18. The black and white photothermographic material according to claim 16, wherein a mean equivalent circular diameter of the tabular grains is 0.3 μm to 8.0 μm.

19. The black and white photothermographic material according to claim 18, wherein a variation coefficient of the equivalent circular diameter distribution is 20% or less.

20. The black and white photothermographic material according to claim 16, wherein a mean thickness of the tabular grains is 0.01 μm to 0.3 μm.

21. The black and white photothermographic material according to claim 20, wherein a variation coefficient of the thickness distribution is 20% or less.

22. The black and white photothermographic material according to claim 13 further comprising a silver iodide complex-forming agent.

23. The black and white photothermographic material according to claim 1 further comprising a nucleator, wherein an average gradient of a photographic characteristic curve is 1.8 to 4.3.

24. The black and white photothermographic material according to claim 1, wherein the image forming layer is provided on both sides of the support.

25. An image forming method comprising:

(a) providing a black and white photothermographic material comprising, on at least one side of a support, an image forming layer comprising at least a photosensitive silver halide, a non-photosensitive organic silver salt, a reducing agent for silver ions, and a binder, wherein 1) the non-photosensitive organic silver salt comprises at least one compound selected from the group consisting of a silver salt of an azole compound and a silver salt of a mercapto compound, 2) the photosensitive silver halide has a spectral sensitizing dye in the form of a multilayer adsorbed on its surface, and 3) 50% by weight or more of the binder is formed by a hydrophilic binder; and (b) subjecting the black and white photothermographic material to imagewise exposure and thermal development, wherein the imagewise exposure comprises bringing the black and white photothermographic material into close contact with a fluorescent intensifying screen containing a fluorescent substance, wherein 50% or more of emission light of the fluorescent substance has a wavelength of 350 nm to 420 nm, and applying imagewise X-ray exposure.

26. The image forming method according to claim 25, wherein the fluorescent substance is a divalent europium activated fluorescent substance.

27. The image forming method according to claim 26, wherein the fluorescent substance is a divalent europium activated barium halide fluorescent substance.

* * * * *